US009188906B2

(12) United States Patent
Batori et al.

(10) Patent No.: US 9,188,906 B2
(45) Date of Patent: Nov. 17, 2015

(54) CARTRIDGE, DEVELOPING CARTRIDGE, PROCESS CARTRIDGE AND IMAGE FORMING APPARATUS

(71) Applicant: CANON KABUSHIKI KAISHA, Tokyo (JP)

(72) Inventors: Yoshiyuki Batori, Suntou-gun (JP); Toshiaki Takeuchi, Susono (JP); Ryuta Murakami, Suntou-gun (JP); Daisuke Makiguchi, Izunokuni (JP); Junichi Matsumura, Numazu (JP); Hiroomi Matsuzaki, Mishima (JP); Kazuki Matsumoto, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/069,597

(22) Filed: Nov. 1, 2013

(65) Prior Publication Data

US 2014/0126928 A1 May 8, 2014

(30) Foreign Application Priority Data

Nov. 6, 2012 (JP) ..... 2012-244341
Oct. 17, 2013 (JP) ..... 2013-215929

(51) Int. Cl.
*G03G 15/08* (2006.01)
*G03G 21/18* (2006.01)

(52) U.S. Cl.
CPC ..... *G03G 15/0881* (2013.01); *G03G 21/1832* (2013.01)

(58) Field of Classification Search
CPC ..... G03G 15/0817; G03G 15/0875; G03G 15/0898; G03G 15/0812; G03G 15/0882; G03G 15/0884; G03G 15/0894; G03G 15/0865; G03G 15/0855; G03G 2215/0177; G03G 2215/0692; G03G 15/0877; G03G 2215/0687
See application file for complete search history.

(56) References Cited

U.S. PATENT DOCUMENTS

| | | | |
|---|---|---|---|
| 5,742,877 | A | 4/1998 | Okada et al. |
| 5,911,096 | A | 6/1999 | Batori et al. |
| 5,920,753 | A | 7/1999 | Sasaki et al. |
| 5,930,562 | A | 7/1999 | Noda et al. |
| 5,937,237 | A | 8/1999 | Nonaka et al. |
| 5,940,658 | A | 8/1999 | Yokoi et al. |
| 5,943,529 | A | 8/1999 | Miyabe et al. |
| 5,966,567 | A | 10/1999 | Matsuzaki et al. |
| 6,011,941 | A | 1/2000 | Takashima et al. |
| 6,075,957 | A | 6/2000 | Batori et al. |
| 6,097,906 | A | 8/2000 | Matsuzaki et al. |

(Continued)

FOREIGN PATENT DOCUMENTS

| | | |
|---|---|---|
| JP | 05197288 | 8/1993 |
| JP | 08248752 | 9/1996 |

*Primary Examiner* — Roy Y Yi
(74) *Attorney, Agent, or Firm* — Fitzpatrick, Cella, Harper & Scinto

(57) ABSTRACT

A cartridge includes: a toner chamber, provided with an opening, for accommodating a toner; and a seal member including a sealing portion, elongated in a longitudinal direction of the cartridge, for unsealably sealing the opening and a mounting portion for being mounted on an unsealing member to unseal the opening. The sealing portion includes a first sealing portion located at a longitudinal end portion and a second sealing portion located at a longitudinal central portion. With respect to a direction crossing the longitudinal direction, a length between the first sealing portion and the mounting portion of the seal member is shorter than a length between the second sealing portion and the mounting portion.

76 Claims, 24 Drawing Sheets

(56) References Cited

U.S. PATENT DOCUMENTS

| | | | | |
|---|---|---|---|---|
| 6,101,348 | A | 8/2000 | Nonaka et al. | |
| 6,131,007 | A | 10/2000 | Yamaguchi et al. | |
| 6,144,815 | A | 11/2000 | Chadani et al. | |
| 6,173,140 | B1 | 1/2001 | Suzuki et al. | |
| 6,173,145 | B1 | 1/2001 | Chadani et al. | |
| 6,205,305 | B1 | 3/2001 | Suzuki et al. | |
| 6,219,504 | B1 | 4/2001 | Matsuzaki et al. | |
| 6,275,668 | B1 | 8/2001 | Batori | |
| 6,282,389 | B1 | 8/2001 | Matsuzaki et al. | |
| 6,334,035 | B1 | 12/2001 | Abe et al. | |
| 6,363,226 | B1 | 3/2002 | Batori | |
| 6,405,004 | B2 | 6/2002 | Matsuzaki et al. | |
| 6,549,736 | B2 | 4/2003 | Miyabe et al. | |
| 6,714,746 | B2 | 3/2004 | Morioka et al. | |
| 6,735,405 | B2 | 5/2004 | Yokoi et al. | |
| 6,792,229 | B2 | 9/2004 | Matsuzaki | |
| 6,795,666 | B2 | 9/2004 | Miyabe et al. | |
| 6,836,639 | B2 | 12/2004 | Karakama et al. | |
| 6,898,392 | B2 | 5/2005 | Karakama et al. | |
| 6,931,226 | B2 | 8/2005 | Chadani et al. | |
| 6,934,485 | B2 | 8/2005 | Miyabe et al. | |
| 6,937,832 | B2 | 8/2005 | Sato et al. | |
| 6,963,706 | B2 | 11/2005 | Morioka et al. | |
| 6,987,938 | B2 | 1/2006 | Muraskami et al. | |
| 7,024,131 | B2 | 4/2006 | Komatsu et al. | |
| 7,079,787 | B2 | 7/2006 | Ogino et al. | |
| 7,127,192 | B2 | 10/2006 | Batori et al. | |
| 7,136,604 | B2 | 11/2006 | Chadani et al. | |
| 7,156,797 | B2 | 1/2007 | Komatsu et al. | |
| 7,200,349 | B2 | 4/2007 | Sato et al. | |
| 7,206,534 | B2 | 4/2007 | Murakami | |
| 7,224,925 | B2 | 5/2007 | Sato et al. | |
| 7,349,657 | B2 | 3/2008 | Sato et al. | |
| 7,412,193 | B2 | 8/2008 | Sato et al. | |
| 7,418,225 | B2 | 8/2008 | Morioka et al. | |
| 7,680,430 | B2 * | 3/2010 | Mori et al. | 399/103 |
| 7,885,575 | B2 | 2/2011 | Batori et al. | |
| 8,081,898 | B2 | 12/2011 | Batori et al. | |
| 8,326,185 | B2 | 12/2012 | Asanuma et al. | |
| 8,406,656 | B2 | 3/2013 | Batori et al. | |
| 8,565,640 | B2 | 10/2013 | Batori et al. | |
| 8,620,181 | B2 | 12/2013 | Murakami | |
| 8,644,732 | B2 | 2/2014 | Kikuchi et al. | |
| 8,676,085 | B1 | 3/2014 | Batori et al. | |
| 2001/0033756 | A1 * | 10/2001 | Shiratori et al. | 399/103 |
| 2003/0202816 | A1 * | 10/2003 | Kacinski et al. | 399/106 |
| 2010/0061771 | A1 * | 3/2010 | Wazana et al. | 399/262 |
| 2011/0170906 | A1 | 7/2011 | Matsushita et al. | |
| 2013/0136489 | A1 | 5/2013 | Yamaguchi et al. | |
| 2013/0164039 | A1 | 6/2013 | Matsushita et al. | |
| 2013/0336679 | A1 | 12/2013 | Furutani et al. | |
| 2013/0343785 | A1 | 12/2013 | Masuzaki et al. | |
| 2014/0016961 | A1 | 1/2014 | Yasui et al. | |
| 2014/0029974 | A1 | 1/2014 | Useugi et al. | |
| 2014/0064793 | A1 | 3/2014 | Matsuzaki et al. | |
| 2014/0072329 | A1 | 3/2014 | Useugi et al. | |
| 2014/0072331 | A1 | 3/2014 | Matsushita et al. | |
| 2014/0072345 | A1 | 3/2014 | Matsunaga et al. | |
| 2014/0072346 | A1 | 3/2014 | Furutani et al. | |
| 2014/0072347 | A1 | 3/2014 | Furutani et al. | |
| 2014/0079432 | A1 | 3/2014 | Matsuzaki et al. | |
| 2014/0086620 | A1 | 3/2014 | Takeuchi et al. | |
| 2014/0086621 | A1 | 3/2014 | Makiguchi et al. | |
| 2014/0086632 | A1 | 3/2014 | Batori et al. | |
| 2014/0093272 | A1 | 4/2014 | Matsumaru et al. | |

* cited by examiner (a)

(b)

(c)

(a)

(b)

(a)

(b)

(a)

(b)

(a)

(b)

(a)

(b)

CARTRIDGE, DEVELOPING CARTRIDGE, PROCESS CARTRIDGE AND IMAGE FORMING APPARATUS

FIELD OF THE INVENTION AND RELATED ART

The present invention relates to a developing cartridge and a process cartridge which are to be provided in an image forming apparatus, and relates to the image forming apparatus.

As a printer, a copying machine, a facsimile machine or the like, the image forming apparatus for forming an image on a sheet material by using an electrophotographic image forming type is used.

Here, the process cartridge refers to a process cartridge prepared by integrally assembling a photosensitive drum and, as a process means, at least one of a charging device, a developing device and a cleaning device into a cartridge. Then, this process cartridge is detachably mounted into a main assembly of the image forming apparatus.

The image forming apparatus using the electrophotographic image forming type forms an electrostatic latent image by subjecting the photosensitive drum, which surface is uniformly electrically charged by a charging means, to selective exposure to light depending on image information. Then, the electrostatic latent image is developed with a toner by a developing means, so that a toner image is formed. Thereafter, the toner image formed on the surface of the photosensitive drum is transferred onto the sheet material to effect image formation.

Japanese Laid-Open Patent Application (JP-A) Hei 5-197288 discloses that a toner supplying opening for permitting communication between a toner chamber and a toner supplying chamber is sealed by using a toner seal member, and then the toner seal member is unsealed by a rotatable member.

The unsealing of the toner seal member is performed by automatically winding up the toner seal member, around the rotatable member, mounted at an end thereof on the rotatable member in the toner chamber. After the unsealing of the toner seal member, the toner seal member is rotated integrally with the rotatable member.

As a result, it is possible to prevent leakage of the toner caused by vibration or impact during transportation of the process cartridge. The toner seal member remains in the process cartridge, and therefore there is no need for a user to treat the toner seal member. Further, there is no need for the user to unseal the toner seal member, and therefore usability (ease of use) is improved.

However, in the case where an automatic winding constitution of the toner seal member shown in JP-A Hei 5-197288 is provided in the image forming apparatus, capacity of a power source is required depending on a winding manner and there is a need to ensure strength of parts of a driving system correspondingly to the increased capacity. For this reason, there is a fear that the image forming apparatus is increased in size, thus leading to an increase in cost.

SUMMARY OF THE INVENTION

The present invention has solved the above-described problem, and a principal object of the present invention to provide a cartridge capable of peeling a sealing portion of a seal member at a low load.

According to an aspect of the present invention, there is provided a cartridge comprising: a toner chamber, provided with an opening, for accommodating a toner; and a seal member including a sealing portion, elongated in a longitudinal direction of the cartridge, for unsealably sealing the opening and a mounting portion for being mounted on an unsealing member to unseal the opening, wherein the sealing portion includes a first sealing portion located at a longitudinal end portion and a second sealing portion located at a longitudinal central portion, and wherein with respect to a direction crossing the longitudinal direction, a length between the first sealing portion and the mounting portion of the seal member is shorter than a length between the second sealing portion and the mounting portion.

According to the above constitution, the length between the sealing portion and the mounting portion of the toner seal member with respect to the direction crossing the longitudinal direction of the cartridge is different between at the longitudinal end portion and at the longitudinal central portion of the cartridge. As a result, a peeling force for peeling the sealing portion of the toner seal member acts at an oblique angle, so that the peeling of the sealing portion of the toner seal member can be effected at a low load.

These and other objects, features and advantages of the present invention will become more apparent upon a consideration of the following description of the preferred embodiments of the present invention taken in conjunction with the accompanying drawings.

Figure 7:
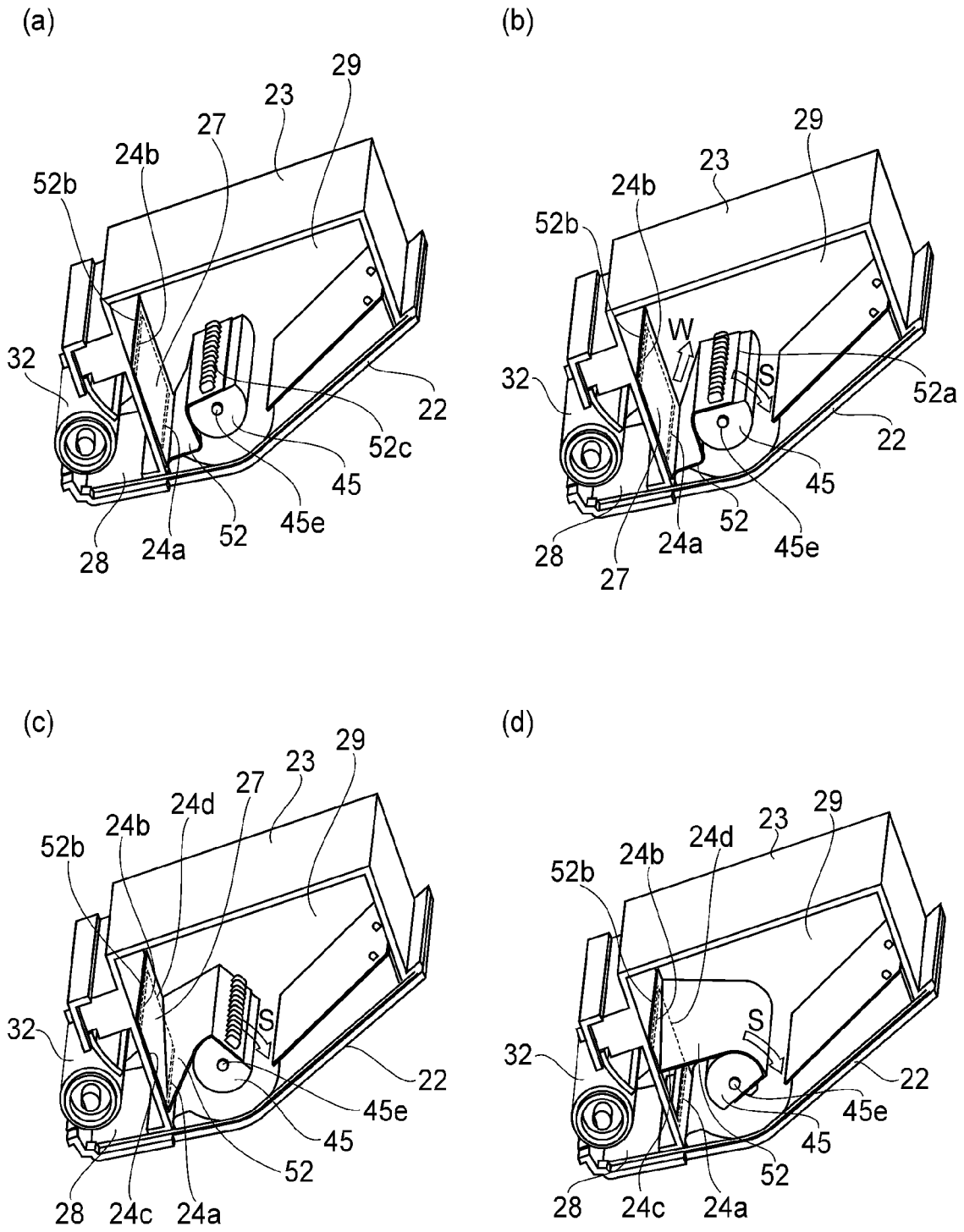

Parts (a) to (d) of FIG. 7 are perspective views for illustrating an unsealing operation of a toner seal member in Embodiment 1.

Figure 8:
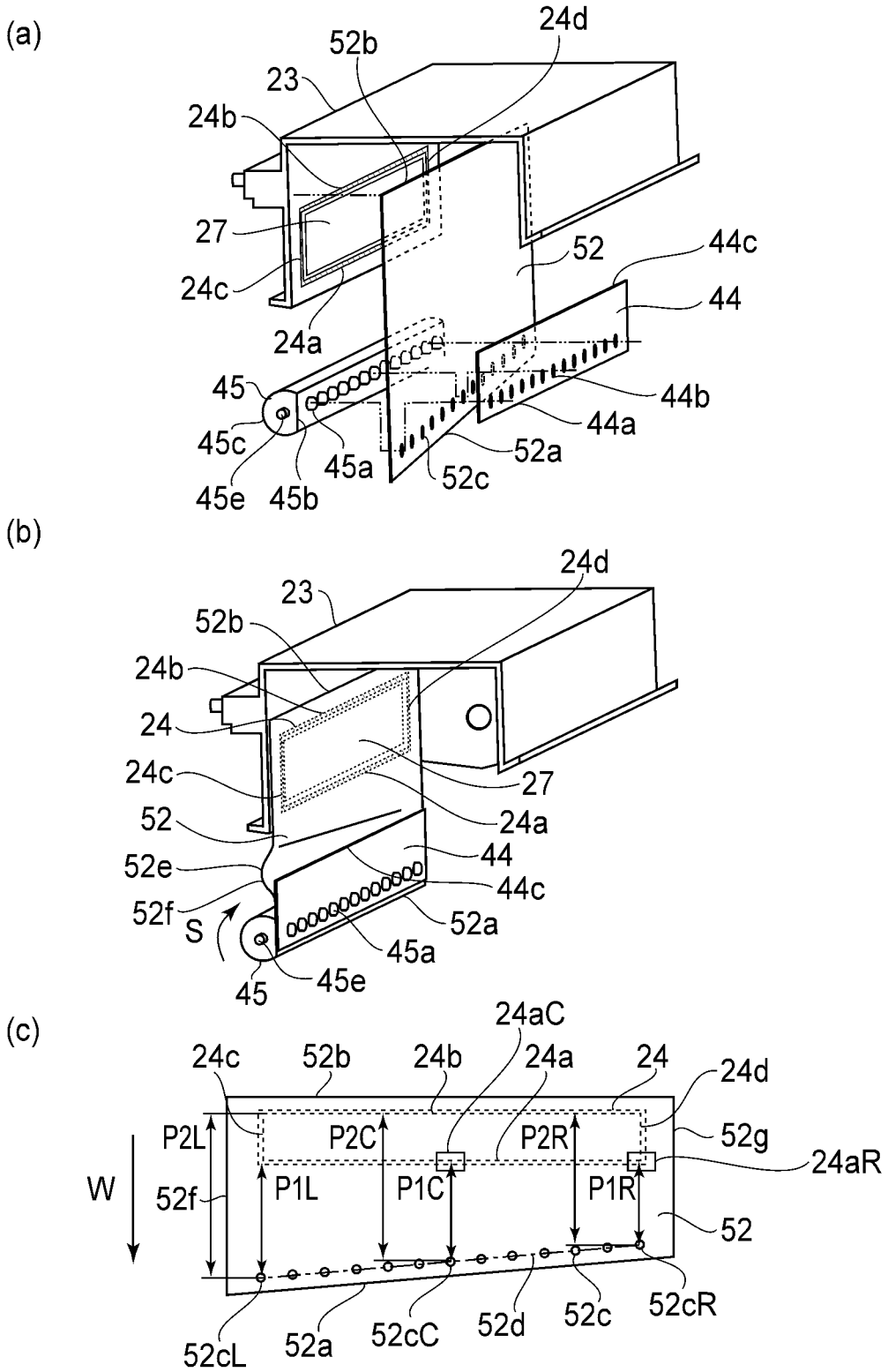

Part (a) of FIG. 8 is an exploded perspective view for illustrating a positional relationship among an opening communicating with a toner chamber, the toner seal member, a sealing portion, a rotatable member and a conveying sheet in Embodiment 1. Part (b) of FIG. 8 is a perspective illustration showing a state in which the opening communicating with the toner chamber is sealed with the sealing portion of the seal member to assemble the toner seal member and the conveying sheet with the rotatable member in Embodiment 1. Part (c) of FIG. 8 is a plan view showing a structure of the toner seal member in Embodiment 1.

Figure 9:
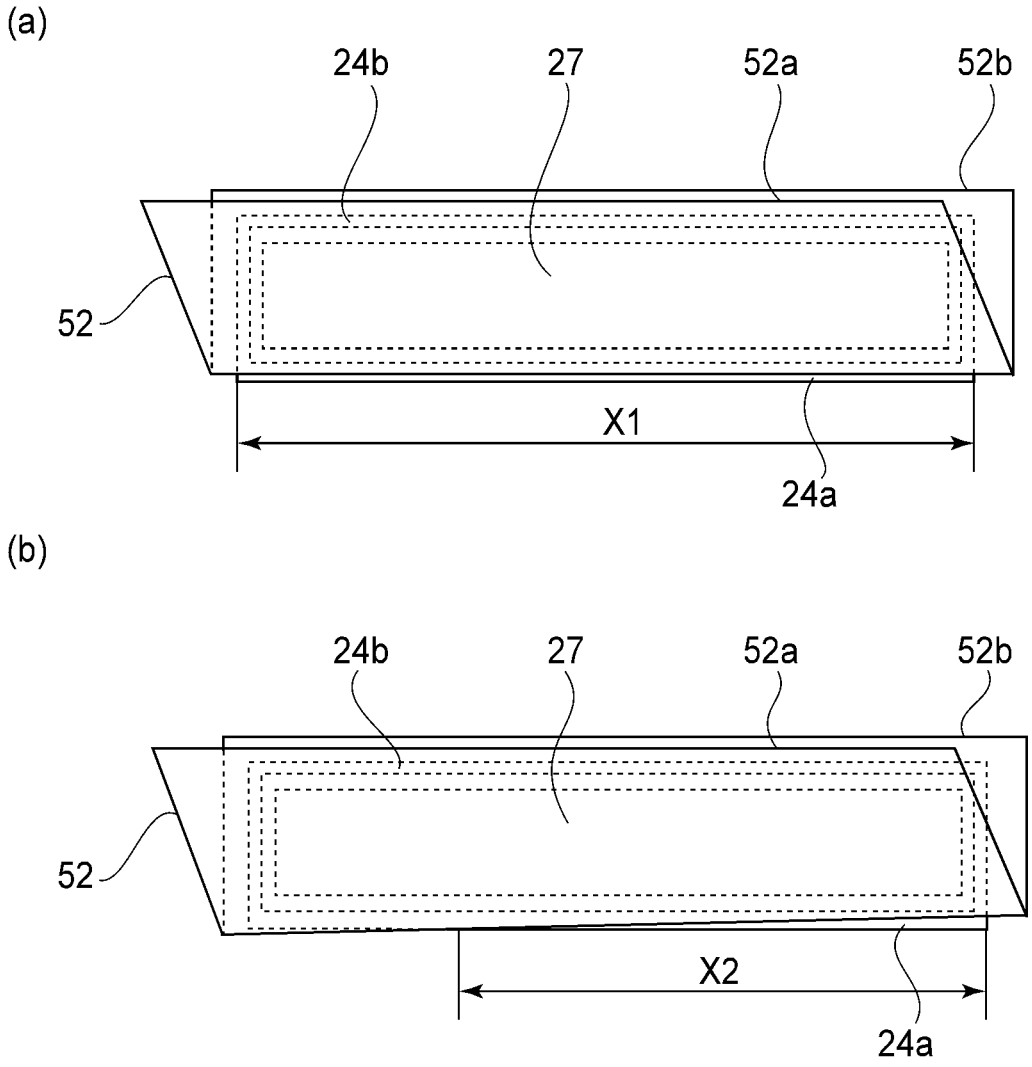

Part (a) of FIG. 9 is a perspective view for illustrating a peeling manner of a toner seal member in Comparison example, and (b) of FIG. 9 is a perspective view for illustrating a peeling manner of the toner seal member in Embodiment 1.

Figure 10:
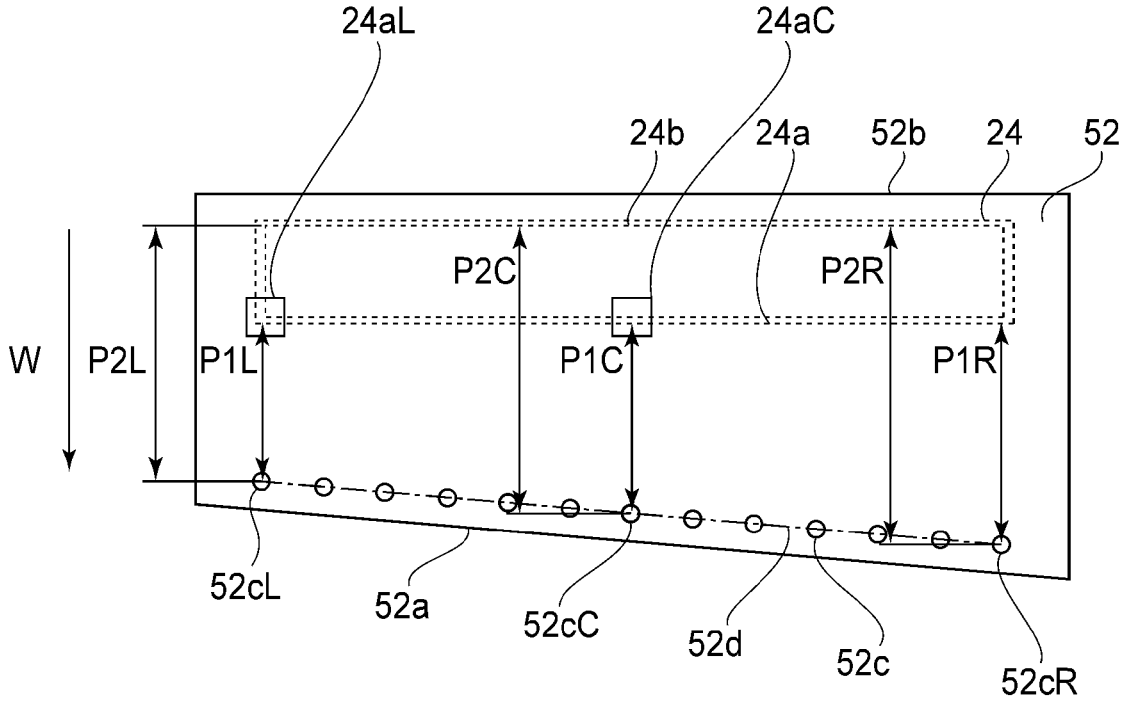

FIG. 10 is a plan view showing a structure of a toner seal member in Embodiment 2 in the image forming apparatus in which the process cartridge also functioning as the developing cartridge as the cartridge according to the direction is provided.

Figure 11:
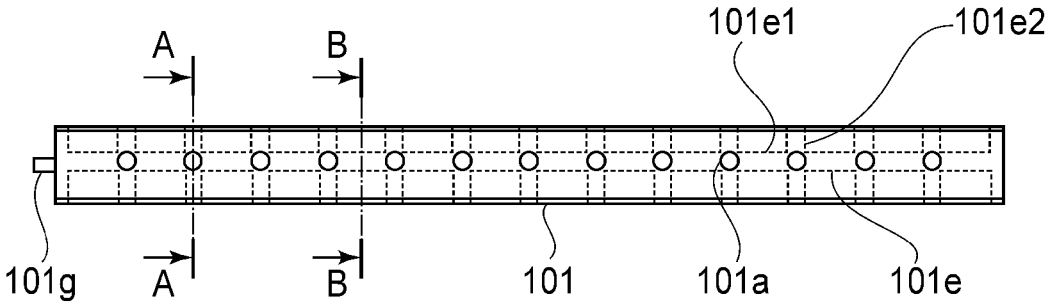
Figure 11:
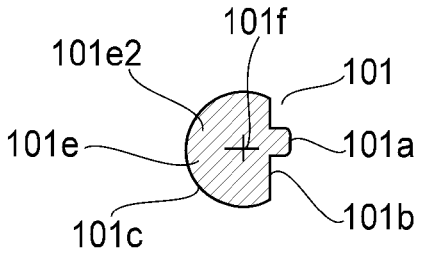
Figure 11:
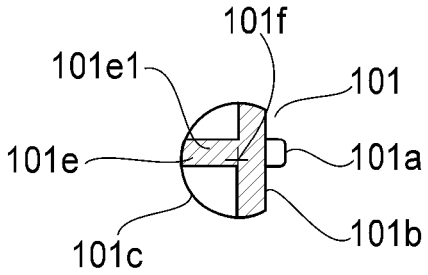

Part (a) of FIG. 11 is a sectional illustration showing a structure of a rotatable member in Embodiment 3 in the image forming apparatus in which the process cartridge also functioning as the developing cartridge as the cartridge according to the present invention is provided, (b) of FIG. 11 is a sectional view taken along A-A line of (a), and (c) of FIG. 11 is a sectional view taken along B-B line of (a).

Figure 12:
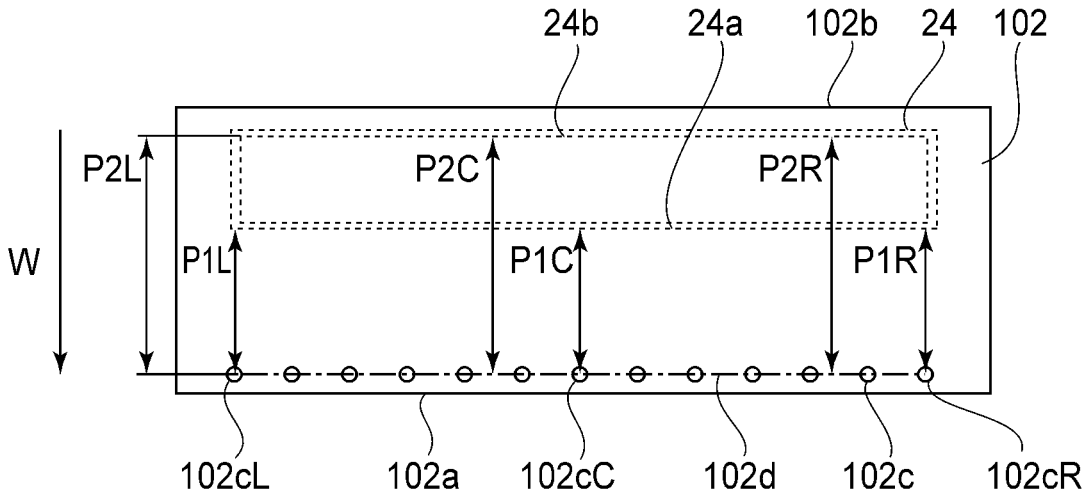

FIG. 12 is a plan view showing a structure of the toner seal member in Comparison example.

Figure 13:
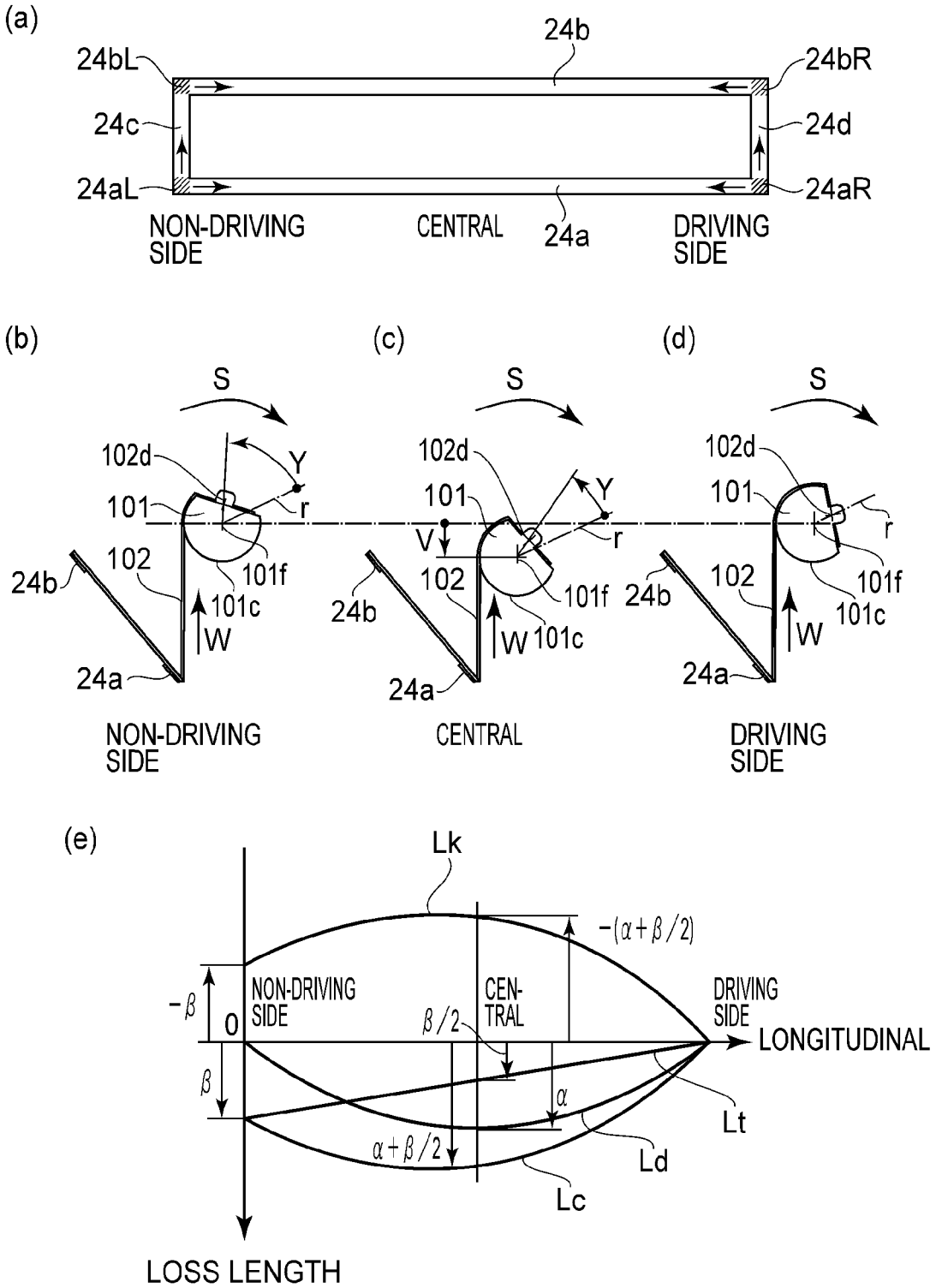

Part (a) of FIG. 13 is a plan view for illustrating a state in which a sealing portion of the toner seal member is unsealed with deformation of a rotatable member in Comparison example, (b) of FIG. 13 is a sectional view for illustrating flexure and torsion with the deformation of the rotatable member in a non-driving side of the rotatable member in Comparison example, (c) of FIG. 13 is a sectional view for illustrating flexure and torsion with the deformation of the rotatable member at a central portion of the rotatable member with respect to a rotational axis direction of the rotatable member in Comparison example, (d) of FIG. 13 is a sectional view for illustrating flexure and torsion with the deformation of the rotatable member in a driving side of the rotatable member in Comparison example, and (e) of FIG. 13 is a schematic view showing a curve for illustrating cancel of loss due to flexure and torsion of the rotatable member with the deformation of the rotatable member in Comparison example.

Figure 14:
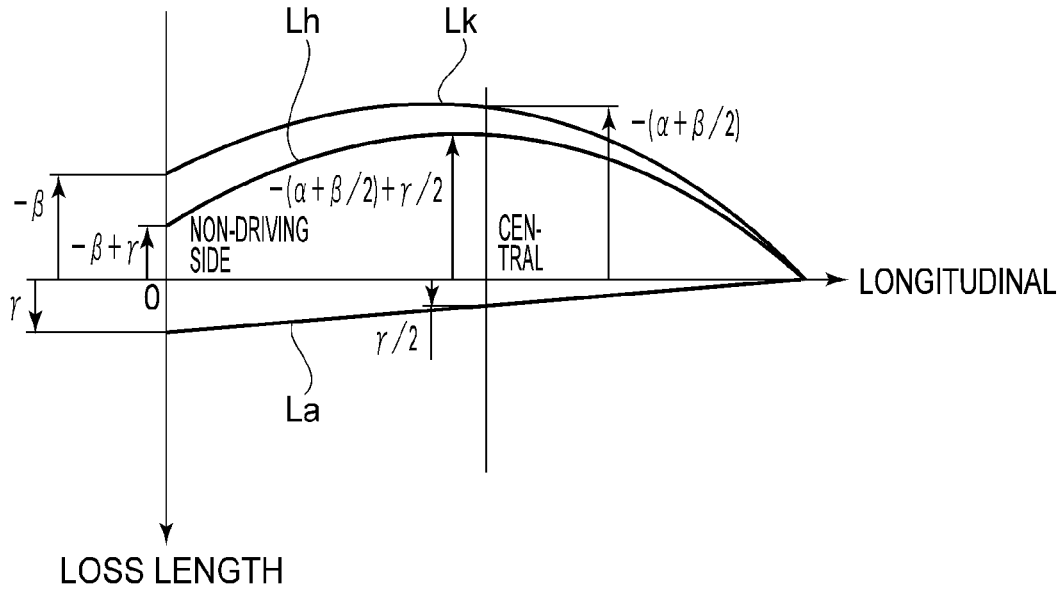
Figure 14:
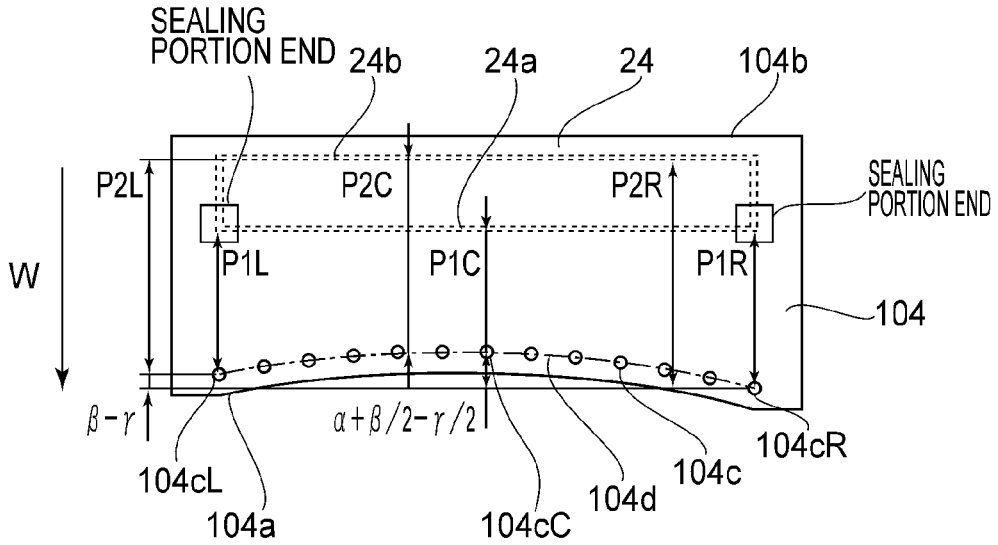

Part (a) of FIG. 14 is a schematic view for illustrating winding loss with deformation of a rotatable member in Embodiment 3, and (b) of FIG. 14 is a plan view for illustrating a positional relationship between a sealing portion and a mounting portion of a toner seal member in Embodiment 3.

Figure 15:
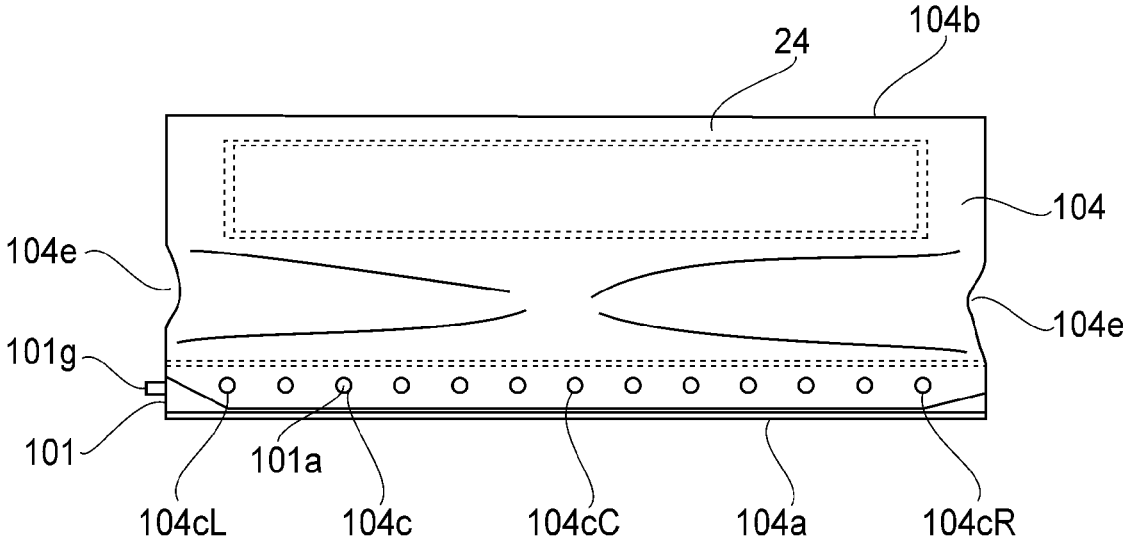

FIG. 15 is a front illustration showing a toner seal member which seals an opening, communicating with a toner chamber, with a sealing portion and showing a state in which the toner seal member is mounted on the rotatable member at a mounting portion in Embodiment 3.

Figure 16:
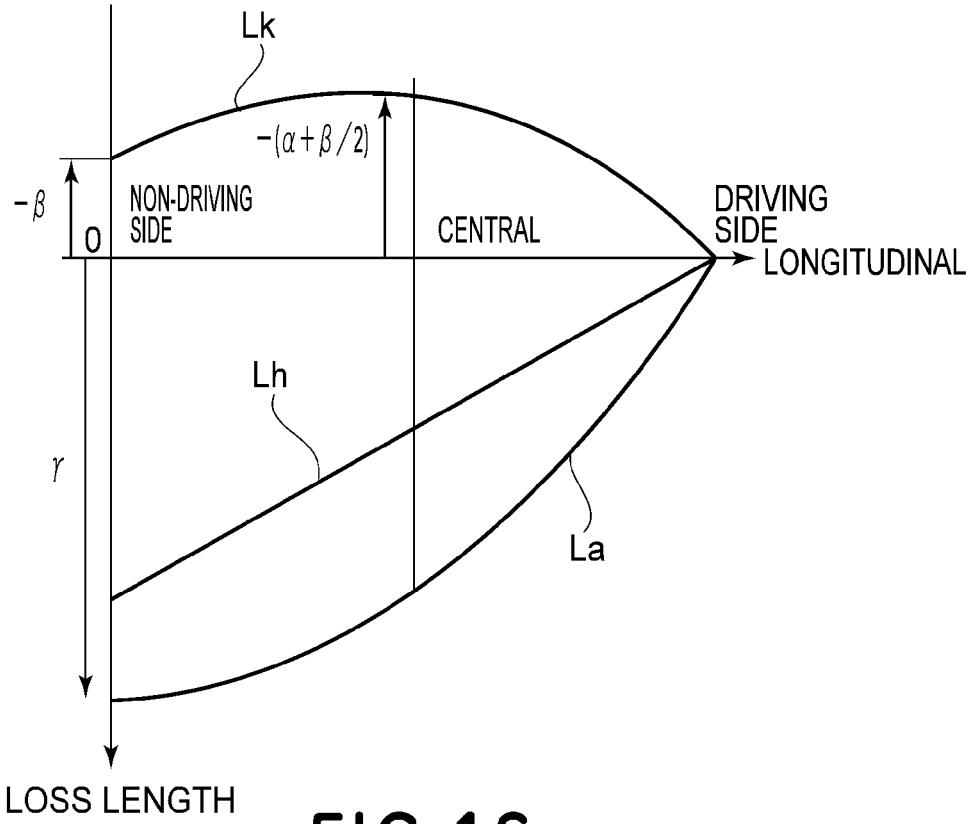

FIG. 16 is a schematic view for illustrating winding loss with deformation of the rotatable member in Embodiment 3.

Figure 17:
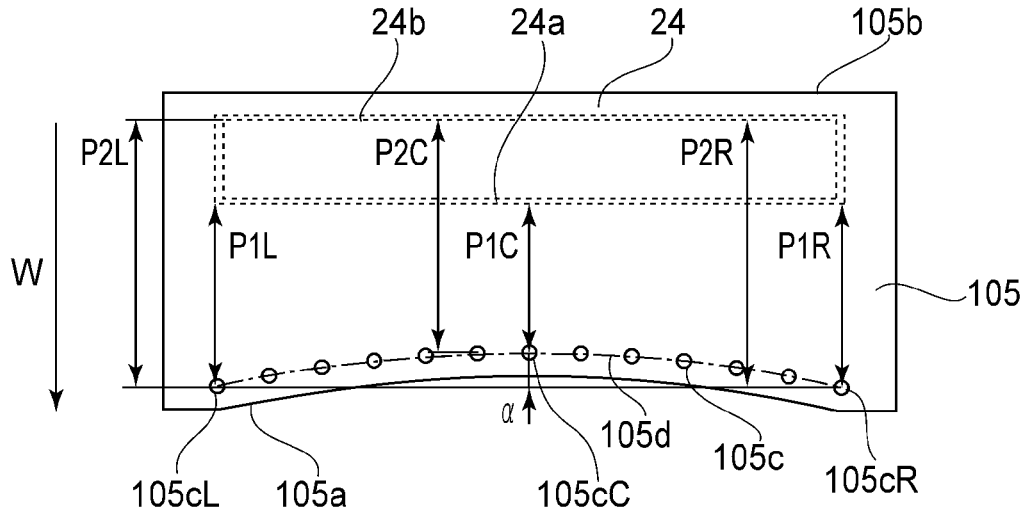
Figure 17:
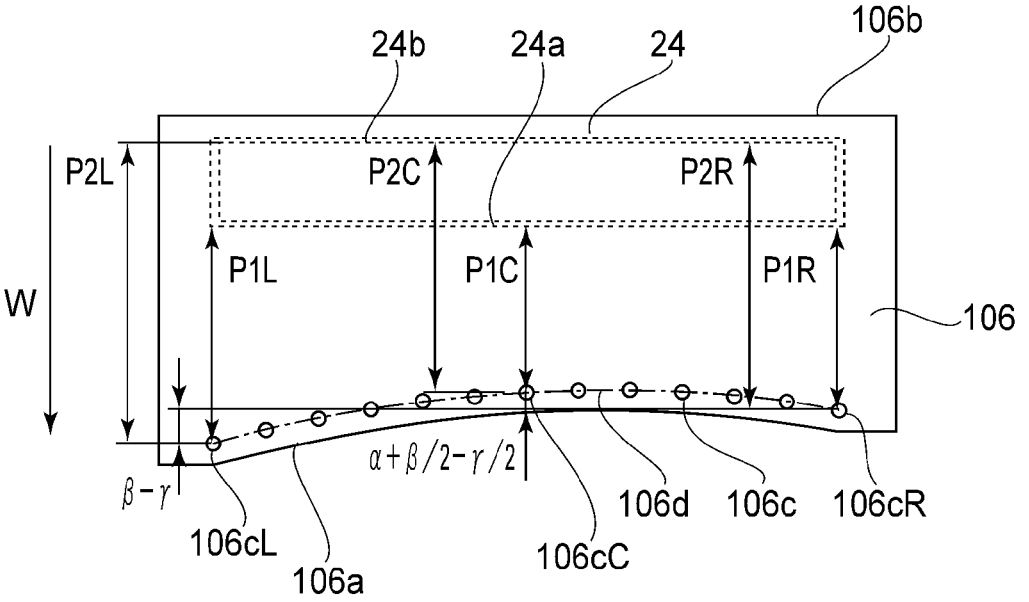

Part (a) of FIG. 17 is a plan view for illustrating a positional relationship between a sealing portion and a mounting portion of a toner seal member in Embodiment 4 in the image forming apparatus in which the process cartridge functioning as the developing cartridge as the cartridge according to the present invention is provided. Part (b) of FIG. 17 is a plan view for illustrating a positional relationship between a sealing portion and a mounting portion of a toner seal member in Embodiment 5 in the image forming apparatus in which the process cartridge functioning as the developing cartridge as the cartridge according to the present invention is provided.

Figure 18:
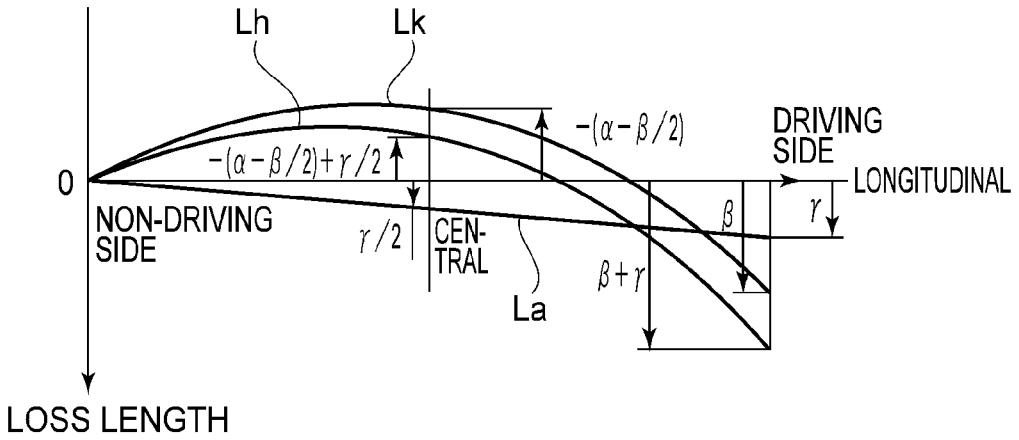
Figure 18:
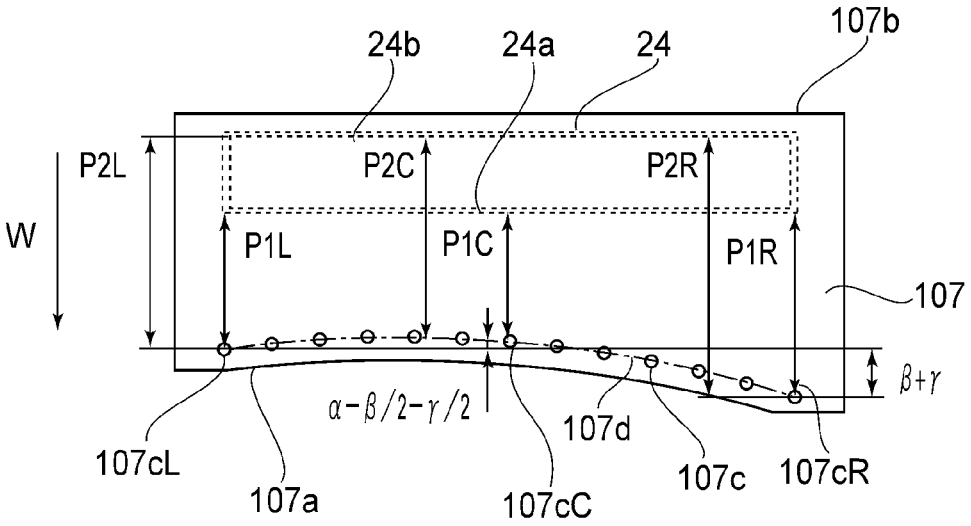

Part (a) of FIG. 18 is a schematic view for illustrating winding loss with deformation of a rotatable member in Embodiment 6 in the image forming apparatus in which the process cartridge functioning as the developing cartridge as the cartridge according to the present invention is provided. Part (b) of FIG. 18 is a plan view for illustrating a positional relationship between a sealing portion and a mounting portion of a toner seal member in Embodiment 6.

Figure 19:
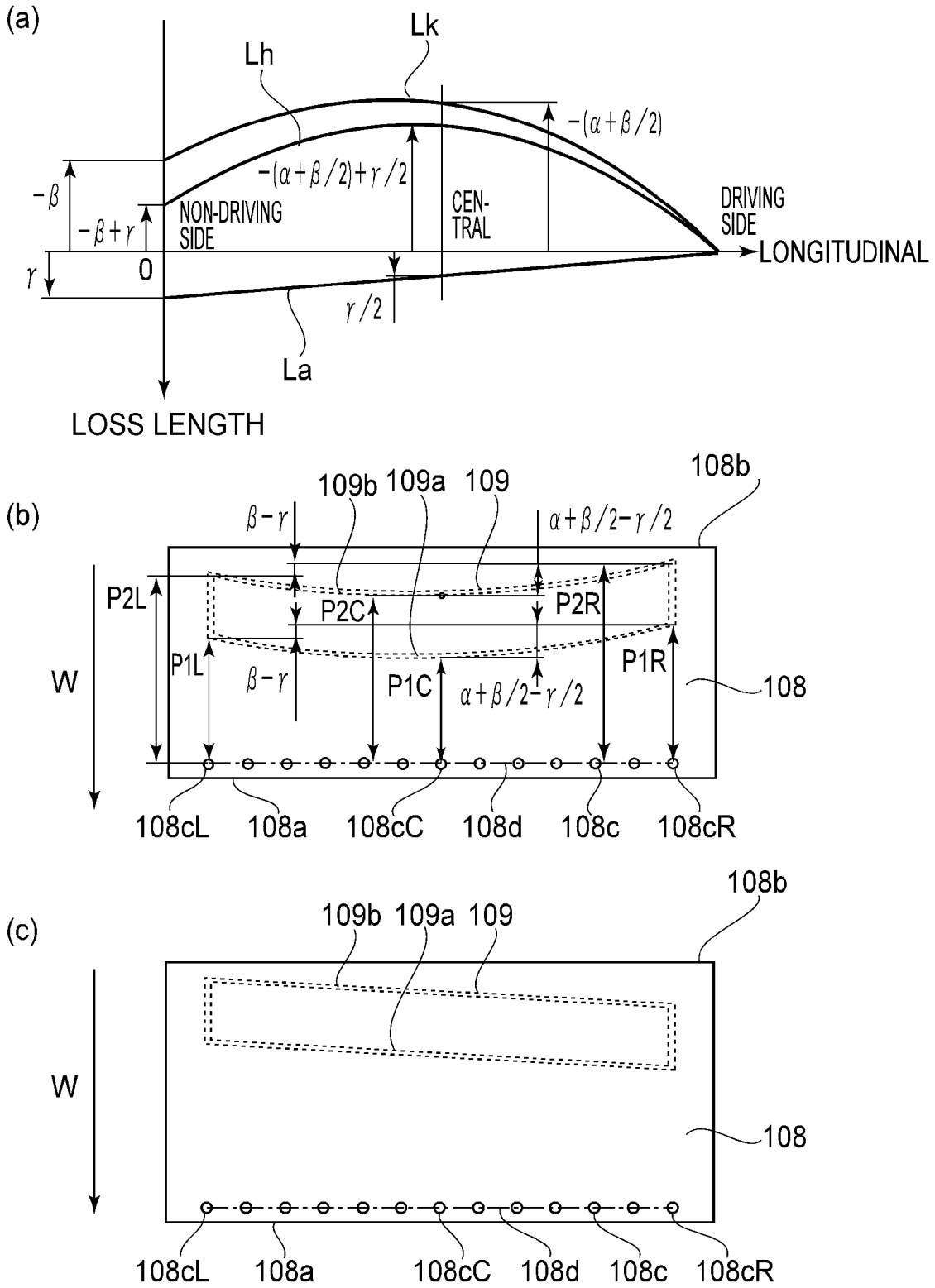

Part (a) of FIG. 19 is a schematic view for illustrating winding loss with deformation of a rotatable member in Embodiment 7 in the image forming apparatus in which the process cartridge functioning as the developing cartridge as the cartridge according to the present invention is provided. Part (b) of FIG. 19 is a plan view for illustrating a positional relationship between a sealing portion and a mounting portion of a toner seal member in Embodiment 7. Part (c) of FIG. 19 is a plan view for illustrating a positional relationship between a sealing portion and a mounting portion of a toner seal member in Embodiment 8 in the image forming apparatus in which the process cartridge functioning as the developing cartridge as the cartridge according to the present invention is provided.

Figure 20:
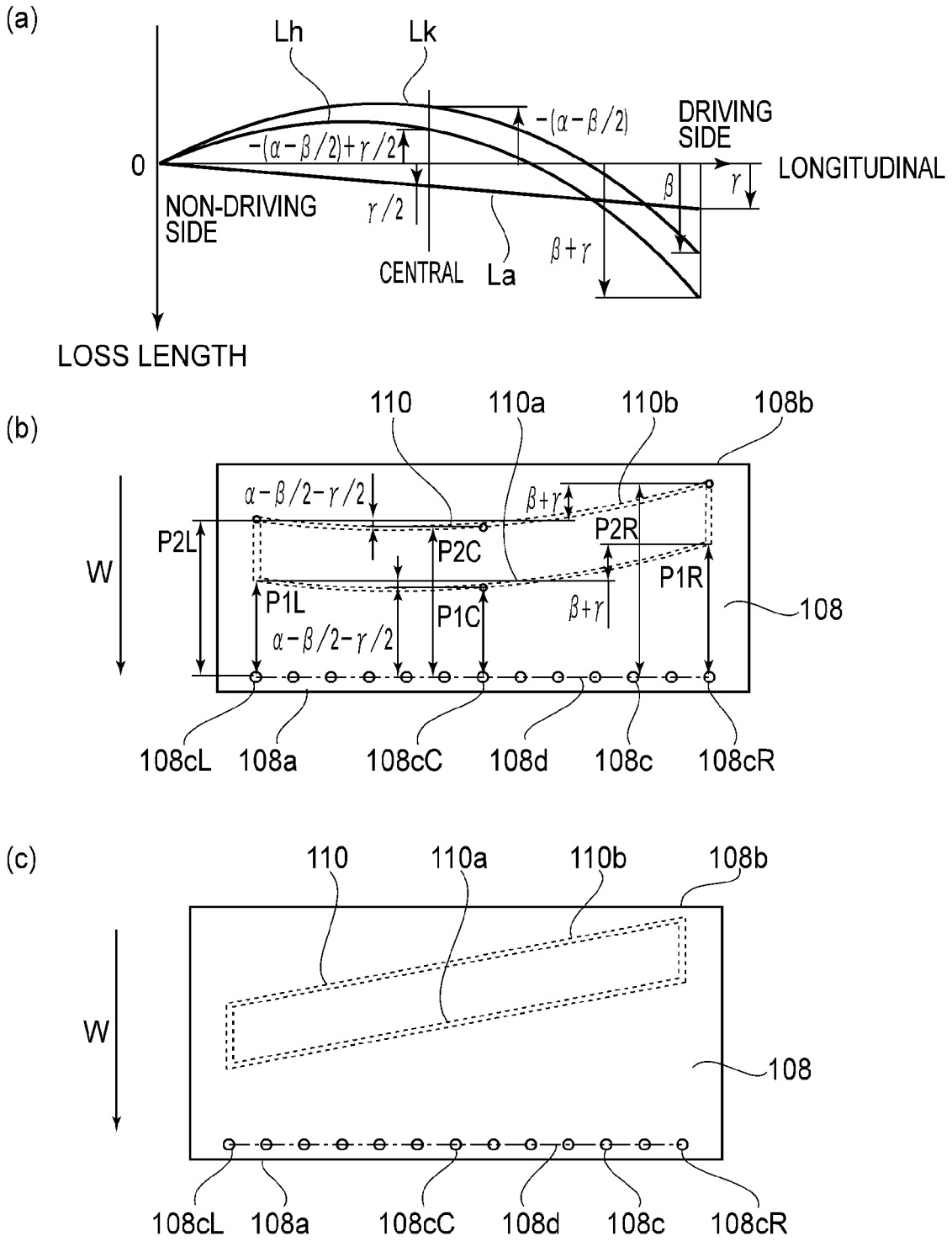

Part (a) of FIG. 20 is a schematic view for illustrating winding loss with deformation of a rotatable member in Embodiment 9 in the image forming apparatus in which the process cartridge functioning as the developing cartridge as the cartridge according to the present invention is provided. Part (b) of FIG. 20 is a plan view for illustrating a positional relationship between a sealing portion and a mounting portion of a toner seal member in Embodiment 9. Part (c) of FIG. 20 is a plan view for illustrating a positional relationship between a sealing portion and a mounting portion of a toner seal member in Embodiment 10 in the image forming apparatus in which the process cartridge functioning as the developing cartridge as the cartridge according to the present invention is provided.

Figure 21:
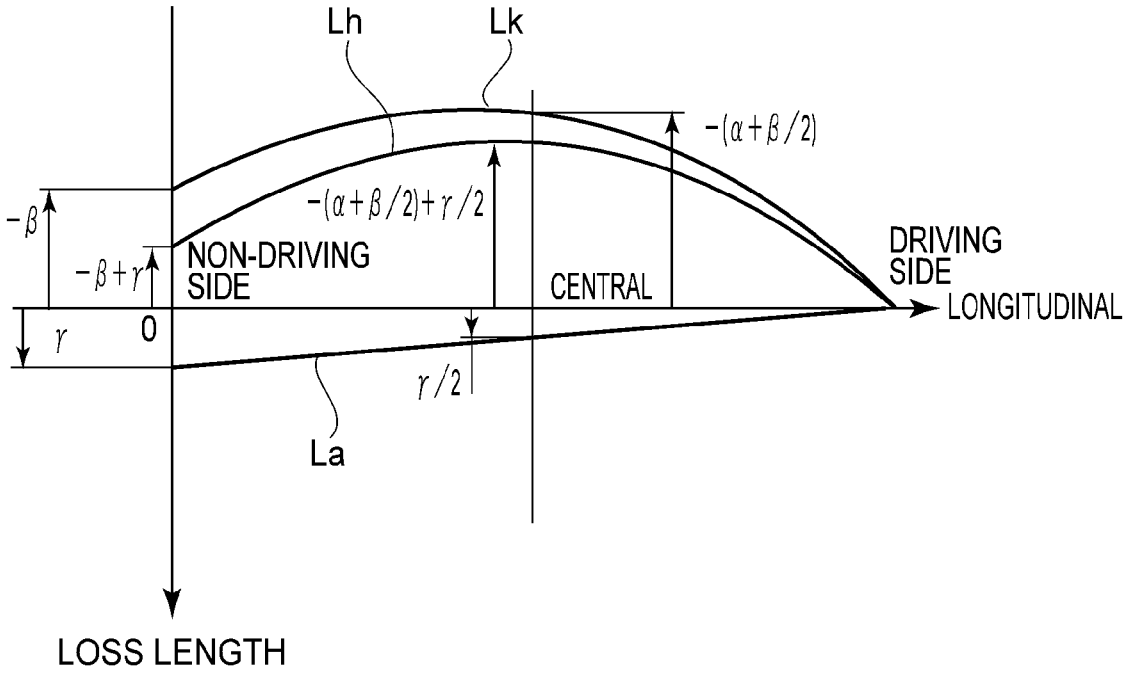
Figure 21:
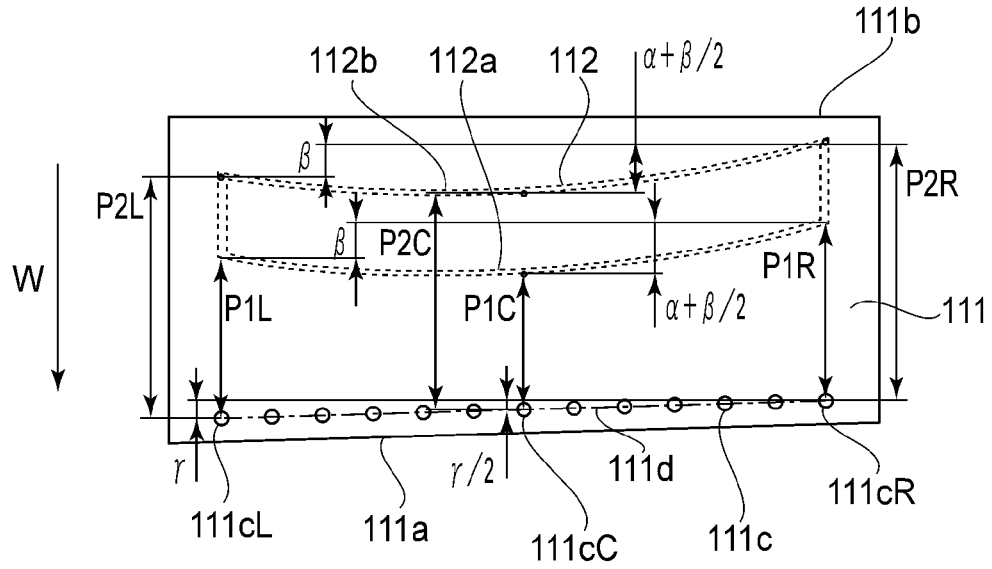

Part (a) of FIG. 21 is a schematic view for illustrating winding loss with deformation of a rotatable member in Embodiment 11 in the image forming apparatus in which the process cartridge functioning as the developing cartridge as the cartridge according to the present invention is provided. Part (b) of FIG. 21 is a plan view for illustrating a positional relationship between a sealing portion and a mounting portion of a toner seal member in Embodiment 11.

Figure 22:
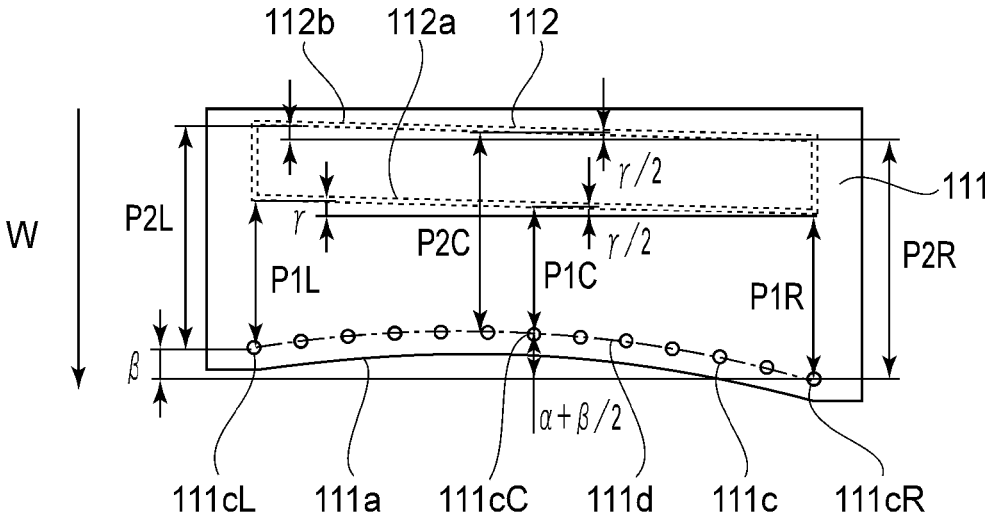

FIG. 22 is a plan view for illustrating a positional relationship between a sealing portion and a mounting portion of a toner seal member in Embodiment 12 in the image forming apparatus in which the process cartridge functioning as the developing cartridge as the cartridge according to the present invention is provided.

Figure 23:
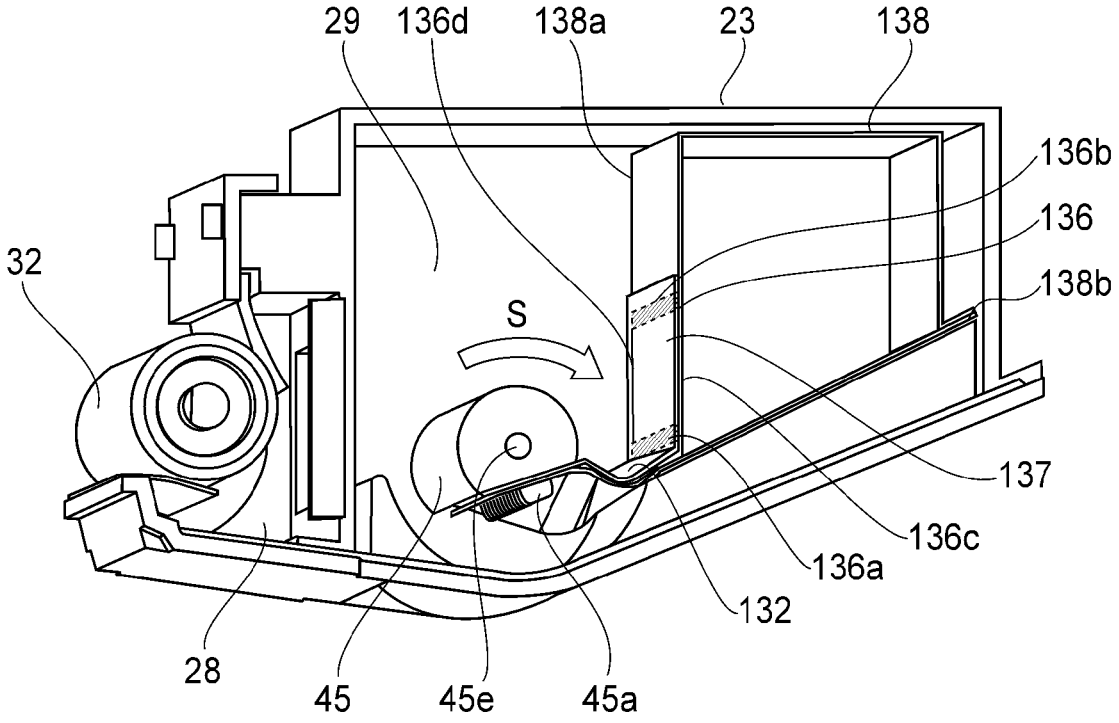

FIG. 23 is a perspective view showing a structure of a toner seal member and a toner accommodating portion constituted by a flexible container in Embodiment 13 in the image forming apparatus in which the process cartridge functioning as the developing cartridge as the cartridge according to the present invention is provided.

Figure 24:
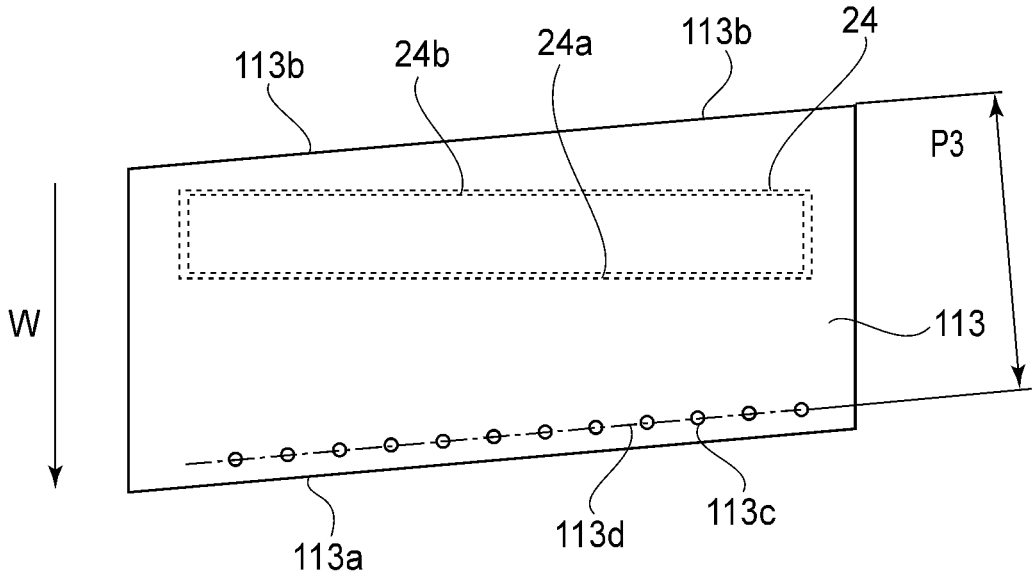
Figure 24:
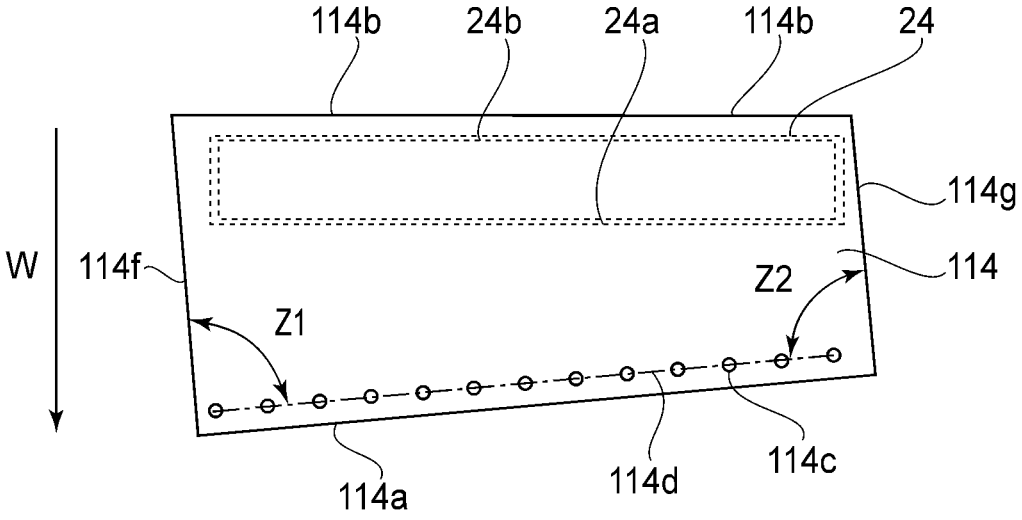

Part (a) of FIG. 24 is a plan view for illustrating a positional relationship between a sealing portion and a mounting portion of a toner seal member in Embodiment 14 in the image forming apparatus in which the process cartridge functioning as the developing cartridge as the cartridge according to the present invention is provided. Part (b) of FIG. 24 is a plan view for illustrating a positional relationship between a sealing portion and a mounting portion of a toner seal member in Embodiment 15 in the image forming apparatus in which the process cartridge functioning as the developing cartridge as the cartridge according to the present invention is provided.

Figure 25:
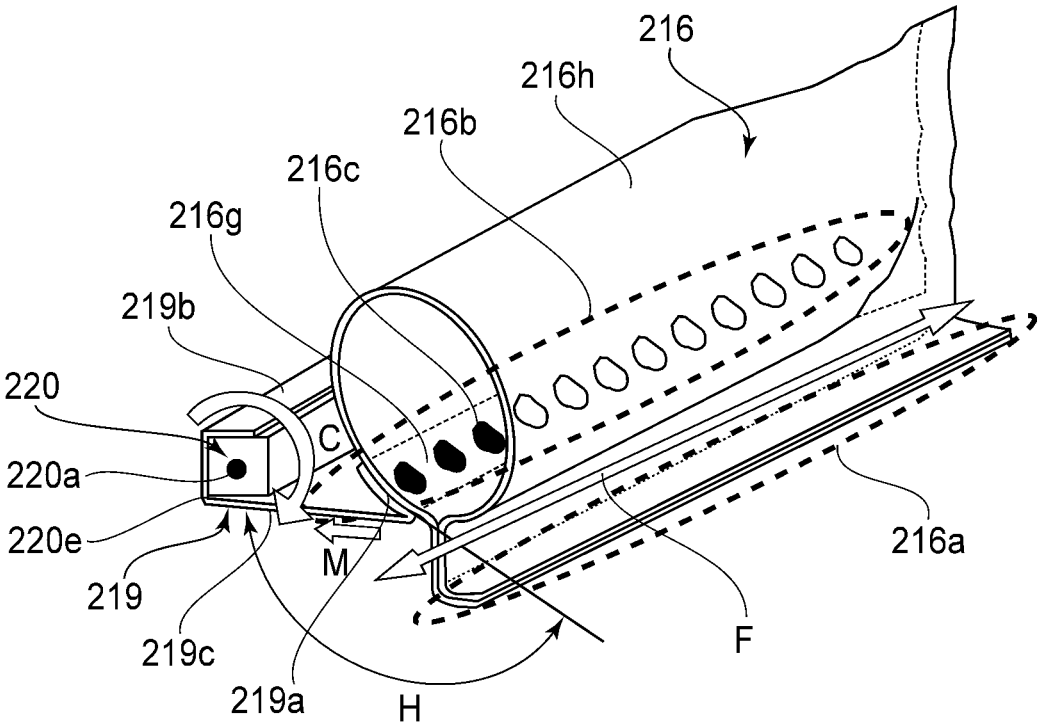

FIG. 25 is a partial perspective view showing a structure of a toner seal member, a rotatable member and a developing bag constituting a flexible container in Embodiment 16 in the cartridge according to the present invention.

Figure 26:
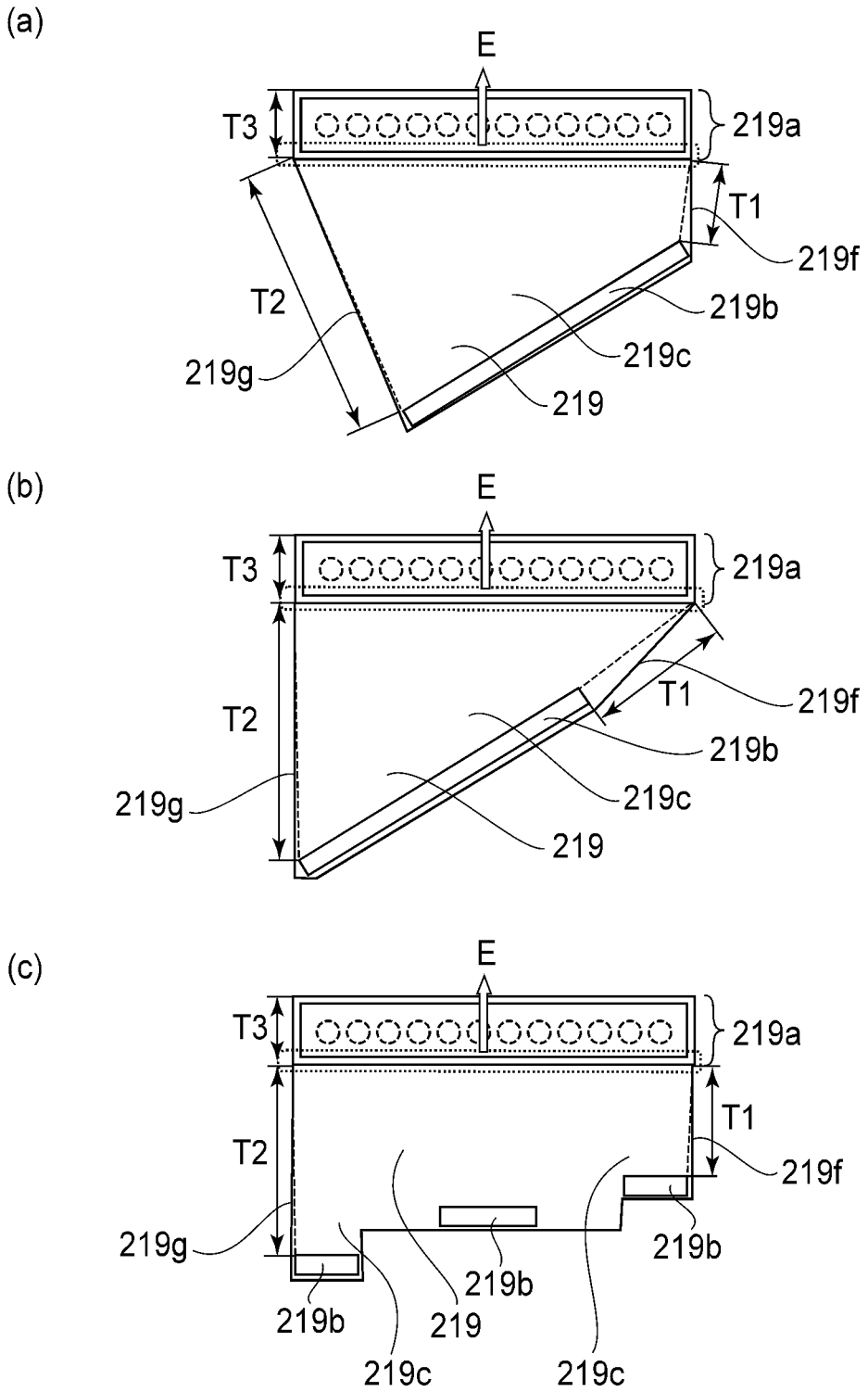

Parts (a), (b) and (c) of FIG. 26 are front illustrations of structures of toner seal members in Embodiments 17, 18 and 19, respectively, in the image forming apparatus in which the process cartridge functioning as the developing cartridge as the cartridge according to the present invention.

DESCRIPTION OF THE PREFERRED EMBODIMENTS

With reference to the drawings, embodiments of an image forming apparatus in which a process cartridge also functioning as a developing cartridge as a cartridge according to the present invention is provided will be described specifically.

Embodiment 1

First, a structure of the image forming apparatus in which the process cartridge also functioning as the developing cartridge as the cartridge according to the present invention is provided in this embodiment will be described with reference to FIGS. 1 to 19. Incidentally, in the following description, a rotational axis direction (left-right direction in FIG. 4) of a photosensitive drum 62 as an image bearing member for forming an electrostatic latent image on a surface of the photosensitive drum 62 is referred to as a longitudinal direction.

Figure 4:
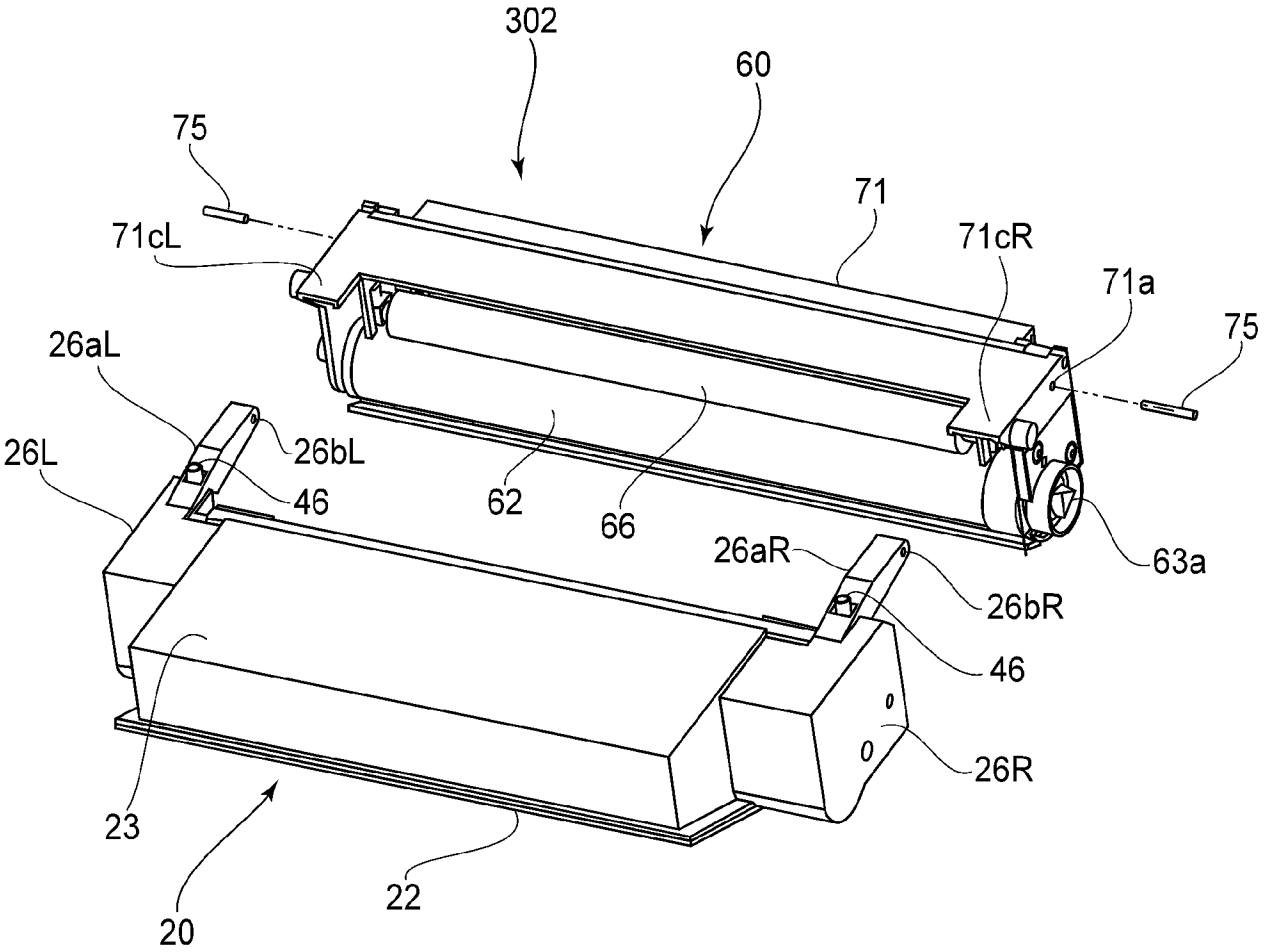
FIG. 4 is an exploded perspective view showing the structure of the process cartridge in Embodiment 1.

Further, with respect to the longitudinal direction of the photosensitive drum 62 shown as the left-right direction in FIG. 4, a side (a driving force receiving portion 63*a* side shown as a right side in FIG. 4) where the photosensitive drum 62 receives a driving force from a main assembly of an image forming apparatus 301 is referred to as a driving side, and its opposite side is referred to as a non-driving side.

A general structure of the image forming apparatus 301 and an image forming process will be described with reference to FIGS. 1 and 2.

Figure 1:
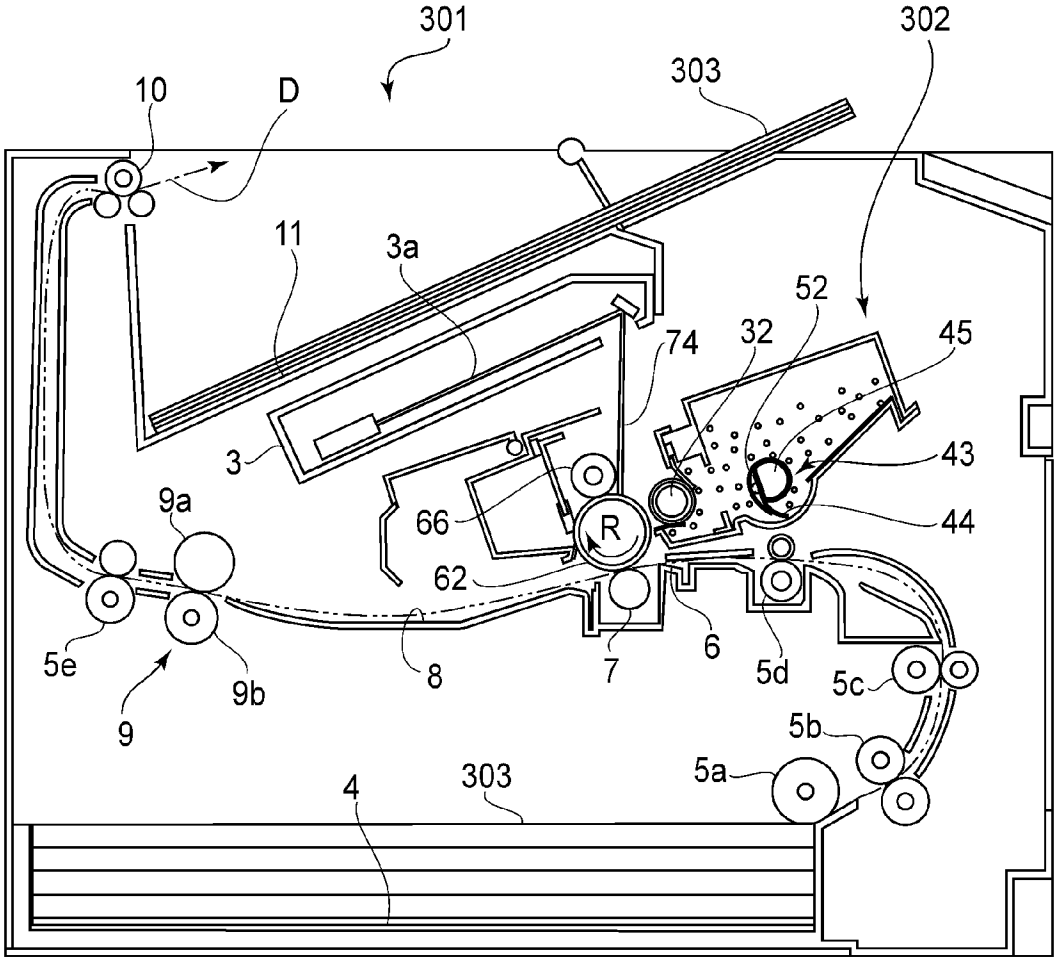
FIG. 1 is a sectional illustration showing a structure of an image forming apparatus in which a process cartridge also functioning as a developing cartridge as a cartridge according to the present invention in Embodiment 1 is provided.

FIG. 1 is a sectional view of a main assembly of the image forming apparatus 301 and a process cartridge 302. FIG. 2 is a sectional view of the cartridge 302. Here, the main assembly of the image forming apparatus 301 refers to a portion of the image forming apparatus 301 from which the cartridge 302 is removed.

<General Structure of Image Forming Apparatus>

In FIG. 1, the image forming apparatus 301 is a laser beam printer, using an electrophotographic type, in which the cartridge 302 is detachably mountable to the main assembly of the image forming apparatus 301. When the cartridge 302 is mounted in the main assembly of the image forming apparatus 301, above the process cartridge 302, an exposure device 3 consisting of a laser scanner unit is provided.

Further, below the cartridge 302, a sheet (feeding) tray 4 in which a sheet material 303 to be subjected to image formation is accommodated is provided.

Further, in the main assembly of the image forming apparatus 301, along a conveyance direction D of the sheet material 303, a pick-up roller 5*a*, a feeding roller 5*b*, a conveying roller 5*c*, a registration roller 5*d*, a transfer guide 6, a transfer roller 7 as a transfer means and a conveying guide 8 are provided. Further, a fixing device 9 as a fixing means, a conveying roller 5*e*, a discharging roller 10, a discharge tray 11 and the like are successively provided. Incidentally, the fixing device 9 is constituted by including a heating roller 9*a* and a pressing roller 9*b*.

<Image Forming Process Operation>

Next, an image forming process operation will be described. On the basis of a print start signal, the photosensitive drum 62 is rotationally driven at a predetermined peripheral speed (process speed) in an arrow R direction in FIG. 1.

A charging roller 66 as a charging means to which a charging bias voltage is applied from an unshown charging bias power source contacts the outer peripheral surface of the photosensitive drum 62 and electrically charges the outer peripheral surface of the photosensitive drum 62 uniformly.

The exposure device 3 as an exposure means outputs laser light 3*a* depending on image information. The laser light 3*a* passes through an exposure window portion 74 provided at an upper surface of the cartridge 302, so that the outer peripheral surface of the photosensitive drum 62 is subjected to scanning exposure. As a result, on the outer peripheral surface of the photosensitive drum 62, an electrostatic latent image depending on the image information is formed.

Figure 2:
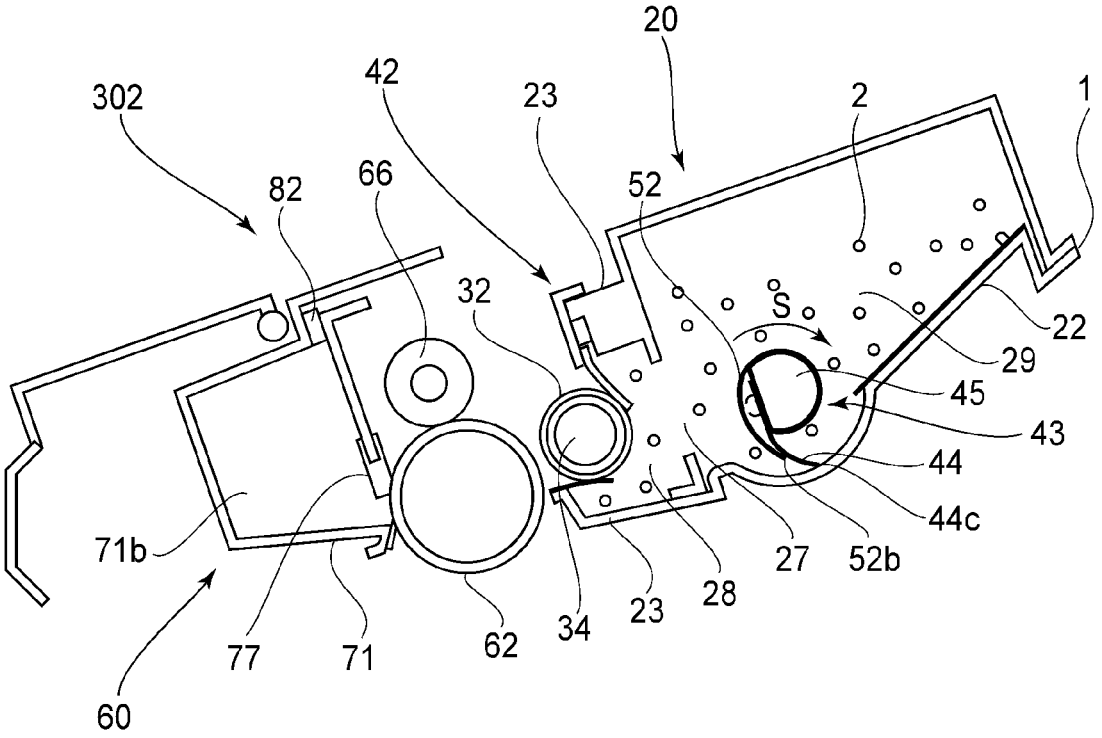
FIG. 2 is a sectional illustration showing a structure of the process cartridge in Embodiment 1.

On the other hand, as shown in FIG. 2, in a developing container 23, for accommodating a toner 2 as the developer, provided in a developing unit 20 as the developing device, a toner chamber 29 including a rectangular toner supplying opening 27 as an opening for permitting accommodation of the toner 2 is provided. The toner 2 in the toner chamber 29 is stirred and fed by rotation of a feeding member 43. Then, the toner 2 is sent from the toner chamber 28, via the toner supplying opening 27, to a toner supplying chamber 28 in which a developing roller 32 as a developer carrying member is provided.

The toner 2 is carried by a magnetic force of a magnet roller 34 formed with a fixed magnet, on a surface of the developing roller 32 as the developer carrying member for supplying the toner 2, as the developer in the toner supplying chamber 28 of the developing container 23, to the surface of the photosensitive drum 62 as the image bearing member on which the electrostatic latent image is formed.

The toner 2 carried on the surface of the developing roller 32 is regulated in layer thickness by a developing blade 42 while being triboelectrically charged.

The toner 2 carried on the developing roller 32 is transferred onto the photosensitive drum 62 depending on the electrostatic latent image formed on the surface of the photosensitive drum 62, so that the electrostatic latent image is visualized as a toner image.

Further, as shown in FIG. 1, in synchronism with output timing of the laser light 3*a*, by the pick-up roller 5*a*, the feeding roller 5*b* and the conveying roller 5*c*, the sheet material 303 accommodated at a lower portion of the main assembly of the image forming apparatus 301 is fed and conveyed from the sheet tray 4.

Then, by the registration roller 5*d*, the sheet material 303 is conveyed, in synchronism with the toner image formed on the surface of the photosensitive drum 62, to a transfer position between the photosensitive drum 62 and the transfer roller 7 via the transfer guide 6. In this transfer position, the toner image formed on the surface of the photosensitive drum 62 is successively transferred onto the sheet material 303.

The sheet material 303 on which the toner image is transferred is separated from the photosensitive drum 62 and then is conveyed to the fixing device 9 along the conveying guide 8. Then, the sheet material 303 passes through a fixing nip between the heating roller 9*a* and the pressing roller 9*b* which constitute the fixing device 9.

At this fixing nip, fixing by heating, and pressure application is effected, so that the toner image is fixed on the sheet material 303. The sheet material 303 on which the toner image is fixed is conveyed to the discharging roller 10 by the conveying roller 5*e* and then is discharged onto the discharge tray 11.

On the other hand, as shown in FIG. 2, the surface of the photosensitive drum 62 after the toner image is transferred onto the sheet material 303 is, after from which a residual toner is removed by a cleaning blade 77, used again in the image forming process operation. The residual (waste) toner removed from the photosensitive drum 62 is stored in a residual toner chamber 71*b* of a cleaning unit 60.

In the above-described constitution, the charging roller 66, the developing roller 32, and the cleaning blade 77 are the image forming process means actable on the photosensitive drum 62.

<Mounting and Demounting Operation of Cartridge>

Figure 3:
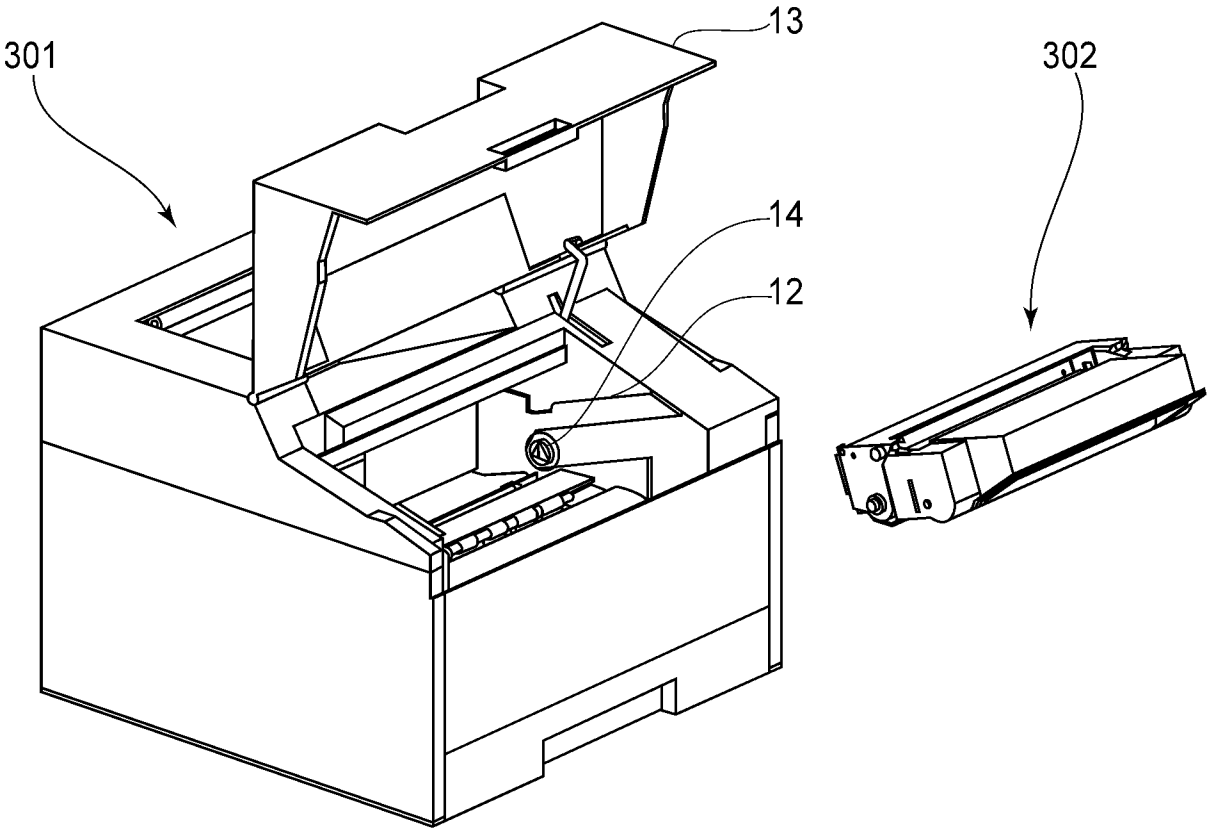
FIG. 3 is a perspective illustration showing a structure of the process cartridge and an image forming apparatus main assembly in a state in which an openable door is opened in the image forming apparatus in Embodiment 1.

Next, with reference to FIG. 3, a mounting and demounting operation of the cartridge 302 with respect to the main assembly of the image forming apparatus 301 will be described. FIG. 3 is a perspective illustration showing a structure of the cartridge 302 and the main assembly of the image forming apparatus an openable door 13 for permitting mounting and demounting of the cartridge 302 is opened.

The main assembly of the image forming apparatus 301 is provided with the openable door 13 in a rotationally movable manner. The main assembly of the image forming apparatus 301 is provided with a guide rail 12 at an inner peripheral surface thereof, and when the openable door 13 is opened, the cartridge 302 is to be mounted into the main assembly of the image forming apparatus 301 along the guide rail 12.

Then, a driving shaft 14 is rotationally driven by an unshown motor as a driving source provided in the main assembly of the image forming apparatus 301. Then, the driving force receiving portion 63*a* provided in the driving side, shown as the right side in FIG. 4, of the cartridge 302 mounted inside the main assembly of the image forming apparatus 301 engages with the driving shaft 14. As a result, the photosensitive drum 62 connected with the driving force receiving portion 63*a* receives the driving force from the main assembly of the image forming apparatus 301, thus being rotated.

Further, the charging roller 66 and the developing roller 32 are supplied with electric power (energy) from an unshown electric power supplying portion of the main assembly of the image forming apparatus 301.

<General Structure of Cartridge>

Next, with respect to FIGS. 4 to 6, a general structure of the cartridge 302 will be described. FIG. 4 is an exploded perspective view for illustrating a structure of the cartridge 302. As shown in FIGS. 2 and 4, the cartridge 302 is constituted by combining the cleaning unit 60 and the developing unit 20. The cleaning unit 60 is constituted by including a cleaning frame 71, the photosensitive drum 62, the charging roller 66, the cleaning blade 77 and the like.

On the other hand, the developing unit 20 is constituted by including the developer container 23, a bottom member 22, (left and right) side members 26L and 26R, a developing blade 42, the developing roller 32, the magnet roller 34, the feeding member 43, the developer bag 100, the toner 2, an urging member 46, and the like.

Then, the cleaning unit 60 and the developing unit 20 are rotationally movably connected with each other by a pin-like connecting member 75 shown in FIG. 4, so that the cartridge 302 is constituted.

Specifically, the side members 26L and 26R are provided at end portions of the developing unit 20 with respect to a longitudinal direction of the developing unit 20 (a rotational axis direction of the developing roller 23). Further, arm portions 26*a*L and 26*a*R formed on the side members 26L and 26R, respectively, are provided with rotational movement holes 26*b*L and 26*b*R, respectively at their end portions, in parallel to a rotation shaft of the developing roller 3.

Further, at each of longitudinal end portions of the cleaning frame 71, an engaging hole 71*a* for permitting engagement therein of the pin-like connecting member 75 is formed and disposed in parallel to a rotation shaft of the photosensitive drum 62.

Then, the arm portions 26*a*L and 26*a*R are engaged with the cleaning frame 71 at the longitudinal end portions of the cleaning frame 71, and then the connecting members 75 are inserted into the rotational movement holes 26*b*L and 26*b*R and the engaging holes 71*a*, thus being locked. As a result, the cleaning unit 60 and the <eloping unit 20 are connected with each other rotatably about the connecting members 75.

At this time, urging members 46 mounted at base portions of the arm portions 26*a*L and 26*a*R about against abutment portions 71*c*L and 71*c*R provided at longitudinal end portions of the cleaning frame 71. Further, the urging members 46 urge, by its urging force, the developing unit 20 rotatably about the connecting members 75 toward the cleaning unit 60. As a result, the developing roller 32 is pressed toward the photosensitive drum 62 with reliability.

Figure 6:
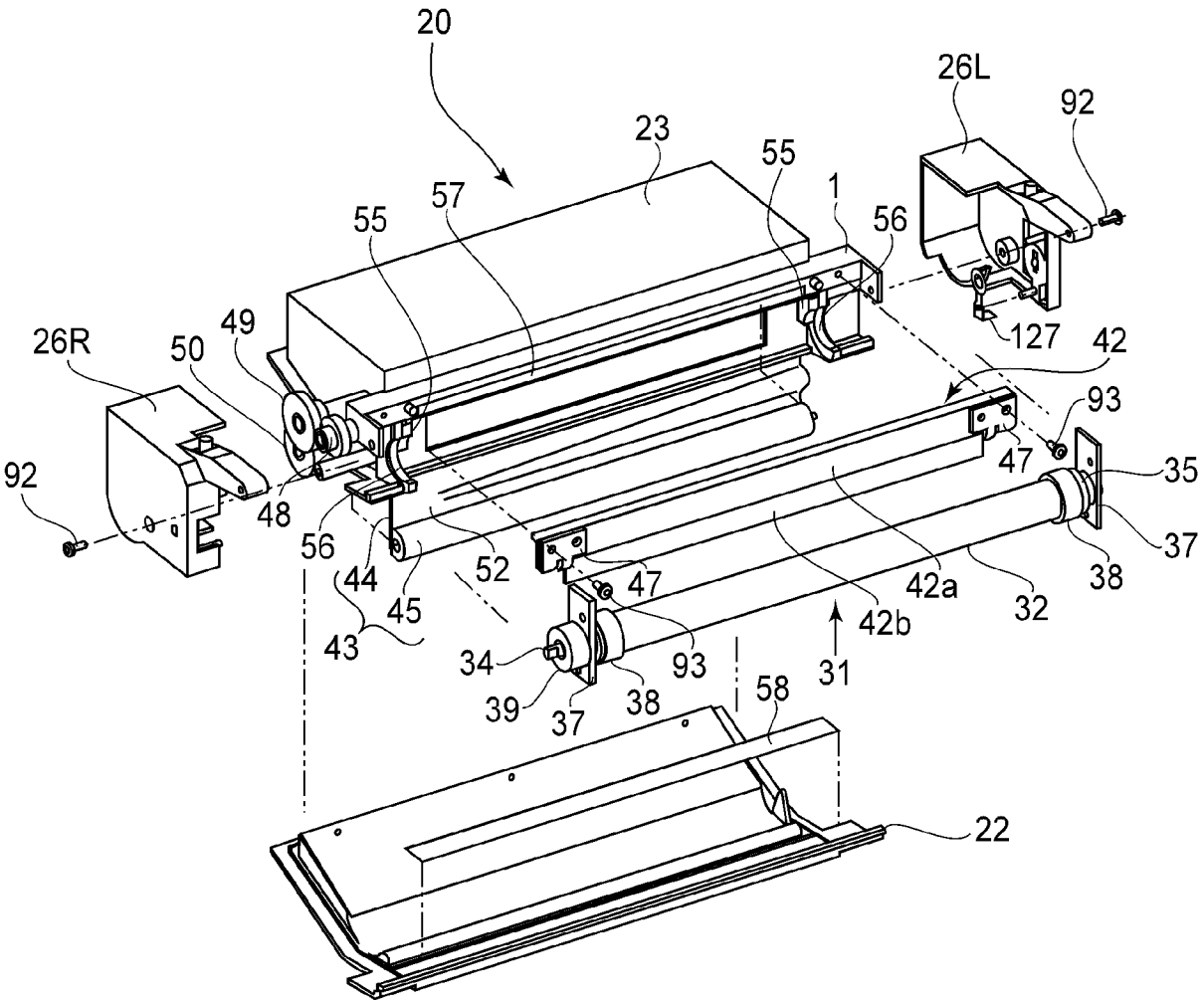
FIG. 6 is an exploded perspective view showing a structure of the developing unit in Embodiment 1.

Then, by a gap (spacing) holding member 38 mounted at each of the end portions of the developing roller 32 with respect to the rotational axis direction of the developing roller 32 shown in FIG. 6, the developing roller 32 is held with a predetermined gap from the photosensitive drum 62.

<Cleaning Unit>

Next, with reference to FIGS. 2 and 5, a structure of the cleaning unit 60 will be described. FIG. 5 is an exploded perspective view for illustrating the structure of the cleaning unit 60.

Figure 5:
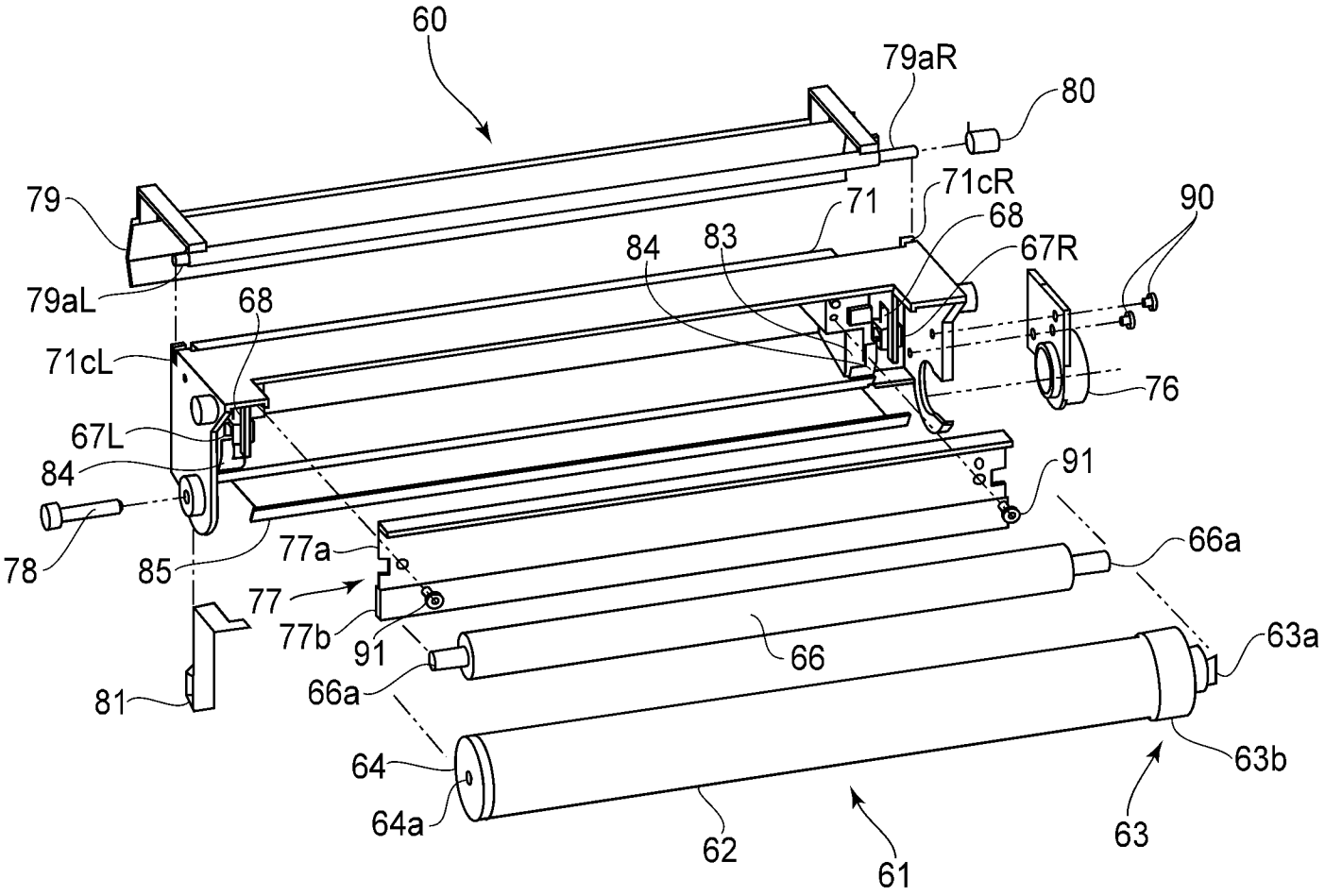
FIG. 5 is an exploded perspective view showing a structure of a cleaning unit in Embodiment 1.

In FIG. 5, the cleaning unit 60 is constituted by including a supporting member 77*a* formed with a metal plate and an elastic member 77*b* formed of an elastic material such as urethane rubber. Further, the cleaning blade 77 is fixed on the cleaning frame 71 by inserting screws 91 into through holes provided at longitudinal end portions of the supporting member 77*a*, thus being provided in a predetermined position.

The elastic member 77*b* of the cleaning blade 77 contacts the surface of the photosensitive drum 62, so that the residual toner is scraped off and removed from the surface of the photosensitive drum 62.

The residual toner removed from the surface of the photosensitive drum 62 is stored in the residual toner container 71*b* provided in the cleaning unit 60 shown in FIG. 2.

An electrode plate 81, an urging member 68 and charging roller bearings 67L and 67R which are shown in FIG. 5 are mounted on the cleaning frame 71. A rotation shaft 66*a* of the charging roller 66 is rotatably engaged into and supported by the charging roller bearings 67L and 67R.

The charging roller 66 is urged toward the photosensitive drum 62 by the urging member 68, and is rotatably supported by the charging roller bearings 67L and 67R. Then, the charging roller 66 is rotated by rotation of the photosensitive drum 62.

The photosensitive drum 62 is connected integrally with flanges 63 and 64 and thus is constituted as a photosensitive drum unit 61. This connecting method can be performed by using caulking, bonding, welding or the like.

To the flange 64, an unshown grounding contact and the like are connected. Further, the flange 63 includes a driving force receiving portion 63*a* for receiving a driving force from the main assembly of the image forming apparatus 301 and includes a flange gear portion 63*b* for transmitting the driving force to the developing roller 32.

The bearing member 76 is integrally fixed on the cleaning frame 71 in the driving side, and a drum shaft 78 is press-fitted and fixed in the cleaning frame 71 in the non-driving side. Further, the bearing member 76 is engaged with the flange 63, and the drum shaft 78 is engaged with a hole 64*a* of the flange 64. As a result, the photosensitive drum unit 61 is rotatably supported by the cleaning frame 71.

<Developing Unit>

Next, a structure of the developing unit 20 will be described with reference to FIGS. 2 to 6. FIG. 6 is an exploded perspective view for illustrating a structure of the developing unit 20.

As shown in FIGS. 2 and 6, a developing (device) frame 1 consisting of the toner developing container 23 and the bottom member 22 defines the toner chamber 29 in which the toner 2 is accommodated, and the toner feeding chamber 28 which are shown in FIG. 2. The developing container 23 and the bottom member 22 are integrally connected with each other by welding or the like.

The feeding member 43 is constituted by including a feeding sheet 44 and the rotatable member 45, rotatable about a rotation shaft 45*e* shown in FIG. 7, as an unsealing member for unsealing the toner supplying opening 27 as the opening. The rotatable member 45 is rotatably supported by the developing container 23, and is a rotatable member capable of stirring the toner 2 in the toner chamber 29.

The rotatable member 45 is constituted as the unsealing member for unsealing the toner supplying opening 27 by winding up the toner seal member 52, for unsealably sealing the toner supplying opening 27 as the opening communicating with the toner chamber 29, to peel a sealing portion 24 shown in FIG. 8.

As shown in (c) of FIG. 8, the sealing portion 24 includes a first sealing portion 24*a*R located at a longitudinal end portion and a second sealing portion 24*a*C located at a longitudinal central portion. Further, with respect to a direction crossing the longitudinal direction, a length from the first sealing portion 24*a*R to the mounting portion is constituted so as to be shorter than a length from the second sealing portion 24*a*C to the mounting portion. As the rotatable member 24 in this embodiment, a solid member capable of ensuring sufficient rigidity is employed.

The feeding member 43 is rotatably supported by the developing container 23 in the non-driving side, and is fixed to a feeding gear 50 rotatably mounted in the driving side. As a result, the feeding member 43 is rotated in the toner chamber 29 by the rotation of the feeding gear 50.

As shown in FIG. 6, toner seal members 55 to 57 are fixed in predetermined positions of the developing container 23 by a double-side tape or the like.

A toner seal member 58 is fixed in a predetermined position of a bottom member 22 by the double-side tape or the like after the developing container 23 and the bottom member 22 are connected.

The toner seal member 55 prevents the toner 2 from leaking out from longitudinal end portions between the developing blade 42 and an elastic member 42*b*.

The toner seal member 56 prevents the toner 2 from leaking out from longitudinal end portions of the developing roller 32.

The toner seal member 57 is provided over a longitudinal full length of the developing blade 42, and prevents the toner 2 from leaking out from a back side of a supporting member 42*a* for the developing blade 42.

The toner seal member 58 is provided over a longitudinal full length of the developing roller 32, and prevents the toner 2 from leaking out from a lower side of the developing roller 32 shown in FIG. 6.

The developing blade 42 is constituted by including a supporting member 42*a* formed with a metal plate and including an elastic member 42*b* formed of an elastic material such as an urethane rubber. Further, the developing blade 42 is fixed together with a cleaning member 47 in a predetermined position relative to the developing container 23 by inserting screws 93 into through holes provided at longitudinal end portions of the supporting member 42*a*.

A developing roller unit 31 is constituted by including the developing roller 32, the magnet roller 34, a flange 35, the gap holding member 38, a bearing member 37, a developing roller gear 39 and the like.

From an end portion of the opening in the non-driving side (the right side of FIG. 6), the magnet roller 34 is inserted, and at the opening end portion in the non-driving side, the flange 35 is press-fitted and fixed.

Here, the respective rotation shafts of the photosensitive drum 62, the rotatable member 45 and the developing roller 32 are disposed in parallel to each other.

In the flange 35, an unshown electroconductive electrode wire is incorporated, and the electrode wire is electrically connected with the developing roller 32 and an electrode plate 127.

The electroconductive electrode plate 127 is fixed on a side member 26L provided in the non-driving side shown as the right side in FIG. 6.

The electrode plate 127 is electrically contacted to an unshown electric power supplying portion of the main assembly of the image forming apparatus 301, and the electric power is supplied to the developing roller 32 via an electric power supplying path consisting of the electrode plate 127 and the unshown electric wire.

The gap holding member 38 is mounted at each of the end portions of the developing roller 32 with respect to the rotational axis direction of the developing roller 32. Further, outside the gap holding member 38, the bearing member 37 is disposed, and in the driving side shown as the left side in FIG. 6), the developing roller gear 39 is assembled outside the bearing member 37.

By the bearing member 37 disposed at each of the end portions of the developing roller 32 with respect to the rotational axis direction of the developing roller 32, the developing roller 32 is rotatably supported.

Gears 48 and 49 as a drive transmission member are rotatably engaged with the developing frame 1. As a result, the rotational driving force from the driving shaft 14 of the main assembly of the image forming apparatus 301 shown in FIG. 3 is received by the driving force receiving portion 63*a* shown in FIG. 4. The driving force received by the driving force receiving portion 63*a* is transmitted to the developing roller 32 and the feeding member 43 by successive engagement and rotation of the developing roller gear 39, the gears 48 and 49, and the feeding gear 50 which are shown in FIGS. 5 and 6.

As shown in FIG. 5, the side members 26L and 26R are fixed with screws 92 at end portions, respectively, of the developing frame 1 with respect to the longitudinal direction of the developing frame 1. At that time, the bearing members 37 of the developing roller 31 are held by the side members 26L and 26R.

<<Toner Seal Member and Unsealing Operation>>

<Structure of Toner Seal Member and Auxiliary Unsealing Member>

Next, with reference to FIGS. 2 and 7 to 9, a structure of the toner seal member 52 including the sealing portion 24 for unsealably sealing the toner supplying opening 27 and a plurality of mounting holes 52*c* as the mounting portion to be mounted on the rotatable member 45 will be described.

In this embodiment, the mounting portion of the toner seal member 52 to be mounted on the rotatable member 45 refers to a portion, of the toner seal member 52, corresponding to a hole center line 52*d* passing through centers of the plurality of mounting holes. Further, a length between the sealing portion 24 and the mounting portion of the toner seal member 52 with respect to a direction crossing (perpendicular to) the longitudinal direction of the cartridge 302 refers, for convenience in (c) of FIG. 8, to a length between an edge portion of the sealing portions 24*a* and 24*b* in a side toward the mounting holes 52*c* and the hole center line 52*d*. In (c) of FIG. 8, the sealing portion includes the first sealing portion 24*a*R located at the longitudinal end portion and the second sealing portion 24*a*C located at the longitudinal central portion. Further, with respect to the direction crossing the longitudinal direction, the length between the first sealing portion 24*a*R and the mounting portion is constituted so as to be shorter than the length between the second sealing portion 24*a*C and the mounting portion.

Parts (a) to (d) of FIG. 7 are perspective illustrations for illustrating an unsealing operation of the toner seal member 52 in this embodiment. Part (a) of FIG. 8 is an exploded perspective view for illustrating a positional relationship among the toner supplying opening 27 communicating with the toner chamber 29, the toner seal member 52, the sealing portion 24, the rotatable member 45 and the conveying sheet 44 in this embodiment. Part (b) of FIG. 8 is a perspective illustration showing a state in which the toner supplying opening 27 communicating with the toner chamber 29 is sealed with the sealing portion 24 of the seal member 52 to assemble the toner seal member 52 and the conveying sheet 44 with the rotatable member 45 in this embodiment. Part (c) of FIG. 8 is a plan view showing a structure of the toner seal member 52 in this embodiment. Incidentally, the conveying sheets 44 in (a) to (d) of FIG. 7 are omitted from illustration for convenience of explanation.

As shown in FIGS. 2, 7 and 8, the developing container 23 is provided with the toner supplying opening 27 for establishing communication between the toner chamber 29 and the toner supplying chamber 28.

The toner seal member 52 for unsealably sealing the toner supplying opening 27 is constituted by a material compatible with a material for the developing container 23 or a material including an adhesive layer.

The feeding sheet 44 fixed on the rotatable member 45 is formed of a flexible material such as polyethylene terephthalate (PET), polycarbonate (PC) or polyphenylene sulfide (PPS).

As shown in (a) of FIG. 8, an end portion 52*a* of the toner seal member 52 constituted by a sheet-shaped member in a fixing side as one side of the toner seal member 52 and an end portion 44*a* of the feeding sheet 44 in a fixing side are provided, as the mounting portion, with mounting holes 44*b* each consisting of a through hole.

The rotatable member 45 is constituted by including a curved portion 45*c* as an arcuate portion in cross section as seen from a direction of the rotation shaft 45*e* and a flat surface as a rectilinear line portion in cross section as seen from the direction of the rotation shaft 45*e*. A rectilinear line along which a plurality of projected portions 45*a* projected from the flat surface 45*b* are arranged is substantially parallel to the direction of the rotation shaft 45*e* of the rotatable member 45.

Here, a geometrical tolerance value of parallelism between the rotation shaft 45*e* of the rotatable member 45 and the rectilinear line along which the plurality of projected portions 45*a* projected from the flat surface 45*b* is approximately 5 mm. Incidentally, the parallelism refers to a magnitude of deviation of a rectilinear line feature to be parallel to a rectilinear line, from a geometrical rectilinear line parallel to the rectilinear line.

Then, as shown in (a) of FIG. 8, with the projections 45*a*, the mounting holes 52*c* consisting of the through holes of the toner seal member 52 and the through holes 44*b* of the feeding sheet 44 are successively engaged. Thereafter, as shown in (b) of FIG. 8, by thermally caulking the projections 45*a* of the rotatable member 45, the toner seal member 52 and the feeding sheet 44 are integrally fixed to the flat surface 45*b* of the rotatable member 45.

Incidentally, a method of fixing the toner seal member 32 and the feeding sheet 44 to the rotatable member 45 may also be another fixing method using welding, snap-fitting, double-side tape or the like, and is not necessarily limited.

As shown in (b) of FIG. 10 an open-side end portion 52*b* side of the toner seal member 52, the toner seal member 52 is peelably fixed to the developing container 23 along an opening edge of the toner supplying opening 27 by the thermal welding or the like. This fixed portion is the sealing portion 24.

The toner seal member 52 is connected to the first surface 45*c* of the rotatable member 45 at its end portion 52*a* in one side (fixing side) by inserting the projected portions 45*a*, projected from the flat surface 45*b* of the rotatable member 45, into the mounting holes 52*c* consisting of the plurality of through holes disposed as the mounting portion continuously at a predetermined pitch, thus locking the projected portions 45*a* in the mounting holes 52*c*, and is provided with the sealing portion 24, for sealing the toner supplying opening 27 as the opening, at its end portion 52*b* in another side.

Here, a forming method of the sealing portion 24 of the toner seal member 52 on the developing container 23 may also be a method other than the thermal welding or the like, and the sealing portion 24 can also be peelably fixed by, e.g., bonding, laser welding or the like.

As shown in FIG. 8, the sealing portion 24 includes sealing portions 24*a* and 24*b* provided substantially in parallel to the direction of the rotational axis 45*e* of the rotatable member 45 along the longitudinal direction of the toner supplying opening 27.

A geometrical tolerance value of parallelism between the sealing portions 24*a* and 24*b* and the rotation shaft 45*e* of the rotatable member 45 is approximately 5 mm. Further, the sealing portions 24*a* and 24*b* include a rectilinear line portion with respect to the longitudinal direction. Further, the sealing portion 24*a* includes a first sealing portion at an end portion thereof and a second sealing portion at a central portion thereof.

The sealing portion 24 further includes sealing portions 24*c* and 24*d* provided with respect to a direction substantially perpendicular to the direction of the rotational axis 45*e* of the rotatable member 45 along a widthwise (short) direction of the toner supplying opening 27.

A geometrical tolerance value of squareness between the sealing portions 24*c* and 24*d* and the rotation shaft 45*e* of the rotatable member 45 is approximately 5 mm. The squareness refers to a magnitude of deviation of a rectilinear line feature, to be perpendicular to a rectilinear line, from a geometrical rectilinear line perpendicular to the rectilinear line.

As shown in FIG. 8, the sealing portions 24*a*, 24*b*, 24*c* and 24*d* are continuously formed in a rectangular shape at an outer peripheral edge portion of the toner supplying opening 27. As a result, it becomes possible to seal the toner 2 accommodated in the toner chamber 29.

Incidentally, the sealing portions 24*a* and 24*b* are disposed in substantially parallel to each other, and are also disposed in substantially parallel to the rotation shaft 45*e* of the rotatable member 45.

The rotatable member 45 is rotated in an arrow S direction of (b) of FIG. 8. A side (right side of FIG. 8) with respect to the direction of the rotation shaft 45*e* of the rotatable member 45 (with respect to the rotational axis direction) is the driving side where a rotational driving force is to be transmitted, and another side (left side of FIG. 8) is the non-driving side.

The sealing portion 24*a* located upstream of the toner supplying opening 27 with respect to the unsealing direction (in a lower side of FIG. 8) is located in the fixing-side end portion 52*a* side of the toner seal member 52 as seen from the toner supplying opening 27.

On the other hand, the portion 24*b* as located downstream of the toner supplying opening 27 with respect to the unsealing direction (in an upper side of FIG. 8) is located in the open-side end portion 52*a* side of the toner seal member 52 as seen from the toner supplying opening 27.

Further, the sealing portion 24*c* is located in the non-driving side shown as the left side in (c) of FIG. 8, and the sealing portion 24*d* is located in the driving side shown as the right side in (c) of FIG. 8.

Further, with reference to (c) of FIG. 8, a positional relationship between the toner seal member 52 and the rotatable member 45 will be specifically described.

The rotatable member 45 is rotated in the arrow S direction of (b) of FIG. 8, so that the toner seal member 52 is wound up in an arrow W direction of (c) of FIG. 8 as winding-up direction around the outer peripheral surface of the rotatable member 45, and thus the sealing portion 24 is peeled and unsealed.

In this embodiment, the sealing portion 24 is unsealed by winding up the toner seal member 52 by the rotatable member 45. At that time, a magnitude of tension exerted between the sealing portion 24 (sealing portions 24*a* to 24*d*) of the toner seal member 52 and the mounting holes 52*c* consisting of the through holes as the mounting portion where the toner seal member 52 is mounted on the rotatable member 45.

For that reason, as shown in (c) of FIG. 8, a line connecting centers of the plurality of mounting holes 52*c* disposed continuously at a predetermined pitch at the fixing-side end portion 52*a* is taken as a hole center line 52*d*. Then, the positional relationship will be described below by using a spacing length P between the hole center line 52*d* and the sealing portion 24*a* and a spacing length P between the hole center line 52*d* and the sealing portion 24*b* in the arrow W direction of (c) of FIG. 8 as the winding-up direction of the toner seal member 52.

In this embodiment, as shown in (c) of FIG. 8, the toner supplying opening 27 is sealed with the sealing portion 24 of the toner seal member 52. Further, the toner seal member 52 is made flat in a region from the sealing portion 24 to the hole center line 52*d* passing through the centers of the mounting holes 52*c* as the mounting portion provided in the side thereof connected with the rotatable member 45.

In a state in which the toner seal member 52 is made flat, the spacing length between the hole center line 52*d* and the sealing portions 24*a* and 24*b* of the toner seal member 52 in the winding-up direction (arrow W direction of (c) of FIG. 8) is considered. The toner seal member 52 is wound up by the rotatable member 45 in a direction crossing the longitudinal direction of the cartridge 302. The hole center line 52*d* passes through the centers of the mounting holes 52*c* as the mounting portion provided in the side of the toner seal member 52 connected with the rotatable member 45. Then, the spacing length P is constituted so as to be different between at the end portion and at the central portion with respect to the direction of the rotation shaft 45*e* of the rotatable member 45 as the longitudinal direction of the cartridge 302.

In this embodiment, in the state in which the toner seal member 52 is made flat, the longitudinal direction of the sealing portions 24*a* and 24*b* of the toner seal member 52 is substantially parallel to the rotation shaft 45*e* of the rotatable member 45. Further, the direction of the hole center line 52*d* (mounting portion longitudinal direction) connecting the centers of the plurality of mounting holes 52*c* as the mounting portion is disposed so as to be inclined with respect to the rotation shaft 45*e*.

Here, a reference (basis) of the spacing length P between the sealing portions 24*a* and 24*b* of the toner seal member 52 and the hole center line 52*d* passing through the centers of the mounting holes 52*c* as the mounting portion with respect to the direction crossing the longitudinal direction of the cartridge 302 is as follows. In a mounting portion side, the hole center line 52*d* connecting the centers of the plurality of mounting holes 52*c* is a reference line.

Further, the spacing length P between the hole center line 52*d* and the sealing portions 24*a* and 24*b* of the toner seal member 52 is constituted so as to be shorter from the end portion toward the central portion with respect to the direction of the rotation shaft 45*e* of the rotatable member 45 as the longitudinal direction of the cartridge 302. The hole center line 52*d* is the line passing through the centers of the mounting holes 52*c* as the mounting portion provided in the side of the toner seal member 52 connected with the rotatable member 45.

As a result, the sealing portion 24 is unsealed in a direction from the driving side (right side of (b) of FIG. 8) to the non-driving side (left side of (b) of FIG. 8) with respect to the direction of the rotation shaft 45*e* of the rotatable member 45.

As described above, the toner supplying opening 27 is sealed with the sealing portion 24 of the toner seal member 52. Then, the toner seal member 52 is made flat in the region from the sealing portion 24 to the mount holes 52*c* as the mounting portion provided in the side of the toner seal member 52 connected with the rotatable member 45.

In the state in which the toner seal member 52 is made flat, the spacing length P will be considered. In the driving side (right side of (c) of FIG. 8) with respect to the direction of the rotation shaft 45*e* of the rotatable member 45, driving side lengths P1R and P2R with respect to the winding-up direction (arrow W direction of (c) of FIG. 8) of the toner seal member 52 to be wound up by the rotatable member 45 is considered.

The driving side lengths P1R and P2R are the spacing length P between the sealing portion 24*a* of the toner seal member 52 and the hole center line 52*d* passing through the center of a mounting hole 52*c*R and the spacing length P between the sealing portion 24*b* of the toner seal member 52 and the hole center line 52*d* passing through the center of the mounting hole 52*c*R, respectively. The mounting hole 52*c*R constitutes the mounting portion provided in the side of the toner seal member 52 connected with the rotatable member 45.

Further, in non-driving side (left side of (c) of FIG. 8) with respect to the direction of the rotation shaft 45*e* of the rotatable member 45, non-driving side lengths P1L and P2L with respect to the winding-up direction (arrow W direction of (c) of FIG. 8) of the toner seal member 52 to be wound up by the rotatable member 45 is considered.

The driving side lengths P1L and P2L are the spacing length P between the sealing portion 24*a* of the toner seal member 52 and the hole center line 52*d* passing through the center of a mounting hole 52*c*L and the spacing length P between the sealing portion 24*b* of the toner seal member 52 and the hole center line 52*d* passing through the center of the mounting hole 52*c*L, respectively. The mounting hole 52*c*L constitutes the mounting portion provided in the side of the toner seal member 52 connected with the rotatable member 45.

Further, at the central portion with respect to the direction of the rotation shaft 45*e* of the rotatable member 45, central portion lengths P1C and P2C with respect to the winding-up direction (arrow W direction of (c) of FIG. 8) of the toner seal member 52 to be wound up by the rotatable member 45 is considered.

The central portion lengths P1C and P2C are the spacing length P between the sealing portion 24*a* of the toner seal member 52 and the hole center line 52*d* passing through the center of a mounting hole 52*c*C and the spacing length P between the sealing portion 24*b* of the toner seal member 52 and the hole center line 52*d* passing through the center of the mounting hole 52*c*C, respectively. The mounting hole 52*c*C constitutes the mounting portion provided in the side of the toner seal member 52 connected with the rotatable member 45.

Further, the relationship between these spacing lengths P are as follows.

Here, the length between the sealing portions 24*a* and 24*b* of the toner seal member 52 and the hole center line 52*d* as the mounting portion with respect to the direction of the rotation shaft 45*e* of the rotatable member 45 refers to the non-driving side lengths P1L and P2L, the central portion lengths P1C and P2C and the driving side lengths P1R and P2R. The hole center line 52*d* passes through the centers of the mounting holes 52*c*L, 52*c*C and 52*c*R.

Further, the spacing length P at the longitudinal end portion of the cartridge 302 refers to the non-driving side lengths P1L and P2L and the driving side lengths P1R and P2R. Further, the spacing length P at the longitudinal central portion of the cartridge 302 refers to the central portion lengths P1C and P2C.

In this embodiment, the non-driving side lengths P1L and P2L are longer than the central portion lengths P1C and P2C, respectively. Further, the spacing length will be considered between the non-driving side and the central portion with respect to the direction of the rotation shaft 45*e* of the rotatable member 45. The non-driving side lengths P1L and P2L and the central portion lengths P1C and P2C with respect to the winding-up direction (arrow W direction of (c) of FIG. 8) of the toner seal member 52 wound up by the rotatable member 45 are increased with respect to the direction of the rotation shaft 45*e* of the rotatable member 45.

The non-driving side lengths P1L and P2L and the central portion lengths P1C and P2C are lengths from the sealing portions 24*a* and 24*b* of the toner seal member 52 to the hole center line 52*d* passing through the centers of the mounting holes 52*c*L and 52*c*C. The mounting holes 52*c*L and 52*c*C constituting the mounting portion provided in the side of the toner seal member 52 connected with the rotatable member 45.

As a result, as shown in (b) of FIG. 8, the toner seal member 52 is assembled with the rotatable member 45 so that the longitudinal direction of the sealing portions 24*a* and 24*b* of the toner seal member 52 is disposed in parallel to the direction of the rotation shaft 45*e* of the rotatable member 45. Then, a flexure 52*e* is formed at a side end portion 52*f* of the toner seal member 52 in the non-driving side (left side of (b) of FIG. 8).

As a result, as shown in FIG. 7, a peeling force for peeling the sealing portions 24*a* and 24*b* acts at an oblique angle with respect to the winding-up direction (arrow W direction of (c) of FIG. 8) of the toner seal member 52 wound up by the rotatable member 45. As a result, the sealing portions 24*a* and 24*b* are unsealed in a direction from the side (driving side shown as the right side of (b) of FIG. 8) toward another side (non-driving side shown as the left side of (b) of FIG. 8) with respect to the direction of the rotation shaft 45*e* of the rotatable member 45.

In this embodiment, as shown in (c) of FIG. 8, the hole center line 52*d* is not parallel to the longitudinal direction of the sealing portions 24*a* and 24*b* of the toner seal member 52. Further, from the driving side shown as the right side of (c) of FIG. 8 toward the non-driving side shown as the left side of (c) of FIG. 8, the spacing length P between the hole center line 52*d* and the sealing portions 24*a* and 24*b* with respect to the winding-up direction (arrow W direction of (c) of FIG. 8) of the toner seal member 52 is increased.

Incidentally, the spacing length P may be increased linearly or stepwise.

In the following description, representative three points consisting of the driving side mounting hole 52*c*R of the toner seal member 52 shown in the right side of (c) of FIG. 8, the central portion mounting hole 52*c*C, and the non-driving side mounting hole 52*c*L of the toner seal member 52 shown in the left side of (c) of FIG. 8 are used. Further, a relationship between the spacing lengths P from the hole center line 52*d* to the sealing portions 24*a* and 24*b* of the toner seal member 52 with respect to the winding-up direction of the toner seal member 52 will be specifically described.

The spacing lengths P, from the sealing portion 24*a*, in positions of the hole center line 52*d* passing through the driving side mounting hole 52*c*R, the central portion mounting hole 52*c*C and the non-driving side mounting hole 52*c*L with respect to the winding-up direction (arrow W direction of (c) of FIG. 8) of the toner seal member 52 are taken as the driving side length P1R, the central portion length P1C and the non-driving side length P1L, respectively. A relationship between these lengths is represented by the following formula 1.

$$P1L>P1C>P1R \quad \text{(formula 1)}$$

Similarly, the spacing lengths P, from the sealing portion 24*b*, in positions of the hole center line 52*d* passing through the driving side mounting hole 52*c*R, the central portion mounting hole 52*c*C and the non-driving side mounting hole 52*c*L with respect to the winding-up direction (arrow W direction of (c) of FIG. 8) of the toner seal member 52 are taken as the driving side length P2R, the central portion length P2C and the non-driving side length P2L, respectively. A relationship between these lengths is represented by the following formula 2.

$$P2L>P2C>P2R \quad \text{(formula 2)}$$

As a result, as shown in (b) of FIG. 8, the longitudinal direction of the sealing portion 24*a* of the toner seal member 52 and the direction of the rotation shaft 45*e* of the rotatable member 45 are disposed in substantially parallel to each other.

Incidentally, a geometrical tolerance value of parallelism between the longitudinal direction of the sealing portion 24*a* of the toner seal member 52 and the direction of the rotation shaft 45*e* of the rotatable member 45 is approximately 5 mm.

Then, the spacing length P in the non-driving side (left side of (b) of FIG. 8) of the toner seal member 52 is longer, and therefore a loosened portion 52*e* is generated in the non-driving side.

<Unsealing Operation of Toner Seal Member>

Next, an unsealing operation of the toner seal member 52 performed at the time of start of use of the cartridge 302 will be described with reference to FIGS. 7 to 9. Part (a) of FIG. 9 is a perspective view for illustrating a peeling manner of the sealing portion 24 of the toner seal member 52 in Comparison example, and (b) of FIG. 9 is a perspective view for illustrating a peeling manner of the sealing portion 24 of the toner seal member 52 in this embodiment.

First, as shown in (a) of FIG. 7, the toner seal member 52 is loosened as a whole so that no tension is applied thereto between the sealing portion 24 thereof and the hole center line 52*d* passing through the centers of the mounting holes 52*c* as the mounting portion on the rotatable member 45. As a result, even when an external force acts on the rotatable member 45 during assembling and transportation of the cartridge 302, the toner seal member 52 is loosened and therefore tension is not applied to the toner seal member 52. Therefore, a sealing force by the sealing portion 24 of the toner seal member 52 can be maintained. Incidentally, in FIG. 7, for easy understanding of the unsealing operation of the toner seal member 52, the toner 2 and the conveying sheet 44 and the like are omitted from illustration.

As shown in (a) of FIG. 7, immediately before start of the unsealing operation of the toner seal member 52, similarly as in a state immediately after the assembling, the toner seal member 52 is loosened as a whole, so that no tension is applied to the toner seal member 52.

As shown in (b) of FIG. 7, when the cartridge 302 is mounted in the main assembly of the image forming apparatus 301 and receives the driving force from the main assembly of the image forming apparatus 301, the rotatable member 45 is rotated in an arrow S direction of (b) of FIG. 7. Then, a fixing-side end portion 52*a* of the toner seal member 52 is wound up by the rotatable member 45. For this reason, the toner seal member 52 is pulled in the arrow W direction of (b) of FIG. 7 in a region between the sealing portion 24*a* and the hole center line 52*d*.

At this time, in this embodiment, the driving side seal P1R shown in the right side of (c) of FIG. 8 is shortest, and therefore the tension is applied first to the toner seal member 52 in the driving side shown as the upper side of (b) of FIG. 7. When this tension is increases and exceeds a limit of welding strength of the sealing portion 24*a*, the driving side end portion of the sealing portion 24*a* shown in the upper side of (b) of FIG. 7 is peeled.

As shown in (c) of FIG. 7, the rotatable member 45 is further rotated in the arrow S direction of (c) of FIG. 7. Then, the sealing portion 24*a* of the toner seal member 52 is pulled and peeled from the driving side shown as the upper side of (c) of FIG. 7 toward the non-driving side shown as the lower side of (c) of FIG. 7, and the sealing portion 24*d* is peeled toward the sealing portion 24*b*.

As shown in (d) of FIG. 7, when the sealing portion 24*a* is peeled to the non-driving side shown as the lower side of (d) of FIG. 7, the sealing portion 24*c* is peeled from the sealing portion 24*a* toward the sealing portion 24*b*.

When the rotatable member 45 is further rotated in the arrow S direction of (d) of FIG. 7, similarly as the sealing portion 24*a*, the sealing portion 24*b* is pulled and peeled from the driving side shown as the upper side of (d) of FIG. 7 toward the non-driving side shown as the lower side of (d) of FIG. 7, so that the sealing portion 24 is pulled and peeled in the entire region.

As a result, the toner supplying opening 27 is unsealed, so that the toner is fed by the feeding member 43 from the toner chamber 29 to the toner supply chamber 28.

As shown in (c) of FIG. 8, on the sealing portions 24*a* and 24*b* of the toner seal member 52, the spacing length P is increased from the driving side shown as the right side of (c) of FIG. 8 toward the central portion and then is increased from the central portion toward the non-driving side shown as the left side of (c) of FIG. 8. The spacing length P is the length between the hole center line 52*d* and the sealing portions 24*a* and 24*b* with respect to the winding-up direction (arrow W direction of (c) of FIG. 8) of the toner seal member 52.

For this reason, the sealing portions 24*a* and 24*b* of the toner seal member 52 are pulled and peeled in a direction from the driving side shown as the upper side of FIG. 7 toward the non-driving side shown as the lower side of FIG. 7.

Here, as in Comparison example shown by (a) of FIG. 9 and FIG. 21, the case where the longitudinal direction of sealing portions 24*a* and 24*b* of a toner seal member 52 or 102 and a hole center line 102*d* of a plurality of mounting holes 102*c* as the mounting portion fixed on the rotatable member 45 are substantially parallel to each other will be considered. In that case, the spacing length P between the hole center line 102*d* and the sealing portions 24*a* and 24*b* with respect to the winding-up direction (arrow W direction of FIG. 12) of the toner seal member 52 or 102 is the same in the entire region of the sealing portions 24*a* and 24*b* with respect to the longitudinal direction (left-right direction of FIG. 12). In that case, a large peeling force for peeling the sealing portion 24*a* of the toner seal member 52 or 102 in a full longitudinal width (width X1 of (a) of FIG. 9) is required.

On the other hand, in this embodiment, as shown in (c) of FIG. 8, the spacing length P is different between at the end portion and at the central portion with respect to the longitudinal direction (left-right direction of (c) of FIG. 8) of the cartridge 302. The spacing length P is the length between the hole center line 52*d* and the sealing portions 24*a* and 24*b* of the toner seal member 52 with respect to the winding-up direction (arrow W direction of (c) of FIG. 8) of the toner seal member 52.

Further, the toner supplying opening 27 is sealed with the sealing portions 24*a* and 24*b* of the toner seal member 52. Then, the toner seal member 52 is made flat in a region from the sealing portions 24*a* and 24*b* to the hole center line 52*d* passing through the centers of the plurality mounting holes 52*c*, disposed continuously at a predetermined pitch, as the mounting portion provided in the side of the toner seal member 52 connected with the rotatable member 45.

In the state in which the toner seal member 52 is made flat, the longitudinal direction of the sealing portions 24*a* and 24*b* are substantially parallel to the rotation shaft 45*e* of the rotatable member 45. Then, with respect to the rotation shaft 45*e*, the direction (longitudinal direction) of the hole center line 52*d* passing through the centers of the plurality of mounting holes 52*c*, disposed continuously at the predetermined pitch as the mounting portion is inclined.

Incidentally, a geometrical tolerance of parallelism between the longitudinal direction of the sealing portions 24*a* and 24*b* of the toner seal member 52 and the direction of the rotation shaft 45*e* of the rotatable member 45 is approximately 5 mm.

As a result, as shown in (b) of FIG. 9, the sealing portions 24*a* and 24*b* of the toner seal member 52 can be pulled and peeled from the driving side shown as the right side of (b) of FIG. 9 toward the non-driving side shown as the left side of (b) of FIG. 9 with respect to the direction of the rotation shaft 45*e* of the rotatable member 45. Further, as shown in (a) and (b) of FIG. 9, a peeling width X2 of the sealing portion 24*a* of the toner seal member 52 at the same time is smaller than the peeling width X1 in Comparison example shown in (a) of FIG. 9. As a result, in comparison with Comparison example shown in (a) of FIG. 9 and FIG. 12, a peeling region of the sealing portion 24*a* of the toner seal member 52 at the same timing is narrowed, so that the peeling force is reduced.

For a similar reason, also the peeling force of the sealing portion 24*b* of the toner seal member 52 can be reduced.

Incidentally, in this embodiment, as a mounting method for mounting the toner seal member 52 onto the rotatable member 45, an example of the constitution in which the mounting holes 52*c* as the through holes are engaged with the projected portions 45*a* projected from the flat surface 45*b* of the rotatable member 45 was described.

For that reason, the mounting portion-side reference (basis) of the spacing length P with respect to the winding-up direction of the toner seal member 52 to be wound up by the rotatable member was defined by using the hole center line 52*d* passing through the centers of the plurality of mounting holes 52*c* disposed continuously at the predetermined pitch. The spacing length P is the length between the sealing portions 24*a* and 24*b* of the toner seal member 52 and the mounting portion provided in the side of the toner seal member 52 connected with the rotatable member 45.

Alternatively, without using the mounting holes 52*c* as the through holes, the toner seal member 52 is mounted and fixed on the rotatable member 45 in the side thereof by a double-side tape, an adhesive or the like. In that case, a distance from a fixing surface to the sealing portions 24*a* and 24*b* with respect to the winding-up direction of the toner seal member 52 may only be required to be used as the spacing length P.

According to this embodiment, as shown in (c) of FIG. 8, the relationship between the spacing lengths P with respect to the winding-up direction of the toner seal member 52 to be wound up by the rotatable member 45 is set as follows.

That is, the spacing length P was set so as to satisfy the above-described formulas 1 and 2 showing that the spacing length P is increased from the driving side shown as the right side of (c) of FIG. 8 toward the non-driving side shown as the left side of (c) of FIG. 8.

The spacing length P is the length between the sealing portions 24*a* and 24*b* of the toner seal member 52 and the hole center line 52*d* passing through the centers of the plurality of mounting holes 52*c* as the mounting portion provided in the side of the toner seal member 52 connected with the rotatable member 45.

As a result, the sealing portion 24 of the toner seal member 52 can be pulled and peeled from the driving side shown as the right side of (c) of FIG. 8 toward the non-driving side shown as the left side of (c) of FIG. 8 with respect to the direction of the rotation shaft 45*e* of the rotatable member 45.

As a result, an automatic winding-up load of the toner seal member 52 can be reduced. Consequently, it is possible to downsize a motor for driving the rotatable member 45 and a driving system and to employ an inexpensive material, with the result that the image forming apparatus 301 can be decreased in size and cost.

Embodiment 2

Next, with reference to FIG. 10, an image forming apparatus, in which a process cartridge also functioning as a developing cartridge as the cartridge according to the present invention is provided, in a constitution in this embodiment will be described. Incidentally, constituent elements similar to those in Embodiment 1 described above are represented by the same reference numerals or symbols or represented by the same member names with different numerals or symbols, and will be omitted from description.

In Embodiment 1, as shown in (c) of FIG. 8, the sealing portions 24*a* and 24*b* of the toner seal member 52 and unsealed in the direction from the driving side shown as the right side of (c) of FIG. 8 toward the non-driving side shown as the left side of (c) of FIG. 8 with respect to the direction of the rotation shaft 45*e* of the rotatable member 45.

In this embodiment, as shown in FIG. 10, a constitution in which the sealing portions 24*a* and 24*b* of the toner seal member 52 are unsealed in a direction from the non-driving side shown as the left side of FIG. 10 toward the driving side shown as the right side of FIG. 10 with respect to the direction of the rotation shaft 45*e* of the rotatable member 45 is employed. In this case, a longitudinal left end portion is the first sealing portion 24*a*L, and a longitudinal central portion is the second sealing portion 24*c*C.

In this embodiment, as shown in FIG. 10, a side with respect to the direction of the rotation shaft 45*e* of the rotatable member 45 is the driving side (right side of FIG. 10) where the driving force is transmitted the rotatable member, and another side is the non-driving side (left side of FIG. 10) opposite from the driving side. Further, the sealing portions 24*a* and 24*b* are unsealed in the direction from the non-driving side (left side of FIG. 10) toward the driving side (right side of FIG. 10) with respect to the direction of the rotation shaft 45*e* of the rotatable member 45.

In the toner supplying opening 27 is sealed with the sealing portion 24 of the toner seal member 52. Further, the toner seal member 52 is made flat in a region from the sealing portion 24 to the hole center line 52*d* passing through the centers of the mounting holes 52*c* as the mounting portion provided in the side thereof connected with the rotatable member 45.

In the state in which the toner seal member 52 is made flat, the spacing length P will be considered. In the driving side (right side of (c) of FIG. 8) with respect to the direction of the rotation shaft 45*e* of the rotatable member 45, driving side lengths P1R and P2R with respect to the winding-up direction (arrow W direction of FIG. 10) of the toner seal member 52 to be wound up by the rotatable member 45 is considered.

The driving side lengths P1R and P2R are the spacing length P between the sealing portion 24*a* of the toner seal member 52 and the hole center line 52*d* passing through the center of a mounting hole 52*c*R and the spacing length P between the sealing portion 24*b* of the toner seal member 52 and the hole center line 52*d* passing through the center of the mounting hole 52*c*R, respectively. The mounting hole 52*c*R constitutes the mounting portion provided in the side of the toner seal member 52 connected with the rotatable member 45.

Further, in non-driving side (left side of (c) of FIG. 8) with respect to the direction of the rotation shaft 45*e* of the rotatable member 45, non-driving side lengths P1L and P2L with respect to the winding-up direction (arrow W direction of (c) of FIG. 10) of the toner seal member 52 to be wound up by the rotatable member 45 is considered.

The driving side lengths P1L and P2L are the spacing length P between the sealing portion 24*a* of the toner seal member 52 and the hole center line 52*d* passing through the center of a mounting hole 52*c*L and the spacing length P between the sealing portion 24*b* of the toner seal member 52 and the hole center line 52*d* passing through the center of the mounting hole 52*c*L, respectively. The mounting hole 52*c*L constitutes the mounting portion provided in the side of the toner seal member 52 connected with the rotatable member 45.

Further, at the central portion with respect to the direction of the rotation shaft 45*e* of the rotatable member 45, central portion lengths P1C and P2C with respect to the winding-up direction (arrow W direction of (c) of FIG. 10) of the toner seal member 52 to be wound up by the rotatable member 45 is considered.

The central portion lengths P1C and P2C are the spacing length P between the sealing portion 24*a* of the toner seal member 52 and the hole center line 52*d* passing through the center of a mounting hole 52*c*C and the spacing length P between the sealing portion 24*b* of the toner seal member 52 and the hole center line 52*d* passing through the center of the mounting hole 52*c*C, respectively. The mounting hole 52*c*C constitutes the mounting portion provided in the side of the toner seal member 52 connected with the rotatable member 45.

Further, the relationship between these spacing lengths P are as follows.

In this embodiment, the driving side lengths P1R and P2R are longer than the central portion lengths P1C and P2C, respectively. Further, the spacing length P is so as to be increased, in the direction of the rotation shaft between the driving side (right side of FIG. 10) and the central portion with respect to the direction of the rotation shaft 45*e* of the rotatable member 45. The spacing length P is the length in the winding-up direction (arrow W direction of FIG. 10) of the toner seal member 52 to be wound up by the rotatable member 45.

The spacing length P is the length between the hole center line 52*d* and the sealing portions 24*a* and 24*b* of the toner seal member 52. The hole center line 52*d* is the line passing through the centers of the plurality mounting holes 52*c*, disposed continuously at a predetermined pitch, as the mounting portion provided in the side of the toner seal member 52 connected with the rotatable member 45.

Incidentally, in this embodiment, the relationship between the spacing lengths P with respect to the winding-up direction (arrow W direction of FIG. 10) of the toner seal member 52 to be wound up by the rotatable member 45 is set as follows.

That is, the spacing length P was constituted so as to be increased from the non-driving side shown as the left side of FIG. 10 toward the driving side shown as the right side of FIG. 10, as represented by formulas 3 and 4 appearing hereinafter.

The spacing length P is the length between the sealing portions 24*a* and 24*b* of the toner seal member 52 and the hole center line 52*d*. The hole center line 52*d* is the line passing through the centers of the plurality of mounting holes 52*c*, disposed continuously at the predetermined pitch, as the mounting portion provided in the side of the toner seal member 52 connected with the rotatable member 45.

$$P1L<P1C<P1R \quad \text{(formula 3)}$$

$$P2L<P2C<P2R \quad \text{(formula 4)}$$

In such a constitution, the unsealing of the sealing portion 24 of the toner seal member 52 can be made by pulling and peeling the sealing portion 24 from the non-driving side shown as the left side of FIG. 10 to the driving side shown as the right side of FIG. 10, so that a peeling force-reducing effect can be obtained similarly as in Embodiment 1. Other constitutions are the same as those in Embodiment 1 described above, and a similar effect can be obtained.

Embodiment 3

Next, with reference to FIGS. 11 to 16, an image forming apparatus, in which a process cartridge also functioning as a developing cartridge as the cartridge according to the present invention is provided, in a constitution in this embodiment will be described. Incidentally, constituent elements similar to those in the embodiments described above are represented by the same reference numerals or symbols or represented by the same member names with different numerals or symbols, and will be omitted from description.

In the above-described embodiments, an example in which the rotatable member 45 is constituted by the solid member capable of ensuring rigidity was described. However, as in this embodiment, there is the case where a rotatable member 101 is formed by injection molding or the like using a resin material. In that case, the rotatable member 101 is formed with a hollow member or a rib having the substantially same thickness in consideration of ensuring of dimensional accuracy thereof and productivity such as shortening of a molding time.

In this case, the rigidity of the rotatable member 101 is lowered. By tension when a toner seal member 104 is wound up by the rotatable member 101, torsion Y with respect to a direction of a rotation shaft 101*g* and flexure V with respect to a tension direction are generated in the rotatable member 101.

In order to pull and peel the toner seal member 104 in a direction from the driving side shown as the right side of (b) of FIG. 14 to the non-driving side shown as the left side of (b) of FIG. 14 with respect to the direction of the rotation shaft 101*g* of the rotatable member 101, there is a need to take the torsion Y and the flexure V of the rotatable member 101 into consideration.

With reference to FIG. 11, a constitution of the rotatable member 101 in this embodiment in which the torsion Y and the flexure V should be considered will be described. Part (a) of FIG. 11 is a sectional illustration showing a structure of the rotatable member 101 in this embodiment. Part (b) of FIG. 11 is a sectional view of the rotatable member 101 taken along A-A line of (a) of FIG. 11, and (c) of FIG. 11 is a sectional view of the rotatable member 101 taken along B-B line of (a) of FIG. 11.

The rotatable member 101 as the unsealing member for unsealing the toner supplying opening 27 as the opening is supported rotatably about the rotation shaft 101*e* similarly as in Embodiment 1 described above, and winds up the toner seal member 104 shown in (b) of FIG. 14 and FIG. 15. As a result, the toner supplying opening 27 as the opening is unsealed. The sealing portion 24 of the toner seal member 104 unsealably seals the toner supplying opening 27 as the opening communicating with the toner chamber 29.

The rotatable member 101 in this embodiment is, as shown in (a) to (c) of FIG. 11, constituted by including the ribs. The rotatable member 101 is constituted by an arcuate portion 101*c* and a flat surface 101*b* as a rectilinear line portion in cross section as seen from the longitudinal direction (left or right side of (a) of FIG. 11) of the rotatable member 101 shown in (a) of FIG. 11. The center of the arcuate portion 101*c* is aligned with a rotation center 101*f* of the rotatable member 101. The flat surface 101*b* as the rectilinear line portion in cross section is provided with a plurality of projected portions 101*a*.

Further, in a back (surface) side of the flat surface 101*b*, a grid-like rib 101*e* shown as a dotted-line portion of (a) of FIG. 11 or a hatched line portion of (b) and (c) of FIG. 11 is provided.

The rib 101*e* is constituted by including a longitudinal rib 101*e*1 extending in the longitudinal direction of the rotatable member and a widthwise (short) rib 101*e*2 perpendicular to the longitudinal direction of the rotatable member 101.

As shown in (a) of FIG. 11, in a position corresponding to the projected portion 101*a* on the flat surface 101*b*, the widthwise rib 101*e*2 is provided. As a result, even when the tension is applied to the rotatable member 101 via the toner seal member 104 during unsealing of the sealing portion 24 of the toner seal member 104 as shown in (b) of FIG. 14, the toner seal member 104 is wound around an outer peripheral surface of the arcuate portion 101*c* of the rotatable member with reliability.

Next, a state in which the sealing portion 24 of the toner seal member 104 is unsealed by using the rotatable member 101 in this embodiment will be described. First, as Comparison example, by using a rectangular toner seal member 102 as shown in FIG. 12, the spacing length P in the winding-up direction (arrow W direction of FIG. 12) of the toner seal member 102 to be wound up by the rotatable member 101 will be described. An unsealing mechanism in Comparison example shown in FIG. 12 will be described by using a constitution of the case where the spacing length P is set so as to be the same with respect to the direction of the rotation shaft 45*e* of the rotatable member 45. Thereafter, a constitution in this embodiment will be described.

The spacing length P is the length between the sealing portions 24*a* and 24*b* of the toner seal member 102 and the hole center line 102*d*. The hole center line 102*d* is the line passing through the centers of the plurality of mounting holes 102*c*, disposed continuously at the predetermined pitch, as the mounting portion provided in the side of the toner seal member 102 connected with the rotatable member 101.

Comparison Example

FIG. 12 is a plan view showing a structure of the toner seal member 102 in Comparison example. A positional relationship between the toner seal member 102 and the sealing portion 24 will be described with reference to FIG. 12.

As shown in FIG. 12, a line connecting centers of a plurality of mounting holes 102*c*, disposed continuously at a predetermined pitch, as the mounting portion provided in a side of the toner seal member 102 is taken as a hole center line 102*d*. Spacing lengths P from the hole center line 102*d* to the sealing portions 24*a* and 24*b* of the toner seal member 102 with respect to the winding-up direction (arrow W direction of FIG. 12) of the toner seal member are defined as follows.

Of the mounting holes 102*c* as the through holes shown in FIG. 12, the mounting hole 102*c* corresponding to the end portion in the driving side shown as the right side of FIG. 12 is a driving side mounting hole 102*c*R. The mounting hole 102 corresponding to the longitudinal central portion is a central portion mounting hole 102*c*C. Further, the mounting hole 102*c* corresponding to the end portion in the non-driving side shown as the left side of FIG. 12 is a non-driving side mounting portion 102*c*L.

In Comparison example, the hole center line 102*d* is disposed in substantially parallel to the longitudinal direction (left-right direction of FIG. 12) of the sealing portion 24*a* of the toner seal member 102.

For that reason, the hole center line 102*d* passes through the centers of the driving side mounting hole 102*c*R shown in the right side of FIG. 12, the central portion mounting hole 102*c*C and the non-driving side mounting hole shown in the left side of FIG. 12. The spacing lengths P in positions on the hole center line 102*d* with respect to the winding-up direction (arrow W direction of FIG. 12) of the toner seal member 102 are defined as follows. The spacing lengths P are lengths, in the respective positions, between the hole center line 102*d* and the sealing portion 24*a* of the toner seal member 102. That is, the spacing lengths P at the driving side, the showing that the spacing length P is increased from central portion and the non-driving side are defined as a driving side length P1R, a central portion length P1C and a non-driving side length P1L, respectively. A relationship of these lengths is represented by the following formula 5.

$$P1L=P1C=P1R \quad \text{(formula 5)}$$

Similarly, the hole center line 102*d* passes through the centers of the driving side mounting hole 102*c*R shown in the right side of FIG. 12, the central portion mounting hole 102*c*C and the non-driving side mounting hole shown in the left side of FIG. 12. The spacing lengths P in positions on the hole center line 102*d* with respect to the winding-up direction (arrow W direction of FIG. 12) of the toner seal member 102 are defined as follows. The spacing lengths P are lengths, in the respective positions, between the hole center line 102*d* and the sealing portion 24*b* of the toner seal member 102. That is, the spacing lengths P at the driving side, the showing that the spacing length P is increased from central portion and the non-driving side are defined as a driving side length P2R, a central portion length P2C and a non-driving side length P2L, respectively. A relationship of these lengths is represented by the following formula 6.

$$P2L=P2C=P2R \quad \text{(formula 6)}$$

Next, with reference to FIGS. 12 and 13, the rotatable member 101 and a behavior of the rotatable member 101 when an unsealing operation of the sealing portion 24 of the toner seal member 102 is performed by using the toner seal member 102 in Comparison example will be described.

Part (a) of FIG. 13 is a plan view for illustrating a state in which the sealing portion 24 of the toner seal member 102 is unsealed with deformation of the rotatable member 101 in Comparison example shown in FIG. 12, (b) of FIG. 13 is a sectional view for illustrating flexure V and torsion Y with the deformation of the rotatable member 101 in a non-driving side of the rotatable member 101, (c) of FIG. 13 is a sectional view for illustrating flexure V and torsion Y with the deformation of the rotatable member 101 at a central portion of the rotatable member 101 with respect to the direction of the rotational axis 101*g* of the rotatable member 101, (d) of FIG. 13 is a sectional view for illustrating flexure V and torsion Y with the deformation of the rotatable member 101 in a driving side of the rotatable member 101, and (e) of FIG. 13 is a schematic view showing a curve for illustrating cancel of loss due to flexure V and torsion Y of the rotatable member 101 with the deformation of the rotatable member 101.

Arrow directions shown in (a) of FIG. 13 represented at advancing direction of the unsealing of the sealing portion 24 of the toner seal member 102 in Comparison example shown in FIG. 12. Incidentally, in (b) of FIG. 18, the conveying sheet 44 is omitted from illustration for convenience of explanation.

The rotatable member 101 is rotationally driven in the arrow S direction shown in (b) to (d) of FIG. 13. Then, the tension is applied to a whole of the toner seal member 102, and at first, a driving side end portion 24*a*R of the sealing portion 24*a* shown in the right side of (a) of FIG. 13 is peeled. Then, the sealing portion 24 is gradually peeled in a central direction (left direction of (a) of FIG. 13) of the sealing portion 24*a* and in a direction of the sealing portion 24*d* (upper direction of (a) of FIG. 13).

The rotatable member 101 is further rotated in the arrow S direction shown in (b) of FIG. 13. Then, a non-driving side end portion 24*a*L of the sealing portion 24*a* shown in the left side of (a) of FIG. 13 is peeled, and then the sealing portion is gradually peeled in a central direction (right direction of (a) of FIG. 13) of the sealing portion 24*a* and in a direction of the sealing portion 24*c* (upper direction of (a) of FIG. 13).

On the sealing portion 24*a*, the sealing portion 24 is peeled from two directions including the driving side end portion 24*a*R of the sealing portion 24*a* and the non-driving side end portion 24*a*L of the sealing portion 24*a*, and the peeled portions merge with each other in a position somewhat closer to the non-driving side than the central portion.

The peeling of the sealing portion 24 advanced to the sealing portion 24*d* advances toward the central direction (left direction of (a) of FIG. 13) of the sealing portion 24*b* via the driving side end portion 24*b*R of the sealing portion 24*b* shown in the right side of (a) of FIG. 13.

On the other hand, peeling of the sealing portion 24 advances to the non-driving side sealing portion 24*c* shown in the left side of (a) of FIG. 13 at timing somewhat later than the peeling of the driving side sealing portion 24*d* shown in the right side of (a) of FIG. 13. The advanced peeling advances toward the central portion (in the right direction of (a) of FIG. 13) of the sealing portion 24*b* via the non-driving side end portion 24*b*L of the sealing portion 24*b* shown in the left side of (a) of FIG. 13.

Then, the sealing portion 24 is peeled from two directions, including the driving side end portion 24*b*R of the sealing portion 24*b* shown in the right side of (a) of FIG. 13 and the non-driving side end portion 24*b*L of the sealing portion 24*b* shown in the left side of (a) of FIG. 13, toward the central portion, and then the peeled portions merge with each other in a position somewhat closer to the non-driving side than the central portion.

The reason why the sealing portion 24 of the toner seal member 102 in Comparison example shown in FIG. 12 is peeled toward the central portion from the two directions including the driving side shown as the right side of (a) of FIG. 13 and the non-driving side shown as the left side of (a) of FIG. 13 will be described below.

Parts (b) to (d) of FIG. 13 are sectional illustrates each showing a state of the toner seal member 102, the rotatable member 101 and the sealing portions 24*a* and 24*b* at the moment when the driving side end portion 24*a*R, shown in the right side of (a) of FIG. 13, of the sealing portion 24*a* of the toner seal member 102 in Comparison example shown in FIG. 12.

Incidentally, the non-driving side, the central portion and the driving side shown in (b) to (d) of FIG. 13 show cross sections in positions of the non-driving side mounting hole 101*c*L shown in the left side of FIG. 12, the central portion mounting hole 101*c*C, and the driving side mounting hole 101*c*R shown in the right side of FIG. 12, respectively, of the toner seal member 102 in Comparison example shown in FIG. 12.

Part (e) of FIG. 13 is a schematic view showing the influence of the flexure V and the torsion Y, generated in the rotatable member 101, as a winding-up loss length of the toner seal member 102 in Comparison example shown in FIG. 12, and is also a schematic view showing a curve for canceling loss due to the flexure V and the torsion Y of the rotatable member 101 with the deformation of the rotatable member 101 in this embodiment.

When the rotatable member 101 is rotationally driven in the arrow S direction of (b) of FIG. 13, the toner seal member 102 is moved in the arrow W direction of (b) of FIG. 13 and then is wound up around the outer peripheral surface of the rotatable member 101. Simultaneously with the winding-up of the toner seal member 102 around the outer peripheral surface of the rotatable member 101, the tension is applied to the toner seal member 102, and reaction force thereof is applied to the rotatable member 101.

The rotatable member 101 generates, by the reaction force of the tension applied to the toner seal member 102, the flexure V with respect to a direction opposite to the arrow W direction as shown in (c) of FIG. 13. The rotatable member 101 is supported at end portions thereof, and therefore the flexure V is gradually increased from the longitudinal end portions toward a longitudinal central portion of the rotatable member 101 and becomes maximum in the neighborhood of the longitudinal central portion. In this embodiment, a position of the rotation center 101*f* in the driving side shown in (d) of FIG. 13 (or in the non-driving side shown in (b) of FIG. 13) is taken as a reference position, and a movement amount from the reference position is defined as the flexure V.

Further, the rotatable member 101 generates, by the reaction force of the tension applied to the toner seal member 102, the torsion Y with respect to a direction opposite to the rotational direction indicated by the arrow S as shown in (b) of FIG. 13.

The rotatable member 101 is, similarly as in Embodiment 1, driven by the feeding gear 50 in the driving side shown as the left side of FIG. 6 and is rotatably supported in the non-driving side. For this reason, the torsion Y is gradually increased from the driving side shown in (d) of FIG. 13 toward the non-driving side shown in (b) of FIG. 13 via the central portion shown in (c) of FIG. 13, and becomes maximum in the non-driving side shown in (b) of FIG. 13.

In this embodiment, a line connecting the rotation center 101*f* in the driving side shown in (d) of FIG. 13 and the hole center line 102*d* is taken as a reference line r, and a deformation amount from the reference line r is defined as the torsion Y.

The flexure V and the torsion Y of the rotatable member 101 act on the toner seal member 102 with respect to a direction opposite to the winding-up direction (arrow W direction of (c) of FIG. 13) of the toner seal member 102, and therefore constitute winding-up loss of the toner seal member 102. By this winding-up loss, a difference in degree of application of the tension on the longitudinal direction of the rotatable member 101 is generated, so that the unsealing of the sealing portion 24 of the toner seal member 102 is started from a position where the winding-up loss is small.

Part (e) of FIG. 13 shows the curve obtained by converting the influence of the flexure V and the torsion Y of the rotatable member 101 into the winding-up loss length of the toner seal member 102.

In this embodiment, corresponding to the flexure V and the torsion Y with rotation of the rotatable member 101, the spacing length P between the sealing portion 24 of the toner seal member 102 and the hole center line 102*d* passing through the centers of the plurality of mounting holes 102*c* as the mounting portion is corrected. At that time, an amount of the flexure V (flexure amount) and an amount of the torsion Y (torsion amount) of the rotatable member 101 at the moment when a part of the sealing portion 24 is unsealed are measured.

In (e) of FIG. 13, a length obtained by converting the flexure V of the rotatable member 101 into the winding-up loss length of the toner seal member 102 in the non-driving side, as a reference side, shown in (d) of FIG. 13 is defined as a flexure loss length Ld. The flexure loss length Ld is a movement amount itself of the rotation center 101*f* in respective positions on the longitudinal direction of the rotatable member 101 in the driving side (reference side) shown in (d) of FIG. 13.

As shown in (e) of FIG. 13, the flexure loss length Ld, similarly as in the flexure of a both end-supported beam, "0" (zero) in supporting positions at the longitudinal end portions in the driving side and the non-driving side. Further, the curve of the flexure loss length Ld is represented by a cubic curve having a maximum in the neighborhood of the central portion with respect to the longitudinal direction of the rotatable member 101. Here, a maximum flexure loss length Ldmax generated at the longitudinal central portion of the rotatable member 101 is taken as "a".

In (e) of FIG. 13, a length obtained by converting the torsion Y of the rotatable member 101 into the winding-up loss length of the toner seal member 102 in the non-driving side, as a reference side, shown in (d) of FIG. 13 is defined as a torsion loss length Lt. The flexure loss length Lt is obtained by multiplying the torsion amount in respective positions on the longitudinal direction of the rotatable member 101 by a radius of the arcuate portion 101*c* on the basis of the reference line r in the driving side shown in (d) of FIG. 13.

The arcuate portion 101*c* of the rotatable member 101 is uniform with respect to the longitudinal direction of the rotatable member 101, and therefore the torsion loss length Lt is proportional to the torsion amount. As shown in (e) of FIG. 13, the torsion loss length Lt shows, similarly as in the torsion of an one end-fixed bar, a rectilinear line which is "0" in the driving side end portion and is maximum at the non-driving side end portion. Here, a maximum torsion loss length Ltmax generated in the non-driving side is taken as "β". The torsion loss length Lt of the rotatable member 101 at the longitudinal central portion is "β/2".

As shown in (e) of FIG. 13, the sum of the flexure loss length Ld and the torsion loss length Lt is defined as a composite loss length Lc. The composite loss length Lc shows a cubic curve, and is increased in the order of the driving side, the non-driving side and the central portion. Further, in this order, the sealing portion 24 of the toner seal member 102 is unsealed. Further, as a condition in which the composite loss length Lc at the longitudinal central portion of the rotatable member 101 is a maximum composite loss length Lcmax, when the maximum flexure loss length Ldmax is "A" and the maximum torsion loss length Ltmax is "β", a relationship of the following formula 7 is satisfied.

$$\alpha > (\beta/2) \qquad \text{(formula 7)}$$

With reference to (b) to (d) of FIG. 13, the reason why the sealing portion 24*a* is peeled from the left and right (two) longitudinal directions of the sealing portion 24*a* by the influence of the flexure V and the torsion Y of the rotatable member 101 was described by using the unsealing of the sealing portion 24*a* of the toner seal member 102 as an example. For the same reason, the sealing portion 24*b* is peeled from the left and right (two) longitudinal directions of the sealing portion 24*b* by the influence of the flexure V and the torsion Y of the rotatable member 101.

As described above, when the sealing portions 24*a* and 24*b* are peeled from the left and right (two) longitudinal directions of the sealing portions 24*a* and 24*b*, a peeling force corresponding to two positions on an associated one of the longitudinal directions of the sealing portions 24*a* and 24*b* is required. For this reason, in this case, the reduction in peeling force as in the constitution in which the sealing portion 24 is pulled and peeled in the longitudinal direction (one longitudinal direction) of the toner seal member 102 as described in Embodiments 1 and 2 cannot be expected.

Therefore, a composite loss cancel length Lk for canceling the composite loss length Lc due to the flexure V and the torsion Y of the rotatable member 101 with the deformation of the rotatable member 101 in this embodiment is set as shown in (e) of FIG. 13. As shown in (e) of FIG. 13, the composite loss cancel length Lk is represented by a curve which is vertically flipped relative to the abscissa of (e) of FIG. 13 in a line-symmetric manner.

Next, a method of canceling the influence of the flexure V and the torsion Y of the rotatable member 101 will be described with reference to (e) of FIG. 13, and then a constitution for pulling and peeling the sealing portion 24 of the toner seal member 102 in the longitudinal direction (one longitudinal direction) in consideration of the influence of the flexure V and the torsion Y will be described.

First, a method in which the influence of the flexure V and the torsion Y of the rotatable member 101 is cancelled to equalize the winding-up loss length of the toner seal member 104 over the entire region of the rotatable member 101 with respect to the longitudinal direction will be described.

The curve of the composite loss cancel length shown in (e) of FIG. 13 is a curve obtained by projecting the curve of the composite loss length Lc, due to the flexure V and the torsion Y of the rotatable member 101 with the deformation of the rotatable member 101, onto the graph in a line-symmetrical manner with respect to the longitudinal direction of the rotatable member 101, (i.e., with respect to the abscissa of the graph of (e) of FIG. 13).

The composite loss cancel length Lk in an arbitrary longitudinal position of the rotatable member 101 relative to a predetermined reference position is set as follows. That is, the composite loss cancel length Lk reflected in the spacing length P with respect to the winding-up direction (arrow W direction of (b) of FIG. 14) of the toner seal member 104 to be mound up by the rotatable member 101. As a result, the influence of the flexure V and the torsion Y of the rotatable member 101 can be canceled.

The spacing length P is the length between the hole center line 104*d* and the sealing portions 24*a* and 24*b* of the toner seal member 104. The hole center line 104*d* is the line passing through the centers of the plurality of mounting holes 104*c*, disposed continuously at a predetermined pitch, as the mounting portion provided in the side of the toner seal member 104 connected with the rotatable member 101.

In order to decrease the loss due to the flexure V and the torsion Y of the rotatable member 101 (in order to reflect an amount of loss corresponding to an amount of the cancel), it is possible to meet the decrease in loss by shortening the spacing length P. On the other hand, in the case where the loss is increased, it is possible to meet the increase in loss by lengthening the spacing length P.

That is, in order to reflect the composite loss cancel length Lk shown in (e) of FIG. 13, depending on a loss amount of the composite loss, the spacing length P may only be required to be shortened on the driving side basis.

As a result, it is possible to equalize the winding-up length in an arbitrary longitudinal position of the rotatable member 101 with the winding-up length in a predetermined reference position. That is, the welding strength can reach a limit thereof substantially concurrently in the entire region of the sealing portion 24*a* of the toner seal member 104. Similarly, the welding strength can reach the limit thereof substantially concurrently in the entire region of the sealing portion 24*b*.

<Operation for Unsealing Sealing Portion in One Direction from Driving Side>

Next, the constitution for pulling and peeling the sealing portion 24 in the (one) longitudinal direction of the rotatable member 101 in consideration of the influence of the flexure V and the torsion Y of the rotatable member 101 will be described with reference to FIGS. 14 to 16.

Part (a) of FIG. 14 is a graph showing a relationship the longitudinal position and the winding-up loss length of the toner seal member 104, shown in (b) of FIG. 14, in consideration of the flexure V and the torsion Y of the rotatable member 101.

Part (b) of FIG. 14 is a schematic view for illustrating a positional relationship between the sealing portion 24 and the toner seal member 104 capable of unsealing the sealing portion 24 in one longitudinal direction of the rotatable member 101 while being subjected to the influence of the flexure V and the torsion Y of the rotatable member 101.

In this embodiment, as shown in (b) of FIG. 14, the toner supplying opening 27 as the opening is sealed with the sealing portion 24 of the toner seal member 104, and then a region from the sealing portion 24 to the hole center line 104*d* passing through the centers of the mounting holes 104*c* as the mounting portion is made flat. In that state, the longitudinal direction of the sealing portions 24*a* and 24*b* is substantially parallel to the rotation shaft 101*g* of the rotatable member 101, and the direction (longitudinal direction) of the hole center line 104*d* is disposed so as to be curved. As a result, the spacing length P between the hole center line 104*d* and the sealing portions 24*a* and 24*b* of the toner seal member 104 with respect to the direction crossing the longitudinal direction of the cartridge 302 (i.e., with respect to the arrow W direction of (b) of FIG. 14) is different between the longitudinal end portion and the longitudinal central portion.

Incidentally, a geometrical tolerance value of parallelism between the longitudinal direction of the sealing portions 24*a* and 24*b* of the toner seal member 104 and the rotation shaft 101*g* of the rotatable member 101 is approximately 5 mm.

FIG. 15 is a schematic view for illustrating a state in which the toner seal member 104 is mounted on the rotatable member 101.

FIG. 16 is a graph showing a relationship between the longitudinal position and the winding-up loss length of the toner seal member 104 shown in (b) of FIG. 14, in consideration of the influence of the flexure V and the torsion Y of the rotatable member 101.

The unsealing of the sealing portion 24 of the toner seal member 104 with respect to the longitudinal direction of the rotatable member 101 while being subjected to the influence of the flexure V and the torsion Y of the rotatable member 101 can be effected. For that purpose, from a state in which the composite loss length Lc due to the flexure V and the torsion Y of the rotatable member 101 with the deformation of the rotatable member 101 is canceled by the composite loss cancel length Lk, as shown in (a) of FIG. 14, an additional loss length La may only be intentionally added.

With reference to (a) of FIG. 14, a constitution in which the sealing portion 24 is driving sided from the driving side with respect to one direction of the longitudinal direction will be described. The loss length to be intentionally added refers to the additional loss length La. The additional loss length La in this embodiment shows a rectilinear line continuously increased from the driving side toward the non-driving side.

When a maximum additional loss length Lamax in the driving side of (a) of FIG. 14 is taken as "γ" and a maximum torsion loss length Ltmax is taken as "β", these loss lengths are set to satisfy a relationship of the following formula 8.

$$\gamma<\beta \quad \text{(formula 8)}$$

Further, in (a) of FIG. 14, the sum of the composite loss cancel length Lk and the additional loss length La is represented by a correction loss length Lh.

In (b) of FIG. 14, a constitution of toner seal member 104 in which the correction loss length Lh is reflected is shown. The toner seal member 104 unsealable seal the toner supplying opening 27 as the opening. The hole center line 104*d* which passes through the centers of the plurality of mounting holes 104*c* disposed continuously at a predetermined pitch at the fixing-side end portion 104*a* of the toner seal member 104 and which is curved upward in (b) of FIG. 14 shows the same curve as the correction loss length Lh described with reference to (a) of FIG. 14. As a result, the sealing portion 24 of the toner seal member 104 can be unsealed with respect to one direction of the longitudinal direction of the rotatable member 101 while being subjected to the influence of the flexure V and the torsion Y of the rotatable member 101. Other constituent elements are the same as those in the above-described embodiments, and a similar effect can be obtained.

With reference to FIG. 15, a state in which the toner seal member 104 is mounted on the rotatable member 101 will be described.

As shown in FIG. 15, when the mounting holes of the toner seal member 104 are mounted with projected portions 101*a* of the rotatable member 101, as shown in (b) of FIG. 14, the hole center line 104*d* is curved, and therefore a loosened portion 104*e* is generated in each of the driving side and the non-driving side of the toner seal member 104.

When the toner seal member 104 is wound up by the rotatable member 101, the tension is applied to the toner seal member 104 in longitudinal positions in the increasing order of the spacing length P. At first, the tension is applied to the rotatable member 101 from the central portion toward the non-driving side with respect to the longitudinal direction of the rotatable member 101 in (b) of FIG. 14. Then, the tension is applied to the rotatable member 101 in the non-driving side with respect to the longitudinal direction of the rotatable member 101 in (b) of FIG. 14. Finally, the tension is applied to the rotatable member 101 in the driving side with respect to the longitudinal direction of the rotatable member 101 in (b) of FIG. 14.

At the same time when the tension is applied to the toner seal member 104, the flexure V and the torsion Y are generated in the rotatable member 101. Further, when the toner seal member 104 is wound, it is possible to pull and peel the sealing portions 24*a* and 24*b* from the driving side, where the additional loss length La shown in (a) of FIG. 14 is small, toward the non-driving side where the additional loss length La is large.

Further, as shown in (a) of FIG. 14, as a result that the additional loss length La is a rectilinear line continuously increasing from the driving side toward the non-driving side, the correction loss length Lh became a curved line. However, as another constitution, as shown in FIG. 16, when the additional loss length La is curved line continuously increasing from the driving side toward the non-driving side, it is also possible to provide a rectilinear line as the correction loss length Lh. In this case, as in Embodiment 1 described with reference to FIG. 8, it is also possible to provide the rectilinear line as the hole center line 104*d* of the toner seal member 104.

However, as shown in FIG. 16, "γ" as the required maximum additional loss length Lamax becomes large. Therefore, a value of "γ" as the required maximum additional loss length Lamax may only be required to be determined by appropriately selecting the rectilinear line and the curved line while achieving a balance between the welding strength and the peeling force of the toner seal member 104.

Here, the additional loss lengths La in positions of the central portion and the non-driving side relative to the driving side are defined as a central portion additional loss length ΔRC on a driving side basis and a non-driving side additional loss length ΔRL on the driving side basis, respectively. The additional loss lengths ΔRC and ΔRL, the non-driving side lengths P1L and P2L, the central portion lengths P1C and P2C and the driving side lengths P1R and P2R are used. Further, when the maximum flexure loss length Ldmax is taken as "α" and the maximum torsion loss length Ltmax is taken as "β", relationships of the following formulas 9 and 10 are satisfied.

$$\Delta RC=P1C-P1R+\alpha+(\beta/2) \quad \text{(formula 9)}$$

$$\Delta RL=P1L-P1R+\beta \quad \text{(formula 10)}$$

Further, when the additional loss length La in a position of the non-driving side relative to the central portion is defined as a non-driving side additional loss length ΔCL on a central portion basis, a relationship of the following formula 11 is satisfied.

$$\Delta CL=\Delta Rl-\Delta RC=P1L-P1C-\alpha+(\beta/2) \quad \text{(formula 11)}$$

A condition in which the additional loss length La is continuously increased from the driving side toward the non-driving side is at least represented by a relationship of the following formula 12.

$$\Delta RC>0$$

$$\Delta CL>0 \quad \text{(formula 12)}$$

Therefore, when a condition of a formula 13 shown below is satisfied, it is possible to pull and peel the sealing portion 24*a* in one direction from the driving side toward the non-driving side.

$$\Delta RC=P1C-P1R+\alpha+(\beta/2)>0$$

$$\Delta CL=P1L-P1C-\alpha+(\beta/2)>0 \quad \text{(formula 13)}$$

Similarly also with respect to the sealing portion 24*b*, when a condition of a formula 14 shown below is satisfied, it is possible to pull and peel the sealing portion 24*b* in one direction from the driving side toward the non-driving side.

$$\Delta RC=P2C-P2R+\alpha+(\beta/2)>0$$

$$\Delta CL=P2L-P2C-\alpha+(\beta/2)>0 \quad \text{(formula 14)}$$

Further, from the right side of the non-driving side additional loss length ΔCL on the central portion basis in formula 13, a relationship of the following formula 15 can be obtained.

$$P1L-P1C>\alpha-(\beta/2) \quad \text{(formula 15)}$$

Further, as a condition in which the sealing portion 24 cannot be unsealed in one direction from the driving side by the influence of the flexure V and the torsion Y of the rotatable member 101, a relationship of the following formula 16 can be obtained.

$$\alpha>(\beta/2), \text{ i.e., } \alpha-(\beta/2)>0 \quad \text{(formula 16)}$$

From the formulas 15 and 16, at least a relationship of the following formula 17 is satisfied.

$$P1L-P1C>\alpha-(\beta/2)>0 \quad \text{(formula 17)}$$

Accordingly, a relationship of the following formula 18 is satisfied.

$$P1L>P1C \quad \text{(formula 18)}$$

Similarly, a relationship of the following formula 19 is satisfied.

$$P2L>P2C \quad \text{(formula 19)}$$

Therefore, the non-driving side loss lengths P1L and P2L are longer than the central portion lengths P1C and P2C, respectively. Other constituent elements are the same as those in the above-described embodiments, and a similar effect can be obtained.

Embodiment 4

Next, with reference to (a) of FIG. 17, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In Embodiment 3, when the maximum additional loss length Lamax in the non-driving side in (a) of FIG. 14 is "γ" and the maximum torsion loss length Ltmax is "β", the relationship of the above-described formula 8 was used.

In this embodiment, as shown in (a) of FIG. 17, when the maximum additional loss length Lamax is "γ" and the maximum torsion loss length Ltmax is "β", a relationship of the following formula 20 was satisfied.

$$\gamma=\gamma \quad \text{(formula 20)}$$

Part (a) of FIG. 17 is a schematic view for illustrating a positional relationship between a toner seal member 105 and the sealing portion 24 which satisfy a relationship of the above formula 20.

Also in this embodiment, as shown in (a) of FIG. 17, the toner supplying opening 27 as the opening is sealed with the sealing portion 24 of the toner seal member 105, and then a region from the sealing portion 24 to the hole center line 105*d* passing through the centers of the mounting holes 105*c* as the mounting portion is made flat. In that state, the longitudinal direction of the sealing portions 24*a* and 24*b* is substantially parallel to the rotation shaft 101*g* of the rotatable member 101, and the direction (longitudinal direction) of the hole center line 105*d* is disposed so as to be curved. As a result, the spacing length P between the hole center line 105*d* and the sealing portions 24*a* and 24*b* of the toner seal member 105 with respect to the direction crossing the longitudinal direction of the cartridge 302 (i.e., with respect to the arrow W direction of (a) of FIG. 17) is different between the longitudinal end portion and the longitudinal central portion.

Incidentally, a geometrical tolerance value of parallelism between the longitudinal direction of the sealing portions 24*a* and 24*b* of the toner seal member 105 and the rotation shaft 101*g* of the rotatable member 101 is approximately 5 mm.

A plurality of mounting holes 105*c* as the mounting portion consisting of through holes of the toner seal member 105 for unsealably sealing the toner supplying opening 27 as the opening are as follows. That is, the plurality of mounting holes 105*c* includes a mounting hole 105*c*R positioned at an end portion in the driving side shown as the right side of (a) of FIG. 17 with respect to the longitudinal direction of the sealing portion 24, a mounting hole 105*c* (positioned at a longitudinal central portion of the sealing portion 24, and a mounting hole 105*c*L positioned at another end portion in the non-driving side shown as the left side of (a) of FIG. 17 with respect to the longitudinal direction of the sealing portion 24.

Further, the hole center line 105*d* passes through the centers of the mounting holes 105*c*R, 105*c*C and 105*c*L. Further, with respect to the arrow W direction of (a) of FIG. 17, the spacing length P between the hole center line 105*d* and the sealing portion 24*a* in positions on the hole center line 105*d* curved upward in (a) of FIG. 17 are a driving side length P1R (for 105*c*R), a central portion length P1C (for 105*c*C) and a non-driving side length P1L (for 105*c*L).

Similarly, with respect to the arrow W direction of (a) of FIG. 17, the spacing lengths P between the hole center line 105*d* and the sealing portion 24*b* in positions on the curved hole center line 105*d* passing through the centers of the mounting holes 105*c*R<105*c*C and 105*c*L are a driving side length P2R (for 105*c*R), a central portion length P2C (for 105*c*C) and a non-driving side length P2L (for 105*c*L).

When the driving side length P1R is taken as a reference length, the central portion length P1C is shorten (than the driving side length P1R) by "α". Similarly, when the driving side length P1R is taken as the reference length, the non-driving side length P1L is equal to the driving side length P1R. Also a relationship between the driving side length P2R, the central portion length P2C and the non-driving side length P2L is similar to that described above.

In the toner seal member 105, the hole center line 105*d* is symmetrical with respect to the central portion mounting hole 105*c*C as the center, and on the basis of the driving side length P1R, the central portion length P1C is shorter by "α", and the non-driving side P1L is equal to the driving side length P1R. The fixing-side end portion 105*a* is spaced (offset) from the hole center line 105*d* by a predetermined dimension.

As a result, the sealing portion 24 of the toner seal member 105 can be unsealed with respect to one direction of the longitudinal direction of the rotatable member 101 while being subjected to the influence of the flexure V and the torsion Y of the rotatable member 101. Other constituent elements are the same as those in the above-described embodiments, and a similar effect can be obtained.

Embodiment 5

Next, with reference to (b) of FIG. 17, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In this embodiment, as shown in (b) of FIG. 17, when the maximum additional loss length Lamax is "γ" and the maximum torsion loss length Ltmax is "β", a relationship of the following formula 20 was satisfied.

$$\gamma > \beta \qquad \text{(formula 21)}$$

Part (b) of FIG. 17 is a schematic view for illustrating a positional relationship between a toner seal member 106 and the sealing portion 24 which satisfy a relationship of the above formula 21.

Also in this embodiment, as shown in (b) of FIG. 17, the toner supplying opening 27 as the opening is sealed with the sealing portion 24 of the toner seal member 106, and then a region from the sealing portion 24 to the hole center line 106*d* passing through the centers of the mounting holes 106*c* as the mounting portion is made flat. In that state, the longitudinal direction of the sealing portions 24*a* and 24*b* is substantially parallel to the rotation shaft 101*g* of the rotatable member 101, and the direction (longitudinal direction) of the hole center line 106*d* is disposed so as to be curved. As a result, the spacing length P between the hole center line 106*d* and the sealing portions 24*a* and 24*b* of the toner seal member 106 with respect to the direction crossing the longitudinal direction of the cartridge 302 (i.e., with respect to the arrow W direction of (b) of FIG. 17) is different between the longitudinal end portion and the longitudinal central portion.

Incidentally, a geometrical tolerance value of parallelism between the longitudinal direction of the sealing portions 24*a* and 24*b* of the toner seal member 106 and the rotation shaft 101*g* of the rotatable member 101 is approximately 5 mm.

A plurality of mounting holes 106*c* as the mounting portion consisting of through holes of the toner seal member 106 for unsealably sealing the toner supplying opening 27 as the opening are as follows. That is, the plurality of mounting holes 106*c* includes a mounting hole 106*c*R positioned at an end portion in the driving side shown as the right side of (b) of FIG. 17 with respect to the longitudinal direction of the sealing portion 24, a mounting hole 106*c* (positioned at a longitudinal central portion of the sealing portion 24, and a mounting hole 106*c*L positioned at another end portion in the non-driving side shown as the left side of (b) of FIG. 17 with respect to the longitudinal direction of the sealing portion 24.

Further, the hole center line 106*d* passes through the centers of the mounting holes 106*c*R, 106*c*C and 106*c*L. Further, with respect to the arrow W direction of (b) of FIG. 17, the spacing length P between the hole center line 106*d* and the sealing portion 24*a* in positions on the hole center line 106*d* curved upward in (b) of FIG. 17 are a driving side length P1R (for 106*c*R), a central portion length P1C (for 106*c*C) and a non-driving side length P1L (for 106*c*L).

Similarly, with respect to the arrow W direction of (b) of FIG. 17, the spacing lengths P between the hole center line 106*d* and the sealing portion 24*b* in positions on the curved hole center line 106*d* passing through the centers of the mounting holes 106*c*R<106*c*C and 106*c*L are a driving side length P2R (for 106*c*R), a central portion length P2C (for 106*c*C) and a non-driving side length P2L (for 106*c*L).

When the driving side length P1R is taken as a reference length, the central portion length P1C is shorten (than the driving side length P1R) by $\{\alpha+(\beta/2)-(\gamma/2)\}$. Similarly, when the driving side length P1R is taken as the reference length, the non-driving side length P1L is shorter than the driving side length P1R by $(\beta-\gamma)$. Also a relationship between the driving side length P2R, the central portion length P2C and the non-driving side length P2L is similar to that described above. Other constituent elements are the same as those in the above-described embodiments, and a similar effect can be obtained.

Embodiment 6

Next, with reference to FIG. 18, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In this embodiment, a constitution in which the sealing portion 24 of a toner seal member 107 is unsealed with respect to one longitudinal direction from the non-driving side shown as the left side of FIG. 18 toward the driving side shown as the right side of FIG. 18 is employed.

Part (a) of FIG. 18 is a graph showing a relationship the longitudinal position and the winding-up loss length of the toner seal member 107 unsealably sealing the toner supplying opening 27 as the opening.

Part (b) of FIG. 18 is a schematic view for illustrating a positional relationship between the sealing portion 24 and the toner seal member 107 capable of unsealing the sealing portion 24 of the toner seal member 107 in one longitudinal direction of the sealing portion 24 while being subjected to the influence of the flexure V and the torsion Y of the rotatable member 101.

Also in this embodiment, as shown in (b) of FIG. 18, the toner supplying opening 27 as the opening is sealed with the sealing portion 24 of the toner seal member 107, and then a region from the sealing portion 24 to the hole center line 107*d* passing through the centers of the mounting holes 107*c* as the mounting portion is made flat. In that state, the longitudinal direction of the sealing portions 24*a* and 24*b* is substantially parallel to the rotation shaft 101*g* of the rotatable member 101, and the direction (longitudinal direction) of the hole center line 107*d* is disposed so as to be curved. As a result, the spacing length P between the hole center line 107*d* and the sealing portions 24*a* and 24*b* of the toner seal member 107 with respect to the direction crossing the longitudinal direction of the cartridge 302 (i.e., with respect to the arrow W direction of (b) of FIG. 18) is different between the longitudinal end portion and the longitudinal central portion.

Incidentally, a geometrical tolerance value of parallelism between the longitudinal direction of the sealing portions 24*a* and 24*b* of the toner seal member 107 and the rotation shaft 101*g* of the rotatable member 101 is approximately 5 mm.

As in the toner seal member 107 shown in (b) of FIG. 18, the sealing portion 24 is unsealed in one direction of the longitudinal direction of the sealing portion 24 from the non-driving side shown as the left side of (b) of FIG. 18 toward the driving side shown as the right side of (b) of FIG. 18. For that purpose, a way of thinking about the additional loss length La is as follows. That is, as in the toner seal member 107 shown in (b) of FIG. 17, the way of thinking about the additional loss length La may only be required to be reversed with respect to the case where the sealing portion 24 is unsealed in one direction of the longitudinal direction of the sealing portion 24 from the driving side shown as the right side of (b) of FIG. 17 toward the non-driving side shown as the left side of (b) of FIG. 17. That is, as shown in (a) of FIG. 18, the additional loss length La may only be required to continuously increasing form the non-driving side toward the driving side.

In (a) of FIG. 18, the composite loss length Lk is taken on the basis of the non-driving side, and the additional loss length La is a rectilinear line continuously increasing from the non-driving side toward the driving side.

In (a) of FIG. 18, when a maximum additional loss length Lamax in the driving side is taken as "γ" and a maximum torsion loss length Ltmax is taken as "β", these loss lengths are set to satisfy a relationship of the following formula 22 is satisfied.

$$\gamma<\beta \qquad \text{(formula 22)}$$

Further, in (a) of FIG. 18, the sum of the composite loss cancel length Lk and the additional loss length La is represented by a correction loss length Lh.

Part (b) of FIG. 18 shows the toner seal member 107 in which the correction loss length Lh shown in (a) of FIG. 18 is reflected in the spacing length P with respect to the winding-up direction (arrow W direction of (b) of FIG. 18) of the toner seal member 107 to be wound up by the rotatable member 101.

The spacing length P is the length between the hole center line 107*d* and the sealing portions 24*a* and 24*b* of the toner seal member 107. The hole center line 107*d* is the line which passes through the centers of the plurality of mounting holes 107*c*, disposed continuously at a predetermined pitch, as the mounting portion provided in the side of the toner seal member 107 connected with the rotatable member 101, and is curved upward in (b) of FIG. 18.

The hole center line 107*d* which passes through centers of the plurality of mounting holes 107*c* and which is curved upward in (b) of FIG. 17 is the same curved line as a curved line which is vertical reverse of the correction loss length Lh shown in (a) of FIG. 18. That is, the plurality of mounting holes 107*c* includes a mounting hole 107*c*R positioned at an end portion in the driving side shown as the right side of (a) of FIG. 18 with respect to the longitudinal direction of the sealing portion 24, a mounting hole 107*c*C positioned at a longitudinal central portion of the sealing portion 24, and a mounting hole 107*c*L positioned at another end portion in the non-driving side shown as the left side of (a) of FIG. 18 with respect to the longitudinal direction of the sealing portion 24.

The spacing lengths P between the hole center line 107*d* and the sealing portion 24*a* in positions of the respective mounting holes 107*c*R, 107*c*C and 107*c*L are a driving side length P1R, a central portion length P1C and a non-driving side length P1L, respectively.

Similarly, the spacing lengths P between the hole center line 107*d* and the sealing portion 24*b* in the above-described positions are a driving side length P2R (for 107*c*R), a central portion length P2C (for 107*c*C) and a non-driving side length P2L (for 107*c*L).

When the non-driving side length P1L shown in the left side of (b) of FIG. 18 is taken as a reference length, the central portion length P1C is shorten (than the non-driving side length P1L) by $\{\alpha-(\gamma/2)\}$. Similarly, when the non-driving side length P1L is taken as the reference length, the driving side length P1R shown in the right side of (b) of FIG. 18 is longer than the non-driving side length P1L by $(\beta+\gamma)$. Also a relationship between driving side length P2R, the central portion length P2C and the non-driving side length P2L is similar to that described above. The fixing-side end portion 107*a* of the toner seal member 107 is spaced (offset) from the hole center line 107*d* by a predetermined dimension.

The toner seal member 107 shown in (b) of FIG. 18 is wound up by the rotatable member 101. Then, it is possible to pull and peel the sealing portions 24*a* and 24*b* in one direction from the non-driving side, where the additional loss length La shown in the left side of (b) of FIG. 18 is small, toward the driving side where the additional loss length La shown in the right side of FIG. 18 is large.

Further, when the maximum additional loss length Lamax is "γ" and the maximum torsion loss length Ltmax is "β", also with respect to a relationship of formula 23 shown below, it is possible to similarly pull and peel the sealing portions 24*a* and 24*b* in one direction from the non-driving side toward the driving side.

$$\gamma=\beta$$

$$\gamma>\beta \qquad \text{(formula 23)}$$

Further, as shown in FIG. 16, when the additional loss length La is curved line continuously increasing from the driving side toward the non-driving side, it is also possible to provide a rectilinear line as the correction loss length Lh. In this case, as in the case of the hole center line 52*d* of the toner seal member 52 shown in (c) of FIG. 8, as the hole center line 107*d* of the toner seal member 107 is the rectilinear line.

However, as shown in FIG. 16, "γ" as the required maximum additional loss length Lamax becomes large, and therefore, a value of "γ" as the maximum additional loss length Lamax may only be required to be determined by appropriately selecting the rectilinear line and the curved line while achieving a balance between the welding strength and the peeling force of the toner seal member 104.

The additional loss lengths La in positions of the central portion and the driving side relative to the non-driving side are defined as a central portion additional loss length ΔLC on a non-driving side basis and a driving side additional loss length ΔLR on the non-driving side basis, respectively. The additional loss lengths ΔLC and ΔLR, the non-driving side lengths P1L and P2L, the central portion lengths P1C and P2C and the driving side lengths P1R and P2R are used. Further, when the maximum flexure loss length Ldmax is taken as "α" and the maximum torsion loss length Ltmax is taken as "β", a relationship of the following formula 24 satisfied.

$$\Delta LC=P1C-P1L+\alpha-(\beta/2)$$

$$\Delta LR=P1R-P1L-\beta \quad \text{(formula 24)}$$

Further, when the additional loss length La in a position of the driving side relative to the central portion is defined as a driving side additional loss length ΔCR on a central portion basis, a relationship of the following formula 25 is satisfied.

$$\Delta CR=\Delta LR-\Delta LC=P1R-P1C-\alpha-(\beta/2) \quad \text{(formula 25)}$$

A condition in which the additional loss length La is continuously increased from the non-driving side toward the driving side at least satisfies a relationship of the following formula 26.

$$\Delta LC>0$$

$$\Delta CR>0 \quad \text{(formula 26)}$$

Therefore, when a condition of a formula 27 shown below is satisfied, it is possible to pull and peel the sealing portion 24*a* in one direction from the non-driving side toward the driving side.

$$\Delta LC=P1C-P1L+\alpha-(\beta/2)>0$$

$$\Delta CR=P1R-P1C-\alpha-(\beta/2)>0 \quad \text{(formula 27)}$$

Similarly also with respect to the sealing portion 24*b*, when a condition of a formula 28 shown below is satisfied, it is possible to pull and peel the sealing portion 24*b* in one direction from the non-driving side toward the driving side.

$$\Delta LC=P2C-P2L+\alpha-(\beta/2)>0$$

$$\Delta CR=P2R-P2C-\alpha-(\beta/2)>0 \quad \text{(formula 28)}$$

Further, from the driving side additional loss length ΔCR on the central portion basis, a relationship of the following formula 29 can be obtained.

$$P1R-P1C>\alpha+(\beta/2)$$

$$\alpha>0$$

$$\beta>0 \quad \text{(formula 29)}$$

As a result, at least a condition represented by the following formula 30 is obtained.

$$P1R-P1C>\alpha+(\beta/2)>0 \quad \text{(formula 30)}$$

Accordingly, a relationship of the following formula 31 is satisfied.

$$P1R>P1C \quad \text{(formula 31)}$$

Similarly, a relationship of the following formula 32 is satisfied.

$$P2R>P2C \quad \text{(formula 32)}$$

According to this embodiment, even in the case where the flexure V and the torsion Y are generated in the rotatable member 101, the additional loss length La continuously increasing from the driving side toward the non-driving side is added to the relationship of the spacing length P capable of canceling the influence of the flexure V and the torsion Y. Alternatively, the additional loss length La continuously increasing from the non-driving side toward the driving side as shown in (a) of FIG. 18 is added.

As a result, it is possible to pull and peel the toner seal member 107 from the driving side toward the non-driving side in the direction of the rotation shaft 101*g* of the rotatable member 101. Alternatively, it is possible to pull and peel the toner seal member 107, shown in (b) of FIG. 18, from the non-driving side shown as the left side of (b) of FIG. 18 toward the driving side shown as the right side of (b) of FIG. 18 in the direction of the rotation shaft 101*g* of the rotatable member 101.

As a result, an automatic winding-up load of the toner seal member 107 can be reduced. Consequently, it is possible to downsize a motor for rotationally driving the rotatable member 101 and a driving system and to employ an inexpensive material. As a result, the image forming apparatus 301 can be decreased in size and cost.

With a larger value of "γ" as the maximum additional loss length Lamax shown in (a) of FIG. 18, the peeling width X2 of the sealing portions 24*a* and 24*b* shown in (b) of FIG. 9 becomes narrower, and therefore the peeling force is decreased. On the other hand, the unsealing time becomes longer, and therefore the value of "γ" as the maximum additional loss length Lamax shown in (a) of FIG. 18 is determined by achieving a balance between the feeling force and the unsealing time.

For example, in the case where the sealing portion 24*a* is unsealed in one direction from the driving side toward the non-driving side, when "γ" as the maximum additional loss length Lamax is increased, a difference in spacing length P between the non-driving side length P1L, the central portion length P1C and the driving side length P1R is once decreased. However, thereafter, the difference in spacing length P is gradually increased.

On the other hand, in the case where the sealing portion 24 is unsealed in one direction from the non-driving side toward the driving side, the difference in spacing length P is only increased. For that reason, when the difference in sealing portion P is compared by using the additional loss length La under the same condition, the difference in spacing length P is small in the case where the sealing portion 24 is unsealed in one direction from the driving side toward the non-driving side.

When the difference in spacing length P is small, a whole area of the toner seal member 107 becomes small, and therefore it is desirable that the sealing portion 24 is unsealed in one direction from the driving side toward the non-driving side. However, the toner seal member 107 and the sealing portion 24 may appropriately be selected also in view of factors other than the shapes thereof. Other constituent elements are the same as those in the above-described embodiments, and a similar effect can be obtained.

Embodiment 7

Next, with reference to (a) and (b) of FIG. 19, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In the above-described embodiments, the sealing portions 24*a* and 24*b* of the toner seal members 102 and 104 to 107 has the rectilinear line shape. Further, the correction loss length Lh is reflected in the hole center lines 102*d* and 104*d* to 107*d* of the toner seal members 102 and 104 to 107. Further, the spacing length P was changed with respect to the longitudinal directions 24*a* and 24*b*.

As a result, even in the case where the flexure V and the torsion Y are generated in the rotatable member 101, the sealing portions 24*a* and 24*b* of the toner seal members 102 and 104 to 107 are peelable in one direction from the end side toward another end side with respect to the rotation shaft 101*g* of the rotatable member 101. This effect was described.

However, the spacing length P is a spacing distance between the sealing portions 24*a* and 24*b* and the hole center lines 102*d* and 104*d* to 107*d* of the toner seal members 102 and 104 to 107. Further, the spacing length P is a spacing distance with respect to the winding-up direction (arrow W direction) of the toner seal members 102 and 104 to 107 to be wound up by the rotatable member 101. For this reason, the correction loss length Lh may also be reflected, in place of the hole center lines 102*d* and 104*d* to 107*d*, in sealing portions 109*a* and 109*b* as shown in (b) of FIG. 19.

<Constitution for Unsealing Sealing Portion in One Direction from Driving Side>

With reference to (a) and (b) of FIG. 9, the correction loss length Lh is reflected in the sealing portions 109*a* and 109*b* of a toner seal member 108. Further, a constitution for peeling the sealing portion 109 of the toner seal member 108 in one direction from the driving side shown as the right side of (b) of FIG. 19 toward the non-driving side shown as the left side of (b) of FIG. 19 will be described.

The sealing portion 109 of the toner seal member 108 unsealably seals the toner supplying opening 27 as the opening.

Part (a) of FIG. 19 is a graph showing a relationship the longitudinal position and the winding-up loss length of the toner seal member 108 under the influence of the flexure V and the torsion Y generated in the rotatable member 101.

Part (b) of FIG. 19 is a schematic view for illustrating a positional relationship between the sealing portion 109 and the toner seal member 108 capable of unsealing the sealing portion 109 in one longitudinal direction of the sealing portion 109 while being subjected to the influence of the flexure V and the torsion Y generated in the rotatable member 101.

In this embodiment, as shown in (b) of FIG. 19, the toner supplying opening 27 as the opening is sealed with the sealing portion 109 of the toner seal member 108, and then a region from the sealing portion 109 to the hole center line 108*d* passing through the centers of the mounting holes 108*c* as the mounting portion is made flat. In that state, the direction (longitudinal direction) of the hole center line 108*d* passing through the centers of the mounting holes 108*c* as the mounting portion is substantially parallel to the rotation shaft 101*g* of the rotatable member 101, and the longitudinal direction of the sealing portions 109*a* and 109*b* hole center line 109*d* is disposed so as to be curved. As a result, the spacing length P between the hole center line 108*d* and the sealing portions 109*a* and 109*b* of the toner seal member 108 with respect to the direction crossing the longitudinal direction of the cartridge 302 (i.e., with respect to the arrow W direction of (b) of FIG. 19) is different between the longitudinal end portion and the longitudinal central portion.

Incidentally, a geometrical tolerance value of parallelism between the longitudinal direction of the hole center line 108*d* and the rotation shaft 101*g* of the rotatable member 101 is approximately 5 mm.

As shown in (a) of FIG. 19, the additional loss length La is a rectilinear line continuously increasing from the driving side toward the non-driving side.

A maximum additional loss length Lamax in the driving side is taken as "γ" and a maximum torsion loss length Ltmax is taken as "β". These loss lengths are set to satisfy a relationship of the following formula 33.

$$\gamma<\beta \quad \text{(formula 33)}$$

Further, the sum of the composite loss cancel length Lk and the additional loss length La is represented by a correction loss length Lh.

In (b) of FIG. 19, the hole center line 108*d* consisting of the line connecting the centers of the plurality of mounting holes 108*c* as the mounting portion disposed continuously at a predetermined pitch at the fixing-side end portion 108*a* of the toner seal member 108 is the rectilinear line. Further, the sealing portions 109*a* and 109*b* for sealing the toner supplying opening 27 are curves each obtained by projecting the correction loss length Lh shown in (a) of FIG. 19 in a vertically symmetrical manner with respect to the longitudinal direction of the sealing portions 109*a* and 109*b*.

The plurality of mounting holes 108*c* includes a mounting hole 108*c*R positioned at an end portion in the driving side shown as the right side of (a) of FIG. 19 with respect to the longitudinal direction of the sealing portion 109, a mounting hole 108*c*C positioned at a longitudinal central portion of the sealing portion 109, and a mounting hole 108*c*L positioned at another end portion in the non-driving side shown as the left side of (a) of FIG. 19 with respect to the longitudinal direction of the sealing portion 109.

The spacing lengths P, with respect to the arrow W direction of (b) of FIG. 19, between the hole center line 108*d* and the sealing portion 109*a* in positions of the respective mounting holes 108*c*R, 108*c*C and 108*c*L on the hole center line 108*d* passing through the centers of the holes are a driving side length P1R, a central portion length P1C and a non-driving side length P1L, respectively.

Similarly, the spacing lengths P, with respect to the arrow W direction of (b) of FIG. 19, between the hole center line 108*d* and the sealing portion 109*b* in the above-described positions are a driving side length P2R (for 108*c*R), a central portion length P2C (for 108*c*C) and a non-driving side length P2L (for 108*c*L).

When the driving side length P1R shown in the right side of (b) of FIG. 19 is taken as a reference length, the central portion length P1C is shorten (than the non-driving side length P1R) by $\{\alpha+(\gamma/2)\}$. Similarly, when the driving side length P1R is taken as the reference length, the non-driving side length P1L is shorter than the driving side length P1R by $(\beta-\gamma)$. Also a relationship between driving side length P2R, the central portion length P2C and the non-driving side length P2L is similar to that described above. The fixing-side end portion 108*a* of the toner seal member 108 is spaced (offset) from the hole center line 108*d*.

When the toner seal member 108 is wound up by the rotatable member 101, as shown in (a) of FIG. 19, it is possible to pull and peel the sealing portions 109*a* and 109*b* from the driving side, where the additional loss length La is small, toward the non-driving side where the additional loss length La is large.

Incidentally, similarly as in the above-described embodiments, when the maximum additional loss length Lamax is "γ" and the maximum torsion loss length Ltmax is "γ", these loss lengths may also be set to provide a relationship of the following formula 34.

$$\gamma=\beta$$

$$\gamma>\beta \quad \text{(formula 34)}$$

Other constituent elements are the same as those in the above-described embodiments, and a similar effect can be obtained.

Embodiment 8

Next, with reference to (c) of FIG. 19, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In Embodiment 7, as shown in (a) of FIG. 19, the additional loss length La was the rectilinear line continuously increasing from the non-driving side toward the driving side.

In this embodiment, similarly as in the constitution shown in FIG. 16, the additional loss length La is the rectilinear line continuously increasing from the driving side toward the non-driving side. As a result, similarly as in the constitution shown in FIG. 16, the correction loss length Lh can be represented by the rectilinear line. In this case, as shown in (c) of FIG. 19, the sealing portions 109*a* and 109*b* are rectilinear lines each inclined with respect to the longitudinal direction of the toner seal member 108.

In this embodiment, as shown in (c) of FIG. 19, the toner supplying opening 27 as the opening is sealed with the sealing portion 109 of the toner seal member 108, and then a region from the sealing portion 109 to the hole center line 108*d* passing through the centers of the mounting holes 108*c* as the mounting portion is made flat. In that state, the direction (longitudinal direction) of the hole center line 108*d* passing through the centers of the mounting holes 108*c* as the mounting portion is substantially parallel to the rotation shaft 101*g* of the rotatable member 101. Further, with respect to the rotation shaft 101*g* of the rotatable member 101, the longitudinal direction of the sealing portions 109*a* and 109*b* is disposed so as to be inclined downward from the left side to the right side of (c) of FIG. 19.

As a result, the spacing length P between the hole center line 108*d* and the sealing portions 109*a* and 109*b* of the toner seal member 108 with respect to the direction crossing the longitudinal direction of the cartridge 302 (i.e., with respect to the arrow W direction of (c) of FIG. 19) is different between the longitudinal end portion and the longitudinal central portion.

Incidentally, a geometrical tolerance value of parallelism between the longitudinal direction of the hole center line 108*d* and the rotation shaft 101*g* of the rotatable member 101 is approximately 5 mm. Other constituent elements are the same as those in the above-described embodiments, and a similar effect can be obtained.

Embodiment 9

Next, with reference to (a) and (b) of FIG. 20, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

<Constitution for Unsealing Sealing Portion in One Direction from Non-Driving Side>

With reference to (a) and (b) of FIG. 20, a constitution for unsealing a sealing portion 110 of the toner seal member 108 in one direction of the longitudinal direction from the non-driving side will be described.

Part (a) of FIG. 20 is a graph showing a relationship the longitudinal position and the winding-up loss length of the toner seal member 108 influenced by flexure V and the torsion Y of the rotatable member 101.

Part (b) of FIG. 20 is a schematic view for illustrating a positional relationship between the sealing portion 110 and the toner seal member 108 capable of unsealing the sealing portion 110 of the toner seal member 108 in one longitudinal direction of the direction of the rotation shaft 101*g* of the rotatable member 101 while being subjected to the influence of the flexure V and the torsion Y of the rotatable member 101.

Also in this embodiment, as shown in (b) of FIG. 20, the toner supplying opening 27 as the opening is sealed with the sealing portion 110 of the toner seal member 108, and then a region from the sealing portion 110 to the hole center line 108*d* passing through the centers of the mounting holes 108*c* as the mounting portion is made flat. In that state, the direction (longitudinal direction) of the hole center line 108*d* passing through the centers of the mounting holes 108*c* as the mounting portion is substantially parallel to the rotation shaft 101*g* of the rotatable member 101, and the longitudinal direction of sealing portions 110*a* and 110*b* is disposed so as to be curved downward in (b) of FIG. 20.

As a result, the spacing length P between the hole center line 108*d* and the sealing portions 110*a* and 110*b* of the toner seal member 108 with respect to the direction crossing the longitudinal direction of the cartridge 302 (i.e., with respect to the arrow W direction of (b) of FIG. 20) is different between the longitudinal end portion and the longitudinal central portion.

Incidentally, a geometrical tolerance value of parallelism between the longitudinal direction of the hole center line 108*d* and the rotation shaft 101*g* of the rotatable member 101 is approximately 5 mm.

In (a) of FIG. 20, the additional loss length La is a rectilinear line continuously increasing from the non-driving side toward the driving side.

When a maximum additional loss length Lamax in the driving side is taken as "γ" and a maximum torsion loss length Ltmax is taken as "β", these loss lengths are set to satisfy a relationship of the following formula 35.

$$\gamma<\beta \qquad \text{(formula 35)}$$

In (a) of FIG. 20, the sum of the composite loss cancel length Lk and the additional loss length La is represented by a correction loss length Lh.

Part (b) of FIG. 20 shows the toner seal member 108 in which the correction loss length Lh is reflected in the sealing portion 110 for sealing the toner supplying opening 27 as the opening.

The hole center line 108*d* consisting of the line connecting the centers of the plurality of mounting holes 108*c* as the mounting portion disposed continuously at a predetermined pitch at the fixing-side end portion 108*a* of the toner seal member 108 is the rectilinear line. The sealing portions 110*a* and 110*b* are curves each obtained by projecting the correction loss length Lh shown in (a) of FIG. 20 in a vertically symmetrical manner with respect to the longitudinal direction of the sealing portions 110*a* and 110*b*.

The plurality of mounting holes 108*c* includes a mounting hole 108*c*R positioned at an end portion in the driving side shown as the right side of (a) of FIG. 20 with respect to the longitudinal direction of the sealing portion 110, a mounting hole 108*c*C positioned at a longitudinal central portion of the sealing portion 110, and a mounting hole 108*c*L positioned at another end portion in the non-driving side shown as the left side of (a) of FIG. 20 with respect to the longitudinal direction of the sealing portion 110.

The spacing lengths P, with respect to the arrow W direction of (b) of FIG. 20, between the hole center line 108*d* and the sealing portion 110*a* in positions of the respective mounting holes 108*c*R, 108*c*C and 108*c*L on the hole center line 108*d* passing through the centers of the holes are a driving side length P1R, a central portion length P1C and a non-driving side length P1L, respectively.

Similarly, the spacing lengths P, with respect to the arrow W direction of (b) of FIG. 20, between the hole center line 108*d* and the sealing portion 110*b* in the above-described positions are a driving side length P2R (for 108*c*R), a central portion length P2C (for 108*c*C) and a non-driving side length P2L (for 108*c*L).

When the non-driving side length P1L shown in the left side of (b) of FIG. 20 is taken as a reference length, the central portion length P1C is shorten (than the non-driving side length P1L) by $\{\alpha-(\gamma/2)\}$. Similarly, when the non-driving side length P1L is taken as the reference length, the driving side length P1R shown in the right side of (b) of FIG. 20 is longer than the non-driving side length P1L by $(\beta+\gamma)$. Also a relationship between driving side length P2R, the central portion length P2C and the non-driving side length P2L is similar to that described above. Incidentally, the fixing-side end portion 108*a* of the toner seal member 108 is parallel to the hole center line 108*d*.

When the toner seal member 108 shown in (b) of FIG. 20 is wound up by the rotatable member 101, it is possible to pull and peel the sealing portions 110*a* and 110*b* from the non-driving side, where the additional loss length La is small, toward the driving side where the additional loss length La is large.

Incidentally, similarly as in the above-described embodiments, when the maximum additional loss length Lmax is "γ" and the maximum torsion loss length Ltmax is "β", these loss lengths may also be set to provide a relationship of the following formula 36.

$$\gamma=\beta$$

$$\gamma>\beta \qquad \text{(formula 36)}$$

According to this embodiment, even in the case where the flexure V and the torsion Y are generated in the rotatable member 101, the additional loss length La continuously increasing from the driving side toward the non-driving side is added to the relationship of the spacing length P capable of canceling the influence of the flexure V and the torsion Y. Alternatively, the additional loss length La continuously increasing from the non-driving side toward the driving side as shown in (b) of FIG. 20 is added.

As a result, it is possible to pull and peel the toner seal member 108 from the driving side toward the non-driving side in one direction of the direction of the rotation shaft 101*g* of the rotatable member 101. Alternatively, it is possible to pull and peel the toner seal member 108, in one direction from the non-driving side toward the driving side.

As a result, an automatic winding-up load of the toner seal member 108 can be reduced. Consequently, it is possible to downsize a motor for rotationally driving the rotatable member 101 and a driving system and to employ an inexpensive material. As a result, the image forming apparatus 301 can be decreased in size and cost. Other constituent elements are the same as those in the above-described embodiments, and a similar effect can be obtained.

Embodiment 10

Next, with reference to (c) of FIG. 20, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In Embodiment 9, as shown in (a) of FIG. 19, the additional loss length La was the rectilinear line continuously increasing from the driving side toward the non-driving side.

In this embodiment, as shown in FIG. 16, the additional loss length La is the rectilinear line continuously increasing from the non-driving side toward the driving side. As a result, the correction loss length Lh can be represented by the rectilinear line. In this case, as shown in (c) of FIG. 20, the sealing portions 110*a* and 110*b* of the toner seal member 108 are rectilinear lines each inclined upward with respect to the hole center line 108*d*, from the left side toward the right side of (c) of FIG. 20.

In this embodiment, as shown in (c) of FIG. 20, the toner supplying opening 27 as the opening is sealed with the sealing portion 110 of the toner seal member 108, and then a region from the sealing portion 110 to the hole center line 108*d* passing through the centers of the mounting holes 108*c* as the mounting portion is made flat. In that state, the direction (longitudinal direction) of the hole center line 108*d* passing through the centers of the mounting holes 108*c* as the mounting portion is substantially parallel to the rotation shaft 101*g* of the rotatable member 101. Further, with respect to the rotation shaft 101*g* of the rotatable member 101, the longitudinal direction of the sealing portions 110*a* and 110*b* is disposed so as to be inclined upward from the left side to the right side of (c) of FIG. 20.

As a result, the spacing length P between the hole center line 108*d* and the sealing portions 110*a* and 110*b* of the toner seal member 108 with respect to the direction crossing the longitudinal direction of the cartridge 302 (i.e., with respect to the arrow W direction of (c) of FIG. 20) is different between the longitudinal end portion and the longitudinal central portion.

Incidentally, a geometrical tolerance value of parallelism between the longitudinal direction of the hole center line 108*d* and the rotation shaft 101*g* of the rotatable member 101 is approximately 5 mm. Other constituent elements are the same as those in the above-described embodiments, and a similar effect can be obtained.

Incidentally, as another constitution, the toner supplying opening 27 as the opening is sealed with the sealing portion 110 of the toner seal member 108, and then a region from the sealing portion 110 to the hole center line 108*d* passing through the centers of the mounting holes 108*c* as the mounting portion is made flat. In that state, the direction (longitudinal direction) of the hole center line 108*d* passing through the centers of the mounting holes 108*c* as the mounting portion is, e.g., inclined downward, with respect to the rotation shaft 101*g* of the rotatable member 101, from the left side toward the right side of (c) of FIG. 20. Further, with respect to the rotation shaft 101*g* of the rotatable member 101, the longitudinal direction of the sealing portions 110*a* and 110*b* is also disposed so as to be inclined upward from the left side to the right side of (c) of FIG. 20 in some cases.

Further, in some cases, even when the inclination directions of the longitudinal directions of the sealing portions 110 and 110*b* with respect to the direction (longitudinal direction) of the hole center line 108*d* are the same, inclination angles of the longitudinal directions of the sealing portions 110 and 110*b* are different from each other.

As a result, the spacing length P between the hole center line 108*d* and the sealing portions 110*a* and 110*b* of the toner seal member 108 with respect to the direction crossing the longitudinal direction of the cartridge 302 (i.e., with respect to the arrow W direction of (c) of FIG. 20) is different between the longitudinal end portion and the longitudinal central portion.

Embodiment 11

Next, with reference to (a) and (b) of FIG. 20, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In the above-described embodiments, the correction loss length Lh was reflected in the hole center lines 104*d* to 106*d* of the toner seal members 104 to 106. Further, the spacing length P with respect to the winding-up direction (arrow W direction) of the toner seal members 104 to 106 wound up by the rotatable member 101 was changed with respect to the direction of the rotation shaft 101*g* of the rotatable member 101.

The spacing length P is the length between the sealing portions 24*a* and 24*b* and the hole center lines 104*d* to 106*d* of the toner seal members 104 to 106.

Further, the correction loss length Lh was reflected in the sealing portions 109*a*, 109*b*, 110*a* and 110*b*. Further, the spacing length P with respect to the winding-up direction (arrow W direction) of the toner seal member 108 wound up by the rotatable member 101 was changed with respect to the direction of the rotation shaft 101*g* of the rotatable member 101.

The spacing length P is the length between the hole center line 108*d* of the toner seal member 108 and the sealing portions 109*a*, 109*b*, 110*a* and 110*b*.

Further, the correction loss length Lh was reflected in the sealing portions 109*a*, 109*b*, 110*a* and 110*b*.

As a result, even in the case where the flexure V and the torsion Y are generated in the rotatable member 101, the toner seal members 104 to 106 were peelable in one direction from the end side toward another end side with respect to the direction of the rotation shaft 101*g* of the rotatable member 101. This effect was described.

In this embodiment, with respect to the spacing length P, a hole center line 111*d* consisting of a line connecting centers of a plurality of mounting holes 111*c* as a mounting portion disposed continuously at a predetermined pitch at a fixing-side end portion 111*a* of a toner seal member 111 is considered. Further, a spacing distance between the hole center line 111*d* and sealing portions 112*a* and 112*b* with respect to an arrow W direction of (b) of FIG. 21 is the spacing length P.

Accordingly, the correction loss length Lh shown in (a) of FIG. 21 may also be reflected in the hole center line 111*d* and the sealing portions 112*a* and 112*b* in a division manner.

With reference to (a) and (b) of FIG. 21, an example of the toner seal member 111 in which the correction loss length Lh is reflected in the hole center line 111*d* and the sealing portions 112*a* and 112*b* in the division manner will be described.

Part (a) of FIG. 21 is a graph showing a relationship the longitudinal position and the winding-up loss length of the toner seal member 111 under the influence of flexure V and the torsion Y of the rotatable member 101.

Part (b) of FIG. 21 is a schematic view showing a positional relationship between the sealing portions 112*a* and 112*b* and the toner seal member 111 capable of unsealing the sealing portion 110 of the toner seal member 108 in one longitudinal direction of the direction of the rotation shaft 101*g* of the rotatable member 101 while being subjected to the influence of the flexure V and the torsion Y generated in the rotatable member 101.

In this embodiment, as shown in (b) of FIG. 21, the toner supplying opening 27 as the opening is sealed with the sealing portion 112 of the toner seal member 111, and then a region from the sealing portion 112 to the hole center line 111*d* passing through the centers of the mounting holes 111*c* as the mounting portion is made flat. In that state, the direction (longitudinal direction) of the hole center line 108*d* passing through the centers of the mounting holes 108*c* as the mounting portion is inclined upward, the rotation shaft 101*g* of the rotatable member 101, from the left side toward the right side of (b) of FIG. 21. Further, the longitudinal direction of sealing portions 112*a* and 112*b* is disposed so as to be curved downward in (b) of FIG. 21.

As a result, the spacing length P between the hole center line 111*d* and the sealing portions 112*a* and 112*b* of the toner seal member 111 with respect to the direction crossing the longitudinal direction of the cartridge 302 (i.e., with respect to the arrow W direction of (b) of FIG. 21) is different between the longitudinal end portion and the longitudinal central portion.

As shown in (a) of FIG. 21, the additional loss length La is a rectilinear line continuously increasing from the driving side toward the non-driving side.

When a maximum additional loss length Lamax in the driving side shown as the left side of (a) of FIG. 21 is taken as "γ" and a maximum torsion loss length Ltmax is taken as "β", these loss lengths are set to satisfy a relationship of the following formula 37.

$$\gamma<\beta \quad \text{(formula 37)}$$

Incidentally, in (a) of FIG. 21, the sum of the composite loss cancel length Lk and the additional loss length La is represented by a correction loss length Lh.

Part (b) of FIG. 21 shows the toner seal member 111 in which the correction loss length Lh is reflected in the hole center line 111*d* and the sealing portions 112*a* and 112*b* in the division manner.

The plurality of mounting holes 111*c* includes a mounting hole 111*c*R positioned at an end portion in the driving side shown as the right side of (a) of FIG. 21 with respect to the longitudinal direction of the sealing portion 112, a mounting hole 111*c*C positioned at a longitudinal central portion of the sealing portion 112, and a mounting hole 111*c*L positioned at another end portion in the non-driving side shown as the left side of (a) of FIG. 21 with respect to the longitudinal direction of the sealing portion 112.

The spacing lengths P, with respect to the arrow W direction of (b) of FIG. 21, between the hole center line 111*d* and the sealing portion 112*a* in positions of the respective mounting holes 111*c*R, 111*c*C and 111*c*L on the hole center line 111*d* passing through the centers of the holes are a driving side length P1R, a central portion length P1C and a non-driving side length P1L, respectively.

Similarly, the spacing lengths P, with respect to the arrow W direction of (b) of FIG. 21, between the hole center line 111*d* and the sealing portion 112*b* in the above-described positions are a driving side length P2R (for 111*c*R), a central portion length P2C (for 111*c*C) and a non-driving side length P2L (for 111*c*L).

On the correction loss length Lh shown in (a) of FIG. 21, the additional loss length a is allocated to and reflected in the hole center line 111*d*, and the composite loss cancel length Lk is allocated to and reflected in the sealing portions 112*a* and 112*b*.

The hole center line 111*d* is a rectilinear line along which the spacing length P is continuously increased, on the basis of the mounting hole 111*c*R in the driving side shown as the right side of (b) of FIG. 21, toward the non-driving side shown as the left side of (b) of FIG. 21.

On the other hand, each of the sealing portions 112*a* and 112*b* is curved line obtained by projecting the correction loss length Lh shown in (a) of FIG. 21 in a vertically symmetrical manner with respect to the direction of the rotation shaft 101*g* of the rotatable member 101.

When the driving side length P1R shown in the right side of (b) of FIG. 21 is taken as a reference length, the central portion length P1C is shorter (than the driving side length 1PR), at the sealing portion 112*a*, by $\{\alpha+(\beta/2)\}$. Further, at the hole center line 111*d*, the central portion length P1C is longer by $(\gamma/2)$. Therefore, when these values of the differences are added up, the central portion length P1C is shorter than the driving side length P1R by $\{\alpha+(\beta/2)-(\gamma/2)\}$.

Similarly, when the driving side length P1R shown in the right side of (b) of FIG. 21 is taken as a reference length, the non-driving side length P1L is shorter (than the driving side length 1PR), at the sealing portion 112*a*, by 13. Further, at the hole center line 111*d*, the central portion length P1C is longer by $\gamma$. Therefore, when these values of the differences are added up, the non-driving side P1L is shorter than the driving side length P1R by $\beta-\gamma$.

Further, also a relationship between the driving side length P2R, the central portion length P2C and the non-driving side length P2L is similar to that described above.

These are naturally the same as results that the correction loss length Lh is reflected in the hole center line 111*d* or the sealing portions 112*a* and 112*b*. For that reason, it is possible to pull and peel the sealing portions 112*a* and 112*b* in one direction from the driving side shown as the right side of (b) of FIG. 21 toward the non-driving side shown as the left side of (b) of FIG. 21.

In this embodiment, of the correction loss length Lh shown in (a) of FIG. 21, the additional loss length La is allocated to and reflected in the hole center line 111*d*, and the composite loss cancel length Lk is allocated to and reflected in the sealing portions 112*a* and 112*b*, but the present invention is not limited thereto.

That is, the sum of the lengths allocated to the hole center line 111*d* and the sealing portions 112*a* and 112*b* may only be required to be equal to the correction loss length Lh.

Further, in this embodiment, a constitution in which the sealing portions 112*a* and 112*b* are pulled and peeled in one direction from the driving side shown as the right side of (b) of FIG. 21 toward the non-driving side shown as the left side of (b) of FIG. 21 was employed. However, the present invention is not limited thereto.

When the additional loss length La is continuously increased from the non-driving side toward the driving side and the sum of the lengths allocated to the hole center line 118*d* and the sealing portions 112*a* and 112*b* is equal to the correction loss length Lh, it is also possible to pull and peel the sealing portions 112*a* and 112*b* in one direction from the non-driving side toward the driving side.

According to this embodiment, even in the case where the flexure V and the torsion Y are generated in the rotatable member 101, the additional loss length La continuously increasing from the end side toward anther end side with respect to the rotation shaft 101*g* of the rotatable member 101 is added to the relationship of the spacing length P capable of canceling the influence of the flexure V and the torsion Y.

As a result, it is possible to pull and peel the sealing portions 112*a* and 112*b* of the toner seal member 111 from the end side toward another end side in one direction of the direction of the rotation shaft 101*g* of the rotatable member 101.

As a result, an automatic winding-up load of the toner seal member 111 can be reduced. Consequently, it is possible to downsize a motor for rotationally driving the rotatable member 101 and a driving system. Further, it is possible to employ an inexpensive material, with the result that the image forming apparatus 301 can be decreased in size and cost.

Further, the correction loss length Lh which the sum of the composite loss cancel lengths Lk and the additional loss length La is allocated to and reflected in the sealing portions 112*a* and 112*b* and the hole center line 111*d*. As a result, space efficiency of the toner seal member 111 is improved. Further, it is possible to reduce an automatic winding up load of the toner seal member 111. Other constituent elements are the same as those in the above-described embodiments, and a similar effect can be obtained.

Incidentally, as another constitution, the toner supplying opening 27 as the opening is sealed with the sealing portion 112 of the toner seal member 111 passing through the centers of the mounting holes 111 as the mounting portion is made flat. In that state, the direction (longitudinal direction) of the hole center line 111*d* passing through the centers of the mounting holes 111*c* as the mounting portion is, e.g., curved upward in (b) of FIG. 21 with respect to the rotation shaft 101*g* of the rotatable member 101. Further, the longitudinal direction of the sealing portion 112*a* and 112*b* is also disposed so as to be curved downward in (b) of FIG. 21 in some cases.

As a result, the spacing length P between the hole center line 111*d* and the sealing portions 112*a* and 112*b* of the toner seal member 111 with respect to the direction crossing the longitudinal direction of the cartridge 302 (i.e., with respect to the arrow W direction of (b) f FIG. 21) is different between the longitudinal end portion and the longitudinal central portion.

Embodiment 12

Next, with reference to FIG. 22, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In this embodiment, as shown in FIG. 22, the toner supplying opening 137 is sealed with the sealing portion 112 of the toner seal member 111. Then, a region from the sealing portion 112 to the mounting holes 111*c* as the mounting portion is placed in a flat state. In that state, with respect to the rotation shaft 101*g* of the rotatable member 101, the longitudinal direction of the sealing portion 112 is disposed so as to be inclined downward from the left side toward the right side of FIG. 22. Further, the longitudinal direction of the hole center line 111*d* passing through the centers of the plurality of mounting holes 111*c* as the mounting portion is disposed so as to be curved upward in FIG. 22. Such an example is shown in FIG. 22.

Also, in the example, the correction loss length Lh is allocated to and reflected in the hole center line 111*d* and the sealing portions 112*a* and 112*b*.

As a result, the spacing length P between the hole center line 111*d* and the sealing portions 112*a* and 112*b* of the toner seal member 111 with respect to the direction crossing (perpendicular to) the longitudinal direction of the cartridge 302 (i.e., with respect to the arrow W direction of FIG. 22) is different between the longitudinal end portion and the longitudinal central portion.

The plurality of mounting holes 111*c* includes a mounting hole 111*c*R positioned at an end portion in the driving side shown as the right side of (a) of FIG. 22 with respect to the longitudinal direction of the sealing portion 112, a mounting hole 111*c*C positioned at a longitudinal central portion of the sealing portion 112, and a mounting hole 111*c*L positioned at another end portion in the non-driving side shown as the left side of FIG. 22 with respect to the longitudinal direction of the sealing portion 112.

The spacing lengths P, with respect to the arrow W direction of (b) of FIG. 22, between the hole center line 111*d* and the sealing portion 112*a* in positions of the respective mounting holes 111*c*R, 111*c*C and 111*c*L on the hole center line 111*d* passing through the centers of the holes are a driving side length P1R, a central portion length P1C and a non-driving side length P1L, respectively.

Similarly, the spacing lengths P, with respect to the arrow W direction of (b) of FIG. 22, between the hole center line 111*d* and the sealing portion 111*b* in the above-described positions are a driving side length P2R (for 111*c*R), a central portion length P2C (for 111*c*C) and a non-driving side length P2L (for 111*c*L).

On the correction loss length Lh shown in (a) of FIG. 21, the composite loss cancel length Lk is allocated to and reflected in the hole center line 111*d*, and the additional loss length La is allocated to and reflected in the sealing portions 112*a* and 112*b*.

The hole center line 111*d* is a curved line obtained by projecting the correction loss length Lh shown in (a) of FIG. 21.

On the other hand, each of the sealing portions 112*a* and 112*b* is a rectilinear line obtained by projecting the additional loss length La shown in (a) of FIG. 21 in a bilaterally symmetrical manner so that the longitudinal direction thereof is inclined downward from the left side, toward the right side of FIG. 22.

When the driving side length P1R shown in the right side of FIG. 22 is taken as a reference length, the central portion length P1C is shorter (than the driving side length 1PR), at the hole center line 111*d*, by $\{\alpha+(\beta/2)\}$. Further, at the sealing portion 112*a*, the central portion length P1C is longer by $(\gamma/2)$. Therefore, when these values of the differences are added up, the central portion length P1C is shorter than the driving side length P1R by $\{\alpha+(\beta/2)-(\gamma/2)\}$.

Similarly, when the driving side length P1R shown in the right side of FIG. 22 is taken as a reference length, the non-driving side length P1L is shorter (than the driving side length 1PR), at the hole center line 111*d*, by $\beta$. Further, at the sealing portion 112*a*, the central portion length P1C is longer by $\gamma$. Therefore, when these values of the differences are added up, the non-driving side P1L is shorter than the driving side length P1R by $\beta-\gamma$.

Further, also a relationship between the driving side length P2R, the central portion length P2C and the non-driving side length P2L is similar to that described above.

These are naturally the same as results that the correction loss length Lh is reflected in the hole center line 111*d* or the sealing portions 112*a* and 112*b*. For that reason, it is possible to pull and peel the sealing portions 112*a* and 112*b* in one direction from the driving side shown as the right side of FIG. 22 toward the non-driving side shown as the left side of FIG. 22.

According to this embodiment, even in the case where the flexure V and the torsion Y are generated in the rotatable member 101, the additional loss length La continuously increasing from the end side toward anther end side with respect to the rotation shaft 101*g* of the rotatable member 101 is added to the relationship of the spacing length P capable of canceling the influence of the flexure V and the torsion Y.

As a result, it is possible to pull and peel the sealing portions 112*a* and 112*b* of the toner seal member 111 from the end side toward another end side in one direction of the direction of the rotation shaft 101*g* of the rotatable member 101.

As a result, an automatic winding-up load of the toner seal member 111 can be reduced. Consequently, it is possible to downsize a motor for rotationally driving the rotatable member 101 and a driving system. Further, it is possible to employ an inexpensive material, with the result that the image forming apparatus 301 can be decreased in size and cost.

Further, the correction loss length Lh which the sum of the composite loss cancel lengths Lk and the additional loss length La is allocated to and reflected in the sealing portions 112*a* and 112*b* and the hole center line 111*d*. As a result, space efficiency of the toner seal member 111 is improved. Further, it is possible to reduce an automatic winding up load of the toner seal member 111. Other constituent elements are the same as those in the above-described embodiments, and a similar effect can be obtained.

Embodiment 13

Next, with reference to FIG. 23, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In the above-described embodiments, as shown in FIG. 8, as a member to be welded for the toner seal members 52, 102, 104 to 108 and 111, the developing container 23 which constitutes the frame and which has rigidity is considered. Further, the constitution in which the toner supplying opening 27 provided in the developing container 23 was unsealably sealed with the sealing portions 24, 109 and 110 of the toner seal members 52, 102, 104 to 108 and 111 was described.

In this embodiment, as shown in FIG. 23, the toner 2 is accommodated in a flexible container 138 as a flexible member formed of a flexible material, and the flexible container 138 is supported inside the developing container 23. The flexible container 138 is provided with a toner supplying opening 137 as the opening. At another peripheral edge of the toner supplying opening 137 of the flexible container 138, a sealing portion 136 for unsealably sealing the toner supplying opening 137 is provided by being welded in a peelable manner.

The flexible container is constituted by bonding, through (thermal) welding or the like, a container portion 138*a* having flexibility and a cap member 138*b* having flexibility and air-permeability.

Also in this embodiment, a constitution in which the sealing portions 136 (136*a* to 136*d*) of the toner seal member 132 are peeled from one direction of the direction of a rotation shaft 45*e* of a rotatable member 45 can be constituted similarly as in the above-described embodiments.

As a result, a load for peeling off the toner seal member 132 can lowered. Other constituent elements are the same as those in the above-described embodiments, and a similar effect can be obtained.

Embodiment 14

Next, with reference to (a) of FIG. 24, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

Part (a) of FIG. 24 is a schematic view for illustrating a positional relationship between a toner seal member 113 and a sealing portion 24.

In the above-described embodiments, a constitution in which the spacing length P with respect to the winding-up direction f the toner seal members 52, 102, 104 to 108, 111 and 132 was changed to enable unsealing of the toner seal members in one direction from the driving side toward the non-driving side or from the non-driving side toward the driving side was employed.

The spacing length P is the length between the hole center lines 52*d*, 102*d*, 104*d* to 108*d* and 111*d* of the toner seal members 52, 102, 104 to 108, 111 and 132 and the associated sealing portions 24*a*, 24*b*, 112*a* and 112*b*.

For example, as shown in FIG. 2, after the toner supplying opening 27 is unsealed, the toner seal member 52 is rotated around the rotation shaft 45*e* of the rotatable member 45. The toner 2 is principally fed to the toner supplying chamber 28 by the feeding sheet 44 shown in FIG. 2, but also the toner seal member 52 contributes not a little to the feeding of the toner 2.

As shown in (c) of FIG. 8, in the case where the open-side end portion 52*b* of the toner seal member 52 and the hole center line 52*d* are not parallel to each other, the rotation radius of the end portion 52*b* is different with respect to the direction of the rotation shaft 45*e* of the rotatable member 45. For this reason, there is a possibility that the supply of the toner 2 is localized with respect to the longitudinal direction of the toner seal member 52.

For that reason, in this embodiment, as shown in (a) of FIG. 24, a longitudinal direction (left-right direction of (a) of FIG. 24) of an end portion 113*b* as an open-side end portion with respect to the winding-up direction of the toner seal member 113 to be wound up by the rotatable member 45 is considered. Further, a hole center line 113*d* consisting of a line connecting centers of a plurality of mounting holes 113*c* disposed continuously at a predetermined pitch at a fixing-side end portion 113*a* as the mounting portion provided in an end side of the toner seal member 113 connected with the rotatable member 45 is considered.

Further, the longitudinal direction of the end portion 113*b* and the hole center line 113*d* are disposed substantially parallel to each other. Incidentally, a geometrical tolerance value of parallelism between the longitudinal direction of the end portion 113*b* and the hole center line 113*d* is approximately 5 mm.

As a result, a spacing distance P3 between the hole center line 113*d* and the end portion 113*b* with respect to the rotational direction of the rotatable member 45 becomes constant. For this reason, the rotation radius of the end portion 113*b* of the toner seal member 113 is equalized with respect to the direction of the rotation shaft 45*e* of the rotatable member 45. As a result, it is possible to alleviate a degree of localizing of supply of the toner 2 with respect to the longitudinal direction of the toner seal member 113. Other constituent elements are the same as those in the above-described embodiments, and a similar effect can be obtained.

Embodiment 15

Next, with reference to (b) of FIG. 24, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

As shown in (c) of FIG. 8, there is the case where a side end portion 52*f* of the toner seal member 52 in the non-driving side shown as the left side of (c) of FIG. 8 and a side fixing portion 52*g* in the driving side shown as the right side of (c) of FIG. 8 are not perpendicular to the hole center line 52*d*. Also in that case, there is a possibility that a feeding force of the toner 2 is different with respect to the longitudinal direction (left-right direction of (c) of FIG. 8) of the toner seal member 52.

For that reason, in this embodiment, as shown in (b) of FIG. 24, side end portions 114*a* and 114*b* provided along the winding-up direction of a toner seal member 114 to be wound up by the rotatable member 45 is considered. Further, a hole center line 114*d* consisting of a line connecting centers of a plurality of mounting holes 114*c* disposed continuously at a predetermined pitch at a fixing-side end portion 114*a* as the mounting portion provided in an end side of the toner seal member 114 connected with the rotatable member 45 is considered.

Further, the side end portions 114*f* and 114*g* and the hole center line 114*d* are disposed substantially perpendicular to substantially parallel to each other. Incidentally, a geometrical tolerance value of parallelism between the side end portions 114*b* and 114*g* and the hole center line 114*d* is approximately 5 mm.

As shown in (b) of FIG. 24, an angle formed between the hole center line 14*d* and the side end portion 114*f* is Z1.

Further, an angle formed between the hole center line 114*d* and the side end portion 114*g* is Z2.

By setting the angles Z1 and Z2 at about 90 degrees, the side end portions 114*f* and 114*g* as longitudinal end surfaces of the toner seal member 114 are parallel to each other, and therefore it is possible to alleviate a difference in feeding force of the toner 2 between the longitudinal end portions of the toner seal member 114. As a result, the sealing portion 24 of the toner seal member 104 can be unsealed with respect to one direction of the longitudinal direction of the rotatable member 101 while being subjected to the influence of the flexure V and the torsion Y of the rotatable member 101. Other constituent elements are the same as those in the above-described embodiments, and a similar effect can be obtained.

Embodiment 16

Next, with reference to FIG. 25, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

<Structure of Develop Bag>

With reference to FIG. 26, a structure and an unsealing operation of a developer bag 216 which is provided with an opening 216*c* as the opening and which constitutes a flexible member for forming a toner chamber for accommodating the toner 2 will be described.

FIG. 25 shows the developer bag 216. FIG. 25 further shows a sealing portion 219*b*, extending in the longitudinal direction of the cartridge 302, for unsealably sealing the opening 216*c* provided in the developer bag 216. Further, FIG. 25 shows a toner seal member 219 including a fixing portion 219*b* as the mounting portion mounted on a rotatable member 220 as the unsealing member for unsealing the opening 216*c*. The rotatable member 220 is supported rotatably about a rotation shaft 220*a*, and winds up the toner seal member 219 to unseal the opening 216*e*.

The developing bag 216 includes a toner discharging portion 216*b* for permitting discharge of the toner 2 therein. Further, the toner discharging portion 216*b* includes the opening 216*c* consisting of a plurality of through holes extending in an arrow F direction of FIG. 25 substantially perpendicular to an arrow M direction of FIG. 25 in which the unsealing advances, and includes a plurality of connecting portions 216*g* each provided between the adjacent openings 216*c*.

The toner seal member 219 is fixed, as shown in FIG. 25, on the rotatable member 220 in a state in which the toner seal member 219 is folded back from the sealing portion 219*a*.

Here, as a sealing method of the sealing portion 219*a* which covers the toner discharging portion 216*b*, it is possible to use thermal welding, ultrasonic welding, bonding, pseudo bonding, clamping using a clip, hooking using a through hole and a projected portion, and the like.

The developer bag 216 is provided with the fixing portion 216*a*. The fixing portion 216*a* is fixed on the frame by using, e.g., a double-side tape, a wedge-shaped member, a hooking member, thermal molding, ultrasonic welding, bonding, and the like.

As shown in FIG. 25, the longitudinal direction of the fixing portion 216*a* of the developer bag 216 and the rotation shaft 220*a* of the rotatable member 220 are disposed substantially parallel to each other. Incidentally, a geometrical tolerance value of parallelism between the longitudinal direction of the fixing portion 216*e* of the developer bag 216 and the rotation shaft 220*a* of the rotatable member 220 is approximately 5 mm.

In this embodiment, as a material for the toner seal member 219, a laminate material having a special sealant layer which exhibits an easy peeling property (easy-to-peel property) is applied. The easy peeling property is such that peeling strength is about 3N/15 mm in testing methods for heat sealed flexible package according to JIS-Z0238. Further, as a material for the developer bag 216, of polyethylene, polypropylene or the like, which is weldable with the special sealant layer is applied, so that the easy peeling property can be exhibited at the peeling portion.

Further, by changing formulation of the special sealant layer and a combination of materials to be bonded to each other, it is possible to decrease the peeling force.

For example, in a state shown in FIG. 25, the rotatable member 220 is rotated in an arrow C direction. Then, the toner seal member 219 is wound up around the outer peripheral surface of the rotatable member 220 to be pulled in an arrow M direction of FIG. 25. As a result, the developer bag 216 and the toner seal member 219 are placed in a state in which a peeling angle indicated by an arrow H direction of FIG. 25 is within a range of 90-180 degrees. The peeling angle indicated by the arrow H direction of FIG. 25 is an angle formed, in cross-section perpendicular to the longitudinal direction of the sealing portion 219*a*, between the developer bag 216 and the winding-up direction (arrow M direction) of the toner seal member 219 when the sealing portion 219*a* is peeled.

A connecting portion 219*c* is folded back in the arrow H direction relative to the sealing portion 219*a* for sealing the toner discharging portion 216*b* of the developer bag and then inclination peeling is made, whereby a peeling force necessary to effect peeling between the sealing portion 219*a* and the developer bag 216 can be reduced.

By devising a shape of the bonding portion between the developer bag 126 and the toner seal member 219 and by using the laminate material having the special sealant layer capable of exhibiting the easy peeling property, the toner discharging portion 216*b* of the developer bag 126 can be unsealed by a small peeling force. Here, the peeling force at the portion to be unsealed is 3N/15 mm.

Embodiment 17

Next, with reference to (a) of FIG. 26, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In Embodiment 16, the rotatable member 220 and the connecting portion 219*c* of the toner seal member 219 are provided over a whole longitudinal region of the sealing portion 219*a*. As a result, a longitudinal length of the sealing portion 219*a* and a longitudinal length of the fixing portion 219*b* were substantially equal to each other. However, the connecting portion 219*c* may also be not provided over the whole longitudinal region of the sealing portion 219*a*.

In this embodiment, the fixing portion 219*b* is disposed only at a part of the sealing portion 219*a* with respect to the longitudinal direction, so that the longitudinal length of the fixing portion 219*b* is longer than the longitudinal length of the sealing portion 219*a*. The longitudinal direction of the fixing portion 219*b* is disposed in a rectilinear line shape while being inclined from the longitudinal direction of the sealing portion 219*b* by a predetermined angle as shown in (c) of FIG. 8 or FIG. 10.

In this embodiment, the mounted on the rotatable member 220 of the toner seal member 219 is the fixing portion 219*b*. Further, a length between the mounting portion and the sealing portion 219*a* of the toner seal member 219 with respect to a direction crossing (perpendicular to) the longitudinal direction of the cartridge 302 is conveniently defined as follows. That is, the length is defined as a length between an edge portion of the sealing portion 219*a* in the fixing portion 219*b* side and an edge portion of the fixing portion 219*b* in the sealing portion 219*b* side.

In this embodiment, at a right-side end portion (an end portion) of (a) of FIG. 29, end portion positions of the sealing portion 219*b* and the fixing portion 219*a* are aligned with each other, and at a left-side end portion (another end portion), a left-side end portion position of the fixing portion 219*a* is disposed toward the central portion than a left-side end portion position of the sealing portion 219*b*.

Parts (a) and (b) of FIG. 26 show a state in which the connecting portion 219*c* of the toner seal member 219 is made flat, and the sealing portion 219*a* and the fixing portion 219*b* during unsealing are disposed so that the longitudinal directions thereof are substantially parallel to each other as shown in FIG. 7. For this reason, a loosening amount of the connecting portion 219*c* is small in the side end portion 219*f* side shown as the right side of (a) and (b) of FIG. 26 and is large in the side end portion 219*g* side shown as the left side of (a) and (b) of FIG. 26.

As a result, as shown in (a) of FIG. 26, a spacing length T1 in the side end portion 219*f* side in which the loosening amount of the connecting portion 219*c* connecting the sealing portion 219*a* and the fixing portion 219*b* of the toner seal member 219 and a spacing length T2 in the side end portion 219*g* side in which the loosening amount is large are different from each other.

Therefore, with respect to the longitudinal direction of the cartridge 302, a length between an edge portion of the sealing portion 219*a* at the end portion closer to the fixing portion 219*b* and an edge portion of the fixing portion 219*b*, as the mounting portion in the same side as the end portion of the sealing portion 219*a*, at the end portion closer to the sealing portion 219*a*, i.e., a length between closer end portions, is considered. Similarly, a length between an edge portion of the sealing portion 219*a* at another end portion, opposing another edge portion of the fixing portion 219*b*, and another edge portion of the fixing portion 219*b*, opposing another edge portion of the sealing portion 219*a*, i.e., a length position remoter end portions, is considered. Thus, the length between closer end portions and the length between closer end portions are different from each other.

By employing such a constitution, even in the case where the toner seal member 219 is fixed at a part of the sealing portion 219*a* with respect to the longitudinal direction, the unsealing of the toner discharging portion 216*b* of the developer bag 216 can be made reliably and stably similarly as in the above-described embodiments. Other constituent elements are the same as those in the above-described embodiments, and a similar effect can be obtained.

Embodiment 18

Next, with reference to (a) of FIG. 26, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In this embodiment, at a left-side end portion of (a) of FIG. 29, end portion positions of the sealing portion 219*b* and the fixing portion 219*a* are aligned with each other, and at a right-side end portion, a right-side end portion position of the fixing portion 219*a* is disposed toward the central portion than a right-side end portion position of the sealing portion 219*b*.

In this case, with respect to the longitudinal direction of the cartridge 302, a length between an edge portion of the sealing portion 219*a* at the end portion closer to the fixing portion 219*b* and an edge portion of the fixing portion 219*b*, as the mounting portion in the same side as the end portion of the sealing portion 219*a*, at the end portion closer to the sealing portion 219*a*, i.e., a length between closer end portions, is considered. Similarly, a length between an edge portion of the sealing portion 219*a* at another end portion, opposing another edge portion of the fixing portion 219*b*, and another edge portion of the fixing portion 219*b*, opposing another edge portion of the sealing portion 219*a*, i.e., a length position remoter end portions, is considered. Thus, the length between closer end portions and the length between closer end portions are different from each other.

Thus, even in the case where the toner seal member 219 is fixed at a part of the sealing portion 219*a* with respect to the longitudinal direction, the unsealing of the toner discharging portion 216*b* of the developer bag 216 can be made reliably and stably similarly as in the above-described embodiments. Other constituent elements are the same as those in the above-described embodiments, and a similar effect can be obtained.

Embodiment 19

Next, with reference to (c) of FIG. 26, an image forming apparatus, in which a process cartridge also functioning as a developing cartridge as the cartridge according to the present invention is provided, in a constitution in this embodiment will be described. Incidentally, constituent elements similar to those in the above-described embodiments described above are represented by the same reference numerals or symbols or represented by the same member names with different numerals or symbols, and will be omitted from description.

In this embodiment, a plurality of fixing portions 219*b* are provided as the mounting portion for the toner seal member 219. In this embodiment, as the fixing portion fixed on the rotatable member 220, the plurality of fixing portions 219*b* is used.

Part (c) of FIG. 26 shows a state in which the connecting portion 219*c* of the toner seal member 219 is made flat, and the sealing portion 219*a* and each of the fixing portions 219*b* during unsealing are disposed so that the longitudinal directions thereof are substantially parallel to each other as shown in FIG. 7. Further, the fixing portions 219*b* are disposed so that longitudinal directions thereof are disposed on the same rectilinear line at the outer peripheral surface of the rotatable member 220. For this reason, a loosening amount of the connecting portion 219*c* is small in the side end portion 219*f* side shown as the right side of (c) of FIG. 26 and is large in the side end portion 219*g* side shown as the left side of (c) of FIG. 26.

A loosening amount of the connecting portion 219*c* corresponding to a portion of the fixing portion 219*b* disposed opposed to the longitudinal central portion of the sealing portion 219*a* in (c) of FIG. 29 is larger than a loosening amount of the connecting portion 219*c* in the side end portion 219*f* side and is smaller than a loosening amount of the connecting portion 219*g* side.

Accordingly, a spacing length T1 in the side end portion 219*f* side in which the loosening amount of the connecting portion 219*c* connecting the sealing portion 219*a* and the fixing portion 219*b* of the toner seal member 219 and a spacing length T2 in the side end portion 219*g* side in which the loosening amount is large are different from each other.

In this case, with respect to the longitudinal direction of the cartridge 302, a length between an edge portion of the sealing portion 219*a* at the end portion closer to the fixing portion 219*b* and an edge portion of the fixing portion 219*b*, as the mounting portion in the same side as the end portion of the sealing portion 219*a*, at the end portion closer to the sealing portion 219*a*, i.e., a length between closer end portions, is considered. Similarly, a length between an edge portion of the sealing portion 219*a* at another end portion, opposing another edge portion of the fixing portion 219*b*, and another edge portion of the fixing portion 219*b*, opposing another edge portion of the sealing portion 219*a*, i.e., a length position remoter end portions, is considered. Thus, the length between closer end portions and the length between closer end portions are different from each other.

By employing such a constitution, even in the case where the toner seal member on the rotatable member 220 by using the rectilinear line of fixing portions 219*b*, the unsealing of the toner discharging portion 216*b* of the developer bag 216 can be made reliably and stably similarly as in the above-described embodiments. Other constituent elements are the same as those in the above-described embodiments, and a similar effect can be obtained.

Incidentally, in the above-described embodiments, a constitution in which the toner seal members 52, 102, 104 to 108, 111, 113, 114, 132 and 219 are wound up by rotation of the rotatable members 45, 101 and 220 as the unsealing member to unseal the opening was employed. As another example, a constitution in which the unsealing member may also be constituted by a moving member for unsealing the opening by being moved. In this case, it is possible to employ a constitution in which the moving member is moved along a guide member. Further, the opening may also be unsealed by moving the position of the rotation shaft while rotating the unsealing member.

Incidentally, in the above-described embodiments, as an example of the cartridge 302 detachably mountable to the main assembly of the image forming apparatus 301, the case where the process cartridge is employed was described.

Further, a constitution in which the process cartridge includes the developing container 23 (developer bag 216), the photosensitive drums 62 and 211 on which the electrostatic latent image is to be formed, and the developing rollers 32 and 213 for supplying the toner 2 from the inside of the developing container 23 (developer bag 216) to the surface of the photosensitive drums 62 and 211 was employed.

Further, a constitution in which the cartridge 302 as the process cartridge is detachably mountable to the image forming apparatus 301, and the image is formed on the sheet 303 was employed.

As another example, a developing cartridge may also be employed as the cartridge detachably mountable to the main assembly of the image forming apparatus 301.

Further, the developing cartridge is constituted by including the developing container 23 (developer bag 216) and the developing rollers 32 and 213 for supplying the toner 2 from the inside of the developing container 23 (developer bag 216) to the surface of the photosensitive drums 62 and 211 on which the electrostatic latent image is to be formed.

Further, a constitution in which the developing cartridge is detachably mountable to the image forming apparatus 301, and the image is formed on the sheet 303 may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 244341/2012 and 215929/2013 filed Nov. 6, 2012 and Oct. 17, 2013, respectively which are hereby incorporated by reference.

What is claimed is:

1. A cartridge comprising:

a toner chamber, provided with an opening, for accommodating a toner;

an unsealing member for unsealing the opening, said unsealing member not being manually operated; and a seal member including (i) a sealing portion, elongated in a longitudinal direction of said cartridge, for unsealably sealing the opening and (ii) a mounting portion for being mounted on said unsealing member to unseal the opening, wherein the sealing portion includes a first sealing portion located at a longitudinal end portion and a second sealing portion located at a longitudinal central portion, and wherein, with respect to an unsealing direction crossing the longitudinal direction, a length between the first sealing portion and the mounting portion of said seal member is shorter than a length between the second sealing portion and the mounting portion.

2. A cartridge according to claim 1, wherein the length between the sealing portion and the mounting portion is shortened from the longitudinal end portion toward the longitudinal central portion.

3. A cartridge according to claim 1, wherein the direction crossing the longitudinal direction is a direction perpendicular to the longitudinal direction.

4. A cartridge according to claim 1, wherein the longitudinal end portion is located in a driving side where a driving force is to be transmitted to the unsealing member or in a non driving side opposite from the driving side.

5. A cartridge according to claim 1, wherein the unsealing member is constituted by a rotatable member rotatable about a rotation shaft.

6. A cartridge according to claim 5, wherein in a state in which the opening is sealed with the sealing portion of said seal member and in which a region from the sealing portion to the mounting portion is made flat, a longitudinal direction of the sealing portion is substantially parallel to the rotation shaft and a longitudinal direction of the mounting portion is inclined with respect to the rotation shaft.

7. A cartridge according to claim 5, wherein in a state in which the opening is sealed with the sealing portion of said seal member and in which a region from the sealing portion to the mounting portion is made flat, a longitudinal direction of the sealing portion is substantially parallel to the rotation shaft and a longitudinal direction of the mounting portion is curved with respect to the rotation shaft.

8. A cartridge according to claim 5, wherein in a state in which the opening is sealed with the sealing portion of said seal member and in which a region from the sealing portion to the mounting portion is made flat, a longitudinal direction of the mounting portion is substantially parallel to the rotation shaft and a longitudinal direction of the sealing portion is inclined with respect to the rotation shaft.

9. A cartridge according to claim 5, wherein in a state in which the opening is sealed with the sealing portion of said seal member and in which a region from the sealing portion to the mounting portion is made flat, a longitudinal direction of the mounting portion is substantially parallel to the rotation shaft and a longitudinal direction of the sealing portion is curved with respect to the rotation shaft.

10. A cartridge according to claim 5, wherein in a state in which the opening is sealed with the sealing portion of said seal member and in which a region from the sealing portion to the mounting portion is made flat, a longitudinal direction of the mounting portion is inclined with respect to the rotation shaft, and a longitudinal direction of the sealing portion is curved with respect to the rotation shaft.

11. A cartridge according to claim 5, wherein in a state in which the opening is sealed with the sealing portion of said seal member and in which a region from the sealing portion to the mounting portion is made flat, a longitudinal direction of the sealing portion is inclined with respect to the rotation shaft, and a longitudinal direction of the mounting portion is curved with respect to the rotation shaft.

12. A cartridge according to claim 5, wherein in a state in which the opening is sealed with the sealing portion of said seal member and in which a region from the sealing portion to the mounting portion is made flat, a longitudinal direction of each of the mounting portion and the sealing portion is inclined with respect to the rotation shaft.

13. A cartridge according to claim 5, wherein in a state in which the opening is sealed with the sealing portion of said seal member and in which a region from the sealing portion to the mounting portion is made flat, a longitudinal direction of each of the mounting portion and the sealing portion is curved with respect to the rotation shaft.

14. A cartridge according to claim 6, wherein when a spacing length between the sealing portion and the mounting portion of said seal member is corrected correspondingly to flexure and torsion of rotation of the rotatable member, the spacing length is corrected by measuring a flexure amount and a torsion amount of the rotatable member at the moment when a part of the sealing portion is unsealed and then by reflecting, in the spacing length between the sealing portion and the mounting portion of said seal member, a correction loss length which is a sum of an additional loss length changed from an end to another end to unseal the sealing portion in a longitudinal direction and a composite loss cancel length for cancelling a composite loss length which is a sum of a flexure loss length obtained by converting the flexure amount into a winding up loss length of said seal member and a torsion loss length obtained by converting the torsion amount into the winding up loss length of said seal member.

15. A cartridge according to claim 1, wherein the unsealing member is constituted by a moving member for unsealing the opening by being moved.

16. A cartridge comprising:

a toner chamber, provided with an opening, for accommodating a toner;

an sealing member for unsealing the opening, said unsealing member not being manually operated; and a seal member including a sealing portion, elongated in a longitudinal direction of said cartridge, for unsealably sealing the opening and a mounting portion for being mounted on said unsealing member to unseal the opening, wherein, with respect to an unsealing direction crossing the longitudinal direction, a length between a longitudinal end portion of the sealing portion and a longitudinal end portion of the mounting portion is different from a length between another longitudinal end portion of the sealing portion and another end portion of the mounting portion.

17. A cartridge according to claim 16, wherein the mounting portion of said seal member is constituted by a plurality of portions.

18. A cartridge according to claim 16, wherein a rectilinear line along a longitudinal direction of the sealing portion and a rectilinear line along a longitudinal direction of the mounting portion are provided in crossable positions.

19. A cartridge according to claim 1, wherein said toner chamber is constituted by a flexible member.

20. A cartridge according to claim 5, wherein a longitudinal direction of an open side end portion of said seal member with respect to a winding direction in which said seal member is to be wound by the rotatable member and a longitudinal direction of the mounting portion provided in an end side of said seal member connected with the rotatable member are substantially parallel to each other.

21. A cartridge according to claim 5, wherein a side end portion of said seal member along a winding direction in which said seal member is to be wound by the rotatable member and a longitudinal direction of the mounting portion provided in an end side of said seal member connected with the rotatable member and substantially perpendicular to each other.

22. A developing cartridge comprising:

a cartridge according to claim 1; and a developer carrying member for supplying a developer to a surface of an image bearing member on which an electrostatic latent image is to be formed.

23. A process cartridge comprising:

a cartridge according to claim 1;

an image bearing member on which an electrostatic latent image is to be formed; and a developer carrying member for supplying a developer to a surface of said image bearing member.

24. An image forming apparatus for forming an image on a sheet, comprising:

a process cartridge according to claim 23, wherein said process cartridge is detachably mountable to said image forming apparatus.

25. A cartridge according to claim 16, wherein the length between the sealing portion and the mounting portion is shortened from the longitudinal end portion toward the longitudinal central portion.

26. A cartridge according to claim 16, wherein the direction crossing the longitudinal direction is a direction perpendicular to the longitudinal direction.

27. A cartridge according to claim 16, wherein the longitudinal end portion is located in a driving side where a driving force is to be transmitted to the unsealing member or in a non driving side opposite from the driving side.

28. A cartridge according to claim 16, wherein the unsealing member is constituted by a rotatable member rotatable about a rotation shaft.

29. A cartridge according to claim 28, wherein in a state in which the opening is sealed with the sealing portion of said seal member and in which a region from the sealing portion to the mounting portion is made flat, a longitudinal direction of the sealing portion is substantially parallel to the rotation shaft and a longitudinal direction of the mounting portion is inclined with respect to the rotation shaft.

30. A cartridge according to claim 28, wherein in a state in which the opening is sealed with the sealing portion of said seal member and in which a region from the sealing portion to the mounting portion is made flat, a longitudinal direction of the sealing portion is substantially parallel to the rotation shaft and a longitudinal direction of the mounting portion is curved with respect to the rotation shaft.

31. A cartridge according to claim 28, wherein in a state in which the opening is sealed with the sealing portion of said seal member and in which a region from the sealing portion to the mounting portion is made flat, a longitudinal direction of the mounting portion is substantially parallel to the rotation shaft and a longitudinal direction of the sealing portion is inclined with respect to the rotation shaft.

32. A cartridge according to claim 28, wherein in a state in which the opening is sealed with the sealing portion of said seal member and in which a region from the sealing portion to the mounting portion is made flat, a longitudinal direction of the mounting portion is substantially parallel to the rotation shaft and a longitudinal direction of the sealing portion is curved with respect to the rotation shaft.

33. A cartridge according to claim 28, wherein in a state in which the opening is sealed with the sealing portion of said seal member and in which a region from the sealing portion to the mounting portion is made flat, a longitudinal direction of the mounting portion is inclined with respect to the rotation shaft, and a longitudinal direction of the sealing portion is curved with respect to the rotation shaft.

34. A cartridge according to claim 28, wherein in a state in which the opening is sealed with the sealing portion of said seal member and in which a region from the sealing portion to the mounting portion is made flat, a longitudinal direction of the sealing portion is inclined with respect to the rotation shaft, and a longitudinal direction of the mounting portion is curved with respect to the rotation shaft.

35. A cartridge according to claim 28, wherein in a state in which the opening is sealed with the sealing portion of said seal member and in which a region from the sealing portion to the mounting portion is made flat, a longitudinal direction of each of the mounting portion and the sealing portion is inclined with respect to the rotation shaft.

36. A cartridge according to claim 28, wherein in a state in which the opening is sealed with the sealing portion of said seal member and in which a region from the sealing portion to the mounting portion is made flat, a longitudinal direction of each of the mounting portion and the sealing portion is curved with respect to the rotation shaft.

37. A cartridge according to claim 29, wherein when a spacing length between the sealing portion and the mounting portion of said seal member is corrected correspondingly to flexure and torsion of rotation of the rotatable member, the spacing length is corrected by measuring a flexure amount and a torsion amount of the rotatable member at the moment when a part of the sealing portion is unsealed and then by reflecting, in the spacing length between the sealing portion and the mounting portion of said seal member, a correction loss length which is a sum of an additional loss length changed from an end to another end to unseal the sealing portion in a longitudinal direction and a composite loss cancel length for cancelling a composite loss length which is a sum of a flexure loss length obtained by converting the flexure amount into a winding up loss length of said seal member and a torsion loss length obtained by converting the torsion amount into the winding up loss length of said seal member.

38. A cartridge according to claim 16, wherein the unsealing member is constituted by a moving member for unsealing the opening by being moved.

39. A cartridge according to claim 28, wherein a longitudinal direction of an open side end portion of said seal member with respect to a winding direction in which said seal member is to be wound by the rotatable member and a longitudinal direction of the mounting portion provided in an end side of said seal member connected with the rotatable member are substantially parallel to each other.

40. A cartridge according to claim 28, wherein a side end portion of said seal member along a winding direction in which said seal member is to be wound by the rotatable member and a longitudinal direction of the mounting portion provided in an end side of said seal member connected with the rotatable member and substantially perpendicular to each other.

41. A developing cartridge comprising:

a cartridge according to claim 16; and a developer carrying member for supplying a developer to a surface of an image bearing member on which an electrostatic latent image is to be formed.

42. A process cartridge comprising:

a cartridge according to claim 16;

an image bearing member on which an electrostatic latent image is to be formed; and a developer carrying member for supplying a developer to a surface of said image bearing member.

43. An image forming apparatus for forming an image on a sheet, comprising:

a process cartridge according to claim 42, wherein said process cartridge is detachably mountable to said image forming apparatus.

44. A cartridge comprising:

a toner chamber, provided with an opening, for accommodating a toner;

an unsealing member for unsealing the opening, said unsealing member not being manually operated;

a seal member including a sealing portion, elongated in a longitudinal direction of said cartridge, for unsealably sealing the opening and a mounting portion for being mounted on said unsealing member to unseal the opening, wherein the sealing portion includes a first sealing portion located at a longitudinal end portion and a second sealing portion located at a longitudinal central portion, and wherein, with respect to an unsealing direction crossing the longitudinal direction, a length between the first sealing portion and the mounting portion of said seal member is longer than a length between the second sealing portion and the mounting portion.

45. A cartridge according to claim 44, wherein the length between the sealing portion and the mounting portion is shortened from the longitudinal end portion toward the longitudinal central portion.

46. A cartridge according to claim 44, wherein the direction crossing the longitudinal direction is a direction perpendicular to the longitudinal direction.

47. A cartridge according to claim 44, wherein the longitudinal end portion is located in a driving side where a driving force is to be transmitted to the unsealing member or in a non-driving side opposite from the driving side.

48. A cartridge according to claim 44, wherein the unsealing member is constituted by a rotatable member rotatable about a rotation shaft.

49. A cartridge according to claim 48, wherein in a state in which the opening is sealed with the sealing portion of said seal member and in which a region from the sealing portion to the mounting portion is made flat, a longitudinal direction of the sealing portion is substantially parallel to the rotation shaft and a longitudinal direction of the mounting portion is inclined with respect to the rotation shaft.

50. A cartridge according to claim 48, wherein in a state in which the opening is sealed with the sealing portion of said seal member and in which a region from the sealing portion to the mounting portion is made flat, a longitudinal direction of the sealing portion is substantially parallel to the rotation shaft and a longitudinal direction of the mounting portion is curved with respect to the rotation shaft.

51. A cartridge according to claim 48, wherein in a state in which the opening is sealed with the sealing portion of said seal member and in which a region from the sealing portion to the mounting portion is made flat, a longitudinal direction of the mounting portion is substantially parallel to the rotation shaft and a longitudinal direction of the sealing portion is inclined with respect to the rotation shaft.

52. A cartridge according to claim 48, wherein in a state in which the opening is sealed with the sealing portion of said seal member and in which a region from the sealing portion to the mounting portion is made flat, a longitudinal direction of the mounting portion is substantially parallel to the rotation shaft and a longitudinal direction of the sealing portion is curved with respect to the rotation shaft.

53. A cartridge according to claim 48, wherein in a state in which the opening is sealed with the sealing portion of said seal member and in which a region from the sealing portion to the mounting portion is made flat, a longitudinal direction of the mounting portion is inclined with respect to the rotation shaft, and a longitudinal direction of the sealing portion is curved with respect to the rotation shaft.

54. A cartridge according to claim 48, wherein in a state in which the opening is sealed with the sealing portion of said seal member and in which a region from the sealing portion to the mounting portion is made flat, a longitudinal direction of the sealing portion is inclined with respect to the rotation shaft, and a longitudinal direction of the mounting portion is curved with respect to the rotation shaft.

55. A cartridge according to claim 48, wherein in a state in which the opening is sealed with the sealing portion of said seal member and in which a region from the sealing portion to the mounting portion is made flat, a longitudinal direction of each of the mounting portion and the sealing portion is inclined with respect to the rotation shaft.

56. A cartridge according to claim 48, wherein in a state in which the opening is sealed with the sealing portion of said seal member and in which a region from the sealing portion to the mounting portion is made flat, a longitudinal direction of each of the mounting portion and the sealing portion is curved with respect to the rotation shaft.

57. A cartridge according to claim 49, wherein when a spacing length between the sealing portion and the mounting portion of said seal member is corrected correspondingly to flexure and torsion of rotation of the rotatable member, the spacing length is corrected by measuring a flexure amount and a torsion amount of the rotatable member at the moment when a part of the sealing portion is unsealed and then by reflecting, in the spacing length between the sealing portion and the mounting portion of said seal member, a correction loss length which is a sum of an additional loss length changed from an end to another end to unseal the sealing portion in a longitudinal direction and a composite loss cancel length for cancelling a composite loss length which is a sum of a flexure loss length obtained by converting the flexure amount into a winding up loss length of said seal member and a torsion loss length obtained by converting the torsion amount into the winding up loss length of said seal member.

58. A cartridge according to claim 44, wherein the unsealing member is constituted by a moving member for unsealing the opening by being moved.

59. A cartridge according to claim 44, wherein said toner chamber is constituted by a flexible member.

60. A cartridge according to claim 48, wherein a longitudinal direction of an open side end portion of said seal member with respect to a winding direction in which said seal member is to be wound by the rotatable member and a longitudinal direction of the mounting portion provided in an end side of said seal member connected with the rotatable member are substantially parallel to each other.

61. A cartridge according to claim 48, wherein a side end portion of said seal member along a winding direction in which said seal member is to be wound by the rotatable member and a longitudinal direction of the mounting portion provided in an end side of said seal member connected with the rotatable member and substantially perpendicular to each other.

62. A developing cartridge comprising:

a cartridge according to claim 44; and a developer carrying member for supplying a developer to a surface of an image bearing member on which an electrostatic latent image is to be formed.

63. A process cartridge comprising:

a cartridge according to claim 44;

an image bearing member on which an electrostatic latent image is to be formed; and a developer carrying member for supplying a developer to a surface of said image bearing member.

64. An image forming apparatus for forming an image on a sheet, comprising:

a process cartridge according to claim 63, wherein said process cartridge is detachably mountable to said image forming apparatus.

65. A seal member and unsealing member combination, wherein said sealing member includes a sealing portion elongated in a first direction of a cartridge, for unsealably sealing an opening and a mounting portion for being mounted on said unsealing member to unseal the opening, wherein the sealing portion includes a first sealing portion located at a first end portion and a second sealing portion located at a first central portion, wherein, with respect to a second direction crossing the first direction, a length between the first sealing portion and the mounting portion is longer than a length between the second sealing portion and the mounting portion, and wherein said unsealing member is not manually operated.

66. A cartridge according to claim 1, wherein said unsealing member is capable of stirring the toner in said toner chamber.

67. A cartridge according to claim 16, wherein said unsealing member is capable of stirring the toner in said toner chamber.

68. A cartridge according to claim 44, wherein said unsealing member is capable of stirring the toner in said toner chamber.

69. A combination according to claim 65, wherein said unsealing member is capable of stirring toner in a toner chamber.

70. A cartridge according to claim 1, wherein a longitudinal direction of said unsealing member and a longitudinal direction of a developer carrying member are parallel to each other.

71. A cartridge according to claim 16, wherein a longitudinal direction of said unsealing member and a longitudinal direction of a developer carrying member are parallel to each other.

72. A cartridge according to claim 44, wherein a longitudinal direction of said unsealing member and a longitudinal direction of a developer carrying member are parallel to each other.

73. A combination according to claim 65, wherein a longitudinal direction of said unsealing member and a longitudinal direction of a developer carrying member are parallel to each other.

74. A cartridge comprising:

a toner chamber, provided with an opening, for accommodating a toner;

an unsealing member for unsealing the opening, said unsealing member receiving a rotational force that is transmitted through a plurality of gears; and a seal member including (i) a sealing portion, elongated in a longitudinal direction of said cartridge, for unsealably sealing the opening and (ii) a mounting portion for being mounted on said unsealing member to unseal the opening, wherein the sealing portion includes a first sealing portion located at a longitudinal end portion and a second sealing portion located at a longitudinal central portion, and wherein, with respect to an unsealing direction crossing the longitudinal direction, a length between the first sealing portion and the mounting portion of said seal member is shorter than a length between the second sealing portion and the mounting portion.

75. A cartridge comprising:

a toner chamber, provided with an opening, for accommodating a toner;

an sealing member for unsealing the opening, said unsealing member receiving a rotational force that is transmitted through a plurality of gears; and a seal member including a sealing portion, elongated in a longitudinal direction of said cartridge, for unsealably sealing the opening and a mounting portion for being mounted on said unsealing member to unseal the opening, wherein, with respect to an unsealing direction crossing the longitudinal direction, a length between a longitudinal end portion of the sealing portion and a longitudinal end portion of the mounting portion is different from a length between another longitudinal end portion of the sealing portion and another end portion of the mounting portion.

76. A cartridge comprising:

a toner chamber, provided with an opening, for accommodating a toner;

an unsealing member for unsealing the opening, said unsealing member receiving a rotational force that is transmitted through a plurality of gears;

a seal member including a sealing portion, elongated in a longitudinal direction of said cartridge, for unsealably sealing the opening and a mounting portion for being mounted on said unsealing member to unseal the opening, wherein the sealing portion includes a first sealing portion located at a longitudinal end portion and a second sealing portion located at a longitudinal central portion, and wherein, with respect to an unsealing direction crossing the longitudinal direction, a length between the first sealing portion and the mounting portion of said seal member is longer than a length between the second sealing portion and the mounting portion.

* * * * *